US007459255B2

(12) United States Patent
Tanaka et al.

(10) Patent No.: US 7,459,255 B2
(45) Date of Patent: Dec. 2, 2008

(54) TONER AND DEVELOPER, TONER CONTAINER, PROCESS CARTRIDGE, IMAGE-FORMING APPARATUS, AND IMAGE-FORMING METHOD USING THE SAME

(75) Inventors: Chiaki Tanaka, Shizuoka (JP); Naohiro Watanabe, Shizuoka (JP); Masahiro Ohki, Numazu (JP); Masahide Yamada, Numazu (JP); Akinori Saitoh, Numazu (JP); Sonoh Matsuoka, Numazu (JP); Ryota Inoue, Numazu (JP); Shigeru Emoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 497 days.

(21) Appl. No.: 11/227,215

(22) Filed: Sep. 16, 2005

(65) Prior Publication Data

US 2006/0063089 A1 Mar. 23, 2006

(30) Foreign Application Priority Data

Sep. 17, 2004 (JP) ..... 2004-272511

(51) Int. Cl.
*G03G 9/08* (2006.01)

(52) U.S. Cl. ..... 430/110.3; 430/137.1; 430/137.15; 430/124.1

(58) Field of Classification Search ..... 430/110.3, 430/137.15, 137.1, 124.1
See application file for complete search history.

(56) References Cited

U.S. PATENT DOCUMENTS

| | | | | |
|---|---|---|---|---|
| 2,297,691 | A | 10/1942 | Carlson | |
| 2005/0003291 | A1 | 1/2005 | Takada et al. | |
| 2005/0026066 | A1 | 2/2005 | Tanaka et al. | |
| 2005/0031980 | A1 | 2/2005 | Inoue et al. | |
| 2005/0042534 | A1 * | 2/2005 | Tanaka et al. | 430/108.4 |
| 2005/0164112 | A1 | 7/2005 | Ohki et al. | |

FOREIGN PATENT DOCUMENTS

| | | |
|---|---|---|
| JP | 62-266550 | 11/1987 |
| JP | 2-51164 | 2/1990 |
| JP | 5-66600 | 3/1993 |
| JP | 8-211655 | 8/1996 |
| JP | 10-20552 | 1/1998 |

(Continued)

OTHER PUBLICATIONS

U.S. Appl. No. 11/852,778, filed Sep. 10, 2007, Nagatomo, et al.

(Continued)

*Primary Examiner*—John L Goodrow
(74) *Attorney, Agent, or Firm*—Oblon, Spivak, McClelland, Maier & Neustadt, P.C.

(57) ABSTRACT

An object of the present invention is to provide a toner having small-sized and potato-shaped particles created from multiple coherent spherical particles for excellent cleaning ability and high image quality, an image-forming method that realizes high image quality using the toner, and the like. To this end, there is provided a toner, which is produced by granulating toner materials as an organic phase comprising at least a binder resin and a colorant in an aqueous medium and has potato-shaped particles created from multiple coherent primary oil droplets of the organic phase in the aqueous medium.

27 Claims, 11 Drawing Sheets

FOREIGN PATENT DOCUMENTS

| | | |
|---|---|---|
| JP | 11-7156 | 1/1999 |
| JP | 2002-351139 | 12/2002 |

OTHER PUBLICATIONS

U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 11/685,969, filed Mar. 14, 2007, Uchinokura, et al.
U.S. Appl. No. 11/513,175, filed Aug. 31, 2006, Ohki, et al.
U.S. Appl. No. 11/520,642, filed Sep. 14, 2006, Chiaki Tanaka, et al.
U.S. Appl. No. 11/519,893, filed Sep. 13, 2006, Ryota Inoue, et al.
U.S. Appl. No. 12/026,937, filed Feb. 6, 2008, Seshita, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/046,011, filed Mar. 11, 2008, Nagatomo, et al.
U.S. Appl. No. 11/227,215, filed Sep. 15, 2005, Tanaka, et al.*
U.S. Appl. No. 11/676,883, filed Feb. 20, 2007, Tanaka.*
U.S. Appl. No. 11/687,075, filed Mar. 16, 2007, Yamada, et al.*
U.S. Appl. No. 11/685,872, filed Mar. 14, 2007, Uchinokura, et al.*
U.S. Appl. No. 11/687,372, filed Mar. 16, 2007, Yamada, et al.*

* cited by examiner $$\sqrt{\tau}-\sqrt{\tau_0}=\sqrt{E_{ta}\times D}$$

TONER AND DEVELOPER, TONER CONTAINER, PROCESS CARTRIDGE, IMAGE-FORMING APPARATUS, AND IMAGE-FORMING METHOD USING THE SAME

BACKGROUND OF THE INVENTION

1. Field of the Invention

The present invention relates to a toner for developing static charge images in electro-photography, electrostatic recording, and electrostatic printing, and a developer, a toner container, a process cartridge, an image-forming apparatus, and an image-forming method, using the toner.

2. Description of the Related Art

Generally, in electro-photography, images are formed by a series of processes including forming a static charge image on a photoconductor (a static charge image bearing member), developing the static charge image using a developer to form a visible image (a toner image), and transferring and fixing the visible image to a recording medium such as a sheet of paper to form a fixed image (see the U.S. Pat. No. 2,297,691). The remaining toner that is not transferred to the recording medium is cleaned off by a cleaning member such as a blade pressed against the photoconductor surface.

For developers, one-component developers using alone a magnetic or non-magnetic toner and two-component developers comprising a toner and a carrier are known. Toners are usually produced by a kneading and pulverizing method in which a thermoplastic resin is melted and mixed with a pigment, a releasing agent such as wax, and a charge controlling agent, pulverized, and then classified. Fine inorganic particles or fine organic particles are added to the surface of toner particles for improved flowability and cleaning ability where necessary.

The toner produced by the aforementioned kneading and pulverizing method generally has wide particle diameter distribution and easily experiences non-uniform frictional charges and, therefore, fogs. Considering production efficiency, it is difficult to obtain smaller toner particles having a volume average particle diameter of 2 μm to 8 μm. Therefore, demand for high image quality is not satisfied.

Toners granulated in an aqueous phase are a focus of interest. Such toners have a narrow particle diameter distribution, are easily made smaller in particle diameter, allowing for high quality and highly fine images, and are excellent in terms of offset resistance due to highly dispersed releasing agents and in fixing properties at low temperature. Being uniformly charged, the toner has excellent transfer properties, and also has excellent flowability. It is advantageous in designing a hopper and a developing apparatus because a smaller torque is required for rotating the developing roll.

Prior art methods for granulating the toner in an aqueous phase involve polymerization or emulsification and dispersion. The toners obtained by these methods (occasionally referred to as the chemical toner, hereafter) have been developed.

A variety of polymerization methods are known, and include a well known suspension polymerization method, in which monomers, a polymerization initiator, colorants, and a charge controlling agent are added and stirred into an aqueous phase containing a dispersion stabilizer to form oil droplets, which is heated for a polymerization reaction to obtain toner particles. An association method is proposed in which fine particles are formed by emulsion polymerization or suspension polymerization, the fine particles are aggregated, and the aggregated fine particles are allowed to fusion bond to obtain toner particles.

The toners obtained by the aforementioned polymerization or association method can have a smaller toner particle diameter. However, the main component of their binder resin is limited to radical-polymerizable vinyl polymers and, therefore, the use of polyester and epoxy resins that are preferable for color toners is not allowed. The polymerization method also has the problem of difficulty in reducing VOCs (volatile organic compounds comprising un-reacted monomers) and to obtain a toner with a narrow particle diameter distribution.

The emulsification and dispersion method is a method in which a mixture of a binder resin, colorants, and other components is mixed with an aqueous phase and emulsified to obtain toner particles (see Japanese Patent Application Laid-Open (JP-A) Nos. 5-66600 and 8-211655). Like the polymerization method, the toner can easily have a smaller particle diameter and a spherical particle shape. In addition, this method has the advantages of having more options for a binder resin compared to the polymerization method, ease of reducing residual monomers, and colorants and other components can be used at any concentration, from low to high.

It is preferable that a binder resin be fixed at low temperature and rapidly melt during fixation to make the image surface smooth. For example, polyester resin is more preferable than styrene-acrylic resin. Particularly, highly flexible polyester resin is preferable for color toners. Recent focus has been given to an emulsification and dispersion method for producing a small particle toner containing polyester resin as a binder resin. Such a toner cannot be produced by the aforementioned polymerization method.

However, toner produced by the emulsification and dispersion method also fails to allow for low fixation temperatures and wider offset resistance temperature ranges. In addition, the creation of fine particles during the production process and some emulsification loss are inevitable, which reduces the toner yield and, therefore, the productivity.

In order to resolve these problems, a method is proposed in which, after emulsification and dispersion, polyester resin is used as a binder resin, the obtained fine particles are aggregated and bonded by fusion to produce toner particles (see JP-A Nos. 10-020552 and 11-007156). This method does not produce superfine particles. Hence, there is no emulsification loss, or toner having a sharp particle diameter distribution and, therefore, no classification can be obtained. Used polyester resin mainly has a straight-chain structure or a low viscosity. Low temperature fixing properties and high temperature offset resistance cannot be simultaneously obtained, making the toner unsuitable for recently desired oil-less heat roll fixation.

Such chemical toners essentially have a spherical shape because of the interfacial tension of oil droplets that occurs in the dispersion process. The spherical toner particles are flowable even if they are of small particle diameter. This is advantageous in designing a hopper and a development apparatus because a smaller torque is required for rotating the developing roll. On the other hand, it is difficult for some cleaning systems to clean them off. The photoconductor surface is cleaned by a unit such as a blade, a fur brush, or a magnetic brush after a toner image is transferred. Among these, blade cleaning is generally used because it has a simple structure and high cleaning ability. In blade cleaning, spherical toner particles are rotated and infiltrate between the cleaning blade and photoconductor, which makes cleaning difficult.

For applying chemical toners to blade cleaning, a method is proposed in which high speed stirring is conducted before the polymerization ends, applying a mechanical force to the particles so as to give the polymerized particles irregular shapes (see JP-A No. 62-266550). However, this method disturbs a stable dispersion state and accelerates association between particles, potentially leading to a mass of polymers. It is difficult to control stirring, making the method impractical.

Alternatively, for example, a method is proposed in which polyvinyl alcohol having a specific saponification value is used as a dispersant to aggregate particles to associated particles of 5 μm to 25 μm for improved cleaning ability (see JP-A No. 2-51164). However, the associated particles are easily grown to larger particle diameters using this method. Therefore, it is not suitable for producing small-particle toners.

In another proposed method, irregularly shaped particles are formed by the phase reversal emulsification, followed by removal of organic solvent, which is stopped mid-way, aggregation, and fusion bonding (see JP-A No. 2002-351139). This method requires a self-emulsifying resin and has significant limitations on the type and acid number of resin, which leaves few options for materials. Controlling the shape by stopping the removal of organic solvent mid-way requires many steps of fine adjustments and controls, increasing costs in view of facility and productivity. In practice, this method is not suitable for mass production.

Hence, in fact, a toner having irregularly shaped particles for excellent cleaning ability (for example, not suffering from poor blade cleaning) and for high image quality while maintaining the advantages of chemical toners such as small particle diameters, narrow particle diameter distributions, and flowability has not been provided.

SUMMARY OF THE INVENTION

An object of the present invention is to provide a toner having small-sized and potato-shaped particles created from multiple coherent spherical particles for excellent cleaning ability and high image quality and a developer, a toner container, a process cartridge, an image-forming apparatus, and an image-forming method, which all realize high image quality using the toner.

The present invention provides, in the first aspect, a toner, which is produced by granulating toner materials as an organic phase comprising at least a binder resin and a colorant in an aqueous medium, wherein the toner has potato-shaped particles created from multiple coherent primary oil droplets of the organic phase in the aqueous medium. Consequently, the toner of the present invention has excellent cleaning ability and low temperature fixing property and realizes high image quality.

The present invention provides, in the second aspect, a toner, which is produced by granulating in an aqueous medium comprising at least a binder resin and a colorant, wherein the toner contains less than 10% by number of cracked or disintegrated toner particles per 1000 toner particles in electronic microscopic observation after 50 g of a developer consisting of 2.5 g of the toner and 47.5 g of a carrier is stirred in a 100 ml jar at 50 Hz for 30 minutes using a paint conditioner. Consequently, the toner of the present invention has excellent cleaning ability and low temperature fixing property and realizes high image quality.

The present invention provides a developer comprising the toner according to the first or second aspect of the present invention.

Therefore, when the developer is used to form images in electro-photography, highly dense and clear, high quality images can be obtained.

The present invention provides a toner container, which is supplied with the toner according to the first or second aspect of the present invention. Therefore, when the toner supplied with the toner container is used to form images in electrophotography, highly dense and clear, high quality images can be obtained.

The present invention provides a process cartridge comprising at least a latent electrostatic image bearing member and a developing unit configured to develop a latent electrostatic image formed on the latent electrostatic image bearing member using the toner according to the first or second aspect of the present invention, thereby forming a visible image. The process cartridge is detachably mounted on an image-forming apparatus, significantly convenient, and realizes highly dense and clear, high quality images because the toner of the present invention is used.

The present invention provides an image-forming apparatus comprising: at least a latent electrostatic image bearing member; a latent electrostatic image-forming unit configured to form a latent electrostatic image on the latent electrostatic image bearing member; a developing unit configured to develop the latent electrostatic image using the toner according to the first or second aspect of the present invention, thereby forming a visible image; a transferring unit for transferring the visible image onto a recording medium; and a fixing unit for fixing the image transferred onto the recording medium. In this image-forming apparatus, the latent electrostatic image-forming unit forms a latent electrostatic image on the latent electrostatic image bearing member. The developing unit develops the latent electrostatic image using the toner of the present invention to form a visible image. The transferring unit transfers the visible image onto a recording medium. The fixing unit fixes the transferred image on the recording medium. Consequently, a highly dense and clear, high quality image is obtained.

The present invention provides an image-forming method comprising: forming a latent electrostatic image on a latent electrostatic image bearing member; developing the latent electrostatic image using the toner according to the first or second aspect of the present invention, thereby forming a visible image; transferring the visible image onto a recording medium; and fixing the transferred image on the recording medium. In this image-forming apparatus, an electrostatic image is formed on a latent electrostatic image bearing member at the latent electrostatic image-forming step. The latent electrostatic image is developed using the toner of the present invention, thereby a visible image is formed in the developing step. The visible image is transferred onto a recording medium at the transfer step. The transferred image on the recording medium is fixed at the fixing step. Consequently, a highly dense and clear, high quality image is obtained.

DESCRIPTION OF THE PREFERRED EMBODIMENTS (Toner)

The toner according to the present invention is, in the first embodiment, a toner which is produced by granulating toner materials as an organic phase comprising at least a binder resin and a colorant in an aqueous medium, wherein the toner has potato-shaped particles created from multiple coherent primary oil droplets (spherical particles) of the organic phase in the aqueous medium.

Preferably, the organic phase is a solution and/or a dispersion of at least the binder resin and colorant dissolved and/or dispersed in an organic solvent.

Preferably, the organic phase comprises at least a polymerizable monomer and the colorant. Multiple primary oil droplets (spherical particles) of the organic phase can cohere with each other while the monomer's polymerization is in progress and they are viscous. For aggregating polymerized resin particles, unlike heating the aggregates, multiple primary oil droplets (spherical particles) can progressively cohere with each other in a state of viscous fluid. Therefore, a toner that has very few cracked or disintegrated particles at the coherent interface can be obtained. Heating to a melting or softening temperature, which requires a significant energy load in the toner production, can be eliminated, therefore remarkably increasing productivity.

Figure 1A:
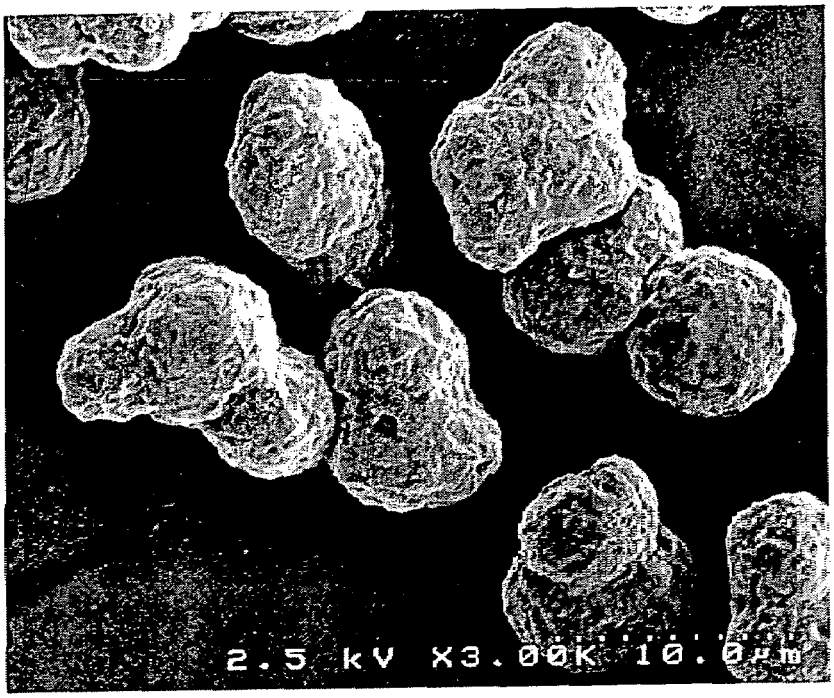
FIG. 1A is an electron microscopic photograph of potato-shaped toner particles produced in Example 1.
Figure 1B:
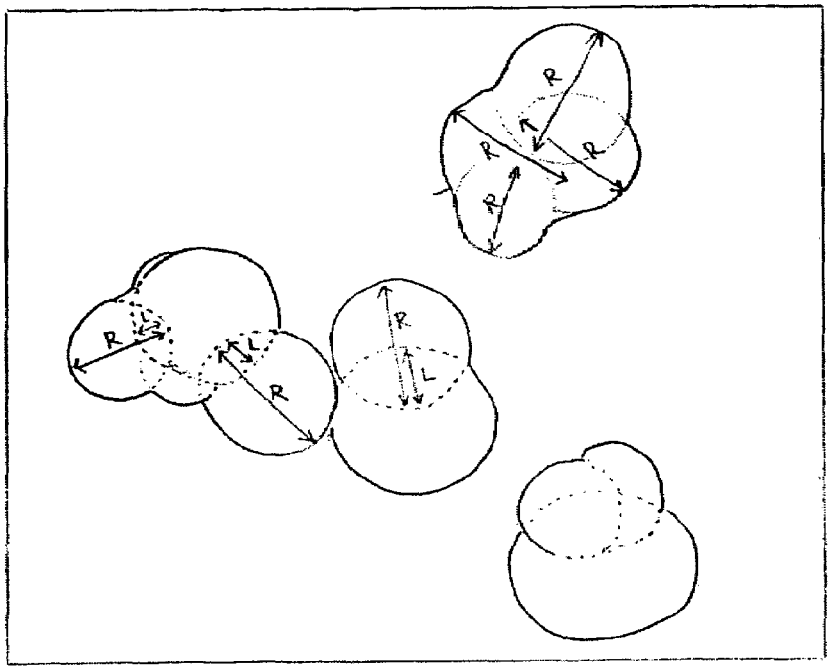
FIG. 1B is a schematic illustration of the FIG. 1A.

The potato-shaped particles created from multiple coherent primary oil droplets (spherical particles) mean a particle formed by at least two spherical particles connected at the coherent part (the coherent part) as shown in FIG. 1A that is an electron microscopic photograph and FIG. 1B that is a schematic illustration of FIG. 1A. Preferably, the potato-shaped particles satisfy $0.1\ R \leqq L < 1.0\ R$, more preferably $0.3\ R \leqq L < 0.9\ R$, in which R (μm) is the diameter of a spherical particle and L (μm) is the length along the depth of the coherent part between spherical particles. When R and L do not satisfy the formula, the potato-shaped toner particles may not be obtained, therefore failing to achieve the purpose and efficacy of the present invention.

The diameter R (μm) of a spherical particle or a primary oil droplet of the organic phase and the length L (μm) along the depth of the coherent part between spherical particles can be measured, for example, using a scanning electron microscope (SEM).

Preferably, the toner contains 30% by number to 100% by number, more preferably 40% by number to 100% by number, of potato-shaped toner particles per 100 toner particles in electronic microscopic observation. When the toner contains less than 30% by number of the potato-shaped toner particles, it may have deteriorated cleaning ability.

Preferably, the toner has a particle shape formed by 2 to 20 (preferably 3 to 15) coherent spherical particles and contains 30% by number to 100% by number (preferably 40% by number to 100% by number) of the potato-shaped toner particles per 100 toner particles in electronic microscopic observation, and an imaginary circle around the spherical particles has a number-average diameter R of 0.5 μm to 7 μm (preferably 1 μm to 6 μm).

The toner according to the present invention is, in the second embodiment, a toner which is produced by granulating in an aqueous medium comprising at least a binder resin and a colorant, wherein the toner contains 10% by number or less of cracked or disintegrated toner particles per 1000 toner particles in a specific cracking resistance test and further contains other components if necessary. The toner contains 10% by number or less, preferably 5% by number or less, more preferably 1% by number or less, and most preferably 0% by number, of cracked or disintegrated toner particles per 1000 toner particles in the aforementioned cracking resistance test.

When the toner contains a larger ratio of cracked or disintegrated particles, fine powder is produced, which may result in contaminating the carrier and impairing the image quality, and it becomes difficult to ensure charging on cracked surfaces, which also may result in impairing the image quality. In the present invention, polyester resin is dissolved in an organic solvent to create a non-Newtonian state. Individual granulated particles can be coupled to each other without forming an interface because the resin is dissolved in the solvent. This prevents the particles from becoming cracked or disintegrated.

The cracked or disintegrated toner particles include partly cracked, half cracked, and largely cracked (disintegrated) toner particles.

In the aforementioned cracking resistance test, 50 g of a developer consisting of 2.5 g of the toner and 47.5 g of a carrier is introduced and stirred in a 100 ml jar (by Nichiden-Rika Glass Co., Ltd.) at 50 Hz for 30 minutes using a paint conditioner and, then, the toner is separated by an electric field separation and observed in scanning electron microscopy (SEM). The SEM observation reveals the ratio (% by number) of cracked or disintegrated toner particles in 1000 toner particles.

The toners of the present invention in the first and second embodiments are not particularly restricted in production methods and materials as long as they satisfy the aforementioned conditions and can be appropriately selected according to the purpose. For example, they are preferably produced by the first and second modes of the toner production method below.

The first mode of the toner production method at least comprises emulsifying and/or dispersing an oil phase in an aqueous phase to form oil droplets and converging the oil droplets. The oil droplets exhibit a non-Newtonian viscosity during the convergence.

The second mode of the toner production method at least comprise emulsifying and/or dispersing an oil phase containing an organic solvent in an aqueous phase to form oil droplets and removing the organic solvent from the oil droplets. The oil droplets exhibit a non-Newtonian viscosity during the removal of organic solvent.

Preferred embodiments of the toner according to the present invention include a toner produced by dissolving and/or dispersing toner materials including at least an active hydrogen group-containing compound and a polymer that is reactive with the active hydrogen group-containing compound in an organic solvent to form an oil phase, emulsifying and/or dispersing the oil phase in an aqueous phase, and reacting the active hydrogen group-containing compound with the polymer that is reactive with the active hydrogen group-containing compound in the aqueous phase to produce a particles containing at least an adhesive base material.

The oil droplets can exhibit a Newtonian viscosity or a non-Newtonian viscosity.

The Newtonian viscosity complies with the Newtonian viscosity law in which the shear stress is proportional to the shear speed (in other words, when the shear speed is gradually increased from zero, the shear stress is gradually increased from zero in proportion to increase in the shear speed) and the viscosity coefficient is fixed at a fixed temperature.

On the other hand, the non-Newtonian viscosity does not comply with the Newtonian viscosity law. The apparent viscosity coefficient is changed according to the shear stress (or shear speed).

The Newtonian viscosity in the present invention includes states that have a structural viscosity described later, but are similar to the aforementioned Newtonian viscosity because the structural viscosity is weak, such as those having a Casson yield value of 0.5 Pa or smaller, which is described later.

The non-Newtonian viscosity includes structural viscosity and dilatancy.

The apparent viscosity coefficient is decreased as the shear stress is increased in the structural viscosity. Conversely, the viscosity coefficient is increased in the dilatancy.

General structural viscosity is discussed in many publications such as "Rheology for Chemists" (Shigeharu Onogi, Kagaku-Dojin, p. 37)

Structural viscosity includes thixotropy and rheopexy. The shear speed depends on the shear stress and the time during which the shear stress is applied in the thixotropy. In other words, the viscosity is decreased and the flowability is increased when the shear stress is applied; however, the initial solidity is recovered after standing.

Contrary to the thixotropy, the viscosity is increased when allowed to flow at a fixed shear speed in the rheopexy.

The Newtonian and non-Newtonian viscosities can be reversibly converted by viscosity conversion in which the viscosity of oil droplets is changed.

Generally, the viscosity conversion can be the non-Newtonian to Newtonian viscosity conversion or the Newtonian to non-Newtonian viscosity conversion.

In the present invention, the oil droplets exhibit a non-Newtonian viscosity during the convergence or the removal of organic solvent. Therefore, the viscosity conversion is unnecessary. In the aforementioned first mode of the toner production method, the oil droplets should exhibit a non-Newtonian viscosity by the time of the convergence at the latest after the oil droplets are formed. In the aforementioned second mode of the toner production method, the oil droplets should exhibit a non-Newtonian viscosity by the time of the removal of organic solvent the latest after the oil droplets are formed. If the oil droplets exhibit a Newtonian viscosity after the convergence, the viscosity conversion can be performed to convert the viscosity of the oil droplets to a non-Newtonian viscosity before the removal of organic solvent.

The non-Newtonian to Newtonian viscosity conversion method is not particularly limited and may be appropriately selected in accordance with a purpose. Examples of the method include stirring and vibration.

The Newtonian to non-Newtonian viscosity conversion method is not particularly limited and may be appropriately selected in accordance with a purpose. Examples of the method include addition of irregular shaping agents (viscosity control agents, thixotropy furnishing agents). The Newtonian to non-Newtonian viscosity conversion method includes a method in which the oil droplets are allowed to stand to recover a structural viscosity that is lost over time in the case that the oil droplets exhibiting a non-Newtonian viscosity is stirred in the aforementioned stirring process and their structural viscosity is destroyed; therefore, the oil droplets temporarily exhibit a Newtonian viscosity.

-Oil Phase-

The oil phase contains toner materials including any of a monomer, a polymer, an active hydrogen group-containing compound and a polymer (prepolymer) that is reactive with the hydrogen-containing compound and, where necessary, other components such as colorants, releasing agents, and charge controlling agents. The oil phase preferably contains an organic solvent, the toner materials being dissolved in the organic solvent.

The organic solvent is not particularly limited, and may be appropriately selected in accordance with a purpose, provided that the organic solvent allows the toner material to be dissolved and/or dispersed therein. It is preferable that the organic solvent is a volatile organic solvent having a boiling point of less than 150° C. in view of easy removal from the solution or dispersion. Suitable examples thereof are toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like. Among these solvents, toluene, xylene, benzene, methylene chloride, 1,2-dichloroethane, chloroform, carbon tetrachloride are preferable. Ethyl acetate is more preferable. These solvents can be selected singly or in combination of two or more The usage amount of the organic solvent is not particularly limited and may be appropriately adjusted in accordance with a purpose. It is preferable from 40 parts by mass to 300 parts by mass, more preferably from 60 parts by mass to 140 parts by mass, and furthermore preferably from 80 parts by mass to 120 parts by mass with respect to 100 parts by mass of the toner material.

-Active Hydrogen Group-Containing Compound-

The active hydrogen group-containing compound functions as an elongation initiator or crosslinking agent at the time of elongation reactions or crosslinking reactions of the active hydrogen group-containing compound and the polymer capable of reacting with the compound in an aqueous phase.

The active hydrogen group-containing compound is not particularly limited, provided that it contains an active hydrogen group, and may be appropriately selected in accordance with a purpose. In the case that the polymer capable of reacting with the active hydrogen group-containing compound is (A) a polyester prepolymer containing an isocyanate group, the active hydrogen group-containing compound is preferably selected from (B) amines in view of capability of high molecular mass polymerization resulted from elongation reaction, crosslinking reaction, and the like.

Within the active hydrogen group-containing compound, the active hydrogen group is not particularly limited, and may be appropriately selected in accordance with a purpose. Examples of the active hydrogen group are hydroxyl groups such as an alcoholic hydroxyl group, a phenolic hydroxyl group, and the like, amino groups, carboxyl groups, mercapto groups, and the like, which can be used singly or in combination of two or more thereof. Of these, the alcoholic hydroxyl group is particularly preferable.

The (B) amines are not particularly limited, and can be appropriately selected in accordance with a purpose. Examples of (B) amines are (B1) a divalent amine compound, (B2) a trivalent or more polyvalent amine compound, (B3) an aminoalcohol, (B4) an amino mercaptan, (B5) an amino acid, and (B6) a compound in which the amino group of B1 to B5 is blocked. Theses can be used singly or in combination of two or more. Of these amines, the (B1) divalent amine lo compound, and a mixture of (B1) divalent amine compound and (B2) trivalent or more polyvalent amine compound are particularly preferable.

Examples of the (B1) divalent amine compound are: an aromatic diamine such as phenylene diamine, diethyl toluene diamine, 4,4'-diamino diphenyl methane; an alicyclic diamine such as 4,4'-diamino-3,3'-dimethyl dicyclohexyl methane, diamine cyclohexane, and isophorone diamine; and an aliphatic diamine such as ethylene diamine, tetramethylene diamine, and hexamethylene diamine.

Examples of the (B2) trivalent or more polyvalent amine compound are diethylene triamine, triethylene tetramine, and the like.

Examples of the (B3) aminoalcohol are ethanol amine, hydroxyethylaniline, and the like.

Examples of the (B4) amino mercaptan are aminoethyl mercaptan, aminopropyl mercaptan, and the like.

Examples of the (B5) amino acid are aminopropionic acid, aminocaproic acid, and the like.

Examples of the (B6) compound in which the amino group of B1 to B5 is blocked are: a ketimine compound obtained from the above-noted amines of B1 to B5 and ketones such as acetone, methyl ethyl ketone, and mehyl isobuthyl ketone; oxazolidine compound; and the like.

In order to stop cross-linking and/or elongation reactions of the active hydrogen group-containing compound and the polymer capable of reacting with the active hydrogen group-containing compound, a reaction stopper may be used as required to control the molecular mass of the adhesive base material to be obtained. Examples of the reaction stopper are: a monoamine such as diethyl amine, dibutyl amine, buthyl amine, and lauryl amine; a compound in which the above-noted elements are blocked such as a ketimine compound; and the like.

A mixing ratio of (B) amines and (A) a polyester prepolymer having isocyanate group, defined as an equivalent ratio [NCO]/[NHx] of isocyanate group [NCO] in (A) a polyester prepolymer having isocyanate group to amine group [NHx] in (B) amines, is 1/3 to 3/1, preferably 1/2 to 2/1, and more preferably 1/1.5 to 1.5/1. When [NCO]/[NHx] is less than 1/3, the low-temperature fixing properties are degraded. When [NCO]/[NHx] is more than 3/1, on the other hand, the molecular mass of the urea-modified polyester becomes low, thereby degrading hot-offset resistance.

-Polymer Capable of Reacting with Active Hydrogen Group-Containing Compound-

The polymer capable of reacting with the active hydrogen group-containing compound, which may be simply referred to "a prepolymer", is not particularly limited, provided that it has a moiety capable of reacting with the active hydrogen group-containing compound, and can be appropriately selected in accordance with a purpose. Examples of the prepolymer are a polyol resin, a polyacrylic resin, a polyester resin, an epoxy resin, a modified resin thereof, and the like. Theses can be selected singly or in combination of two or more. Of these examples, the polyester resin is particularly preferable in view of high flowability at the time of melting, and transparency.

The moiety capable of reacting with the active hydrogen group-containing compound is not particularly limited, and may be appropriately selected from the known substituents. Examples of such moiety are an isocyanate group, an epoxy group, a carboxyl group, an acid chloride group, and the like. These can be selected singly or in combination of two or more. Of these examples, the isocyanate group is particularly preferable.

The prepolymer is particularly preferably a polyester resin containing a group capable of generating urea bonding (RMPE) in view of controllability of the molecular mass of high molecular substance, oil-less and low-temperature fixing properties of a dry toner, especially suitable releasing and fixing properties without a releasing oil applicator for a heating member for fixing.

Example of the group capable of generating urea bonding are isocyanate group, and the like. In the case that the group capable of generating urea bonding in the polyester resin (RMPE) is the isocyanate group, the polyester resin (RMPE) is particularly preferably (A) a polyester prepolymer having an isocyanate group.

The (A) polyester prepolymer having an isocyanate group is not particularly limited, and may be selected in accordance with a purpose. Examples of the (A) polyester prepolymer having an isocyanate group are a polycondensation polyester of polyol (PO) and a polycarboxylic acid (PC), a reactant of the active hydrogen group-containing group and polyisocyante (PIC), and the like.

The polyol (PO) is not particularly limited, and may be appropriately selected in accordance with a purpose.

Examples of the polyol (PO) are diol (DIO), trivalent or more polyhydric alcohol (TO), and a mixture of diol (DIO) and trivalent or more polyhydric alcohol (TO), and the like. These can be selected singly or in combination of two or more. Of these examples, the diol (DIO) per se, or a mixture of the diol (DIO) and a little amount of the trivalent or more polyhydric alcohol (TIO) are preferably.

Examples of the diol (DIO) are alkylene glycol, alkylene ether glycol, alicyclic diol, alkylene oxide adduct of alicyclic diol, bisphenol, alkylene oxide adduct of bisphenol, and the like.

Examples of the alkylene glycol are alkylene glycol having 2 to 12 carbon atoms such as ethylene glycol, 1,2-propylene glycol, 1,3-propylene glycol, bytane-1,4-diol, hexane-1,6-diol and the like.

Examples of the alkylene ether glycol are diethylene glycol, triethylene glycol, dipropylene glycol, polyethylene glycol, polypropylene glycol, polytetramethylene ether glycol, and the like.

Examples of the alicyclic diol are cyclohexane-1,4-dimethanol, hydrogenated bisphenol A, and the like.

Examples of the alkylene oxide adduct of alicyclic diol are alicyclic diol selected from the above-listed alicyclic diols, adducted with alkylene oxide such as ethylene oxide, propylene oxide, butylene oxide, and the like.

Examples of the bisphenol are bisphenol A, bisphenol F, bisphenol S, and the like.

Examples of the alkylene oxide adduct of bisphenol are bisphenol selected from the above-listed bisphenols adducted with alkylene oxide such as ethylene oxide, propylene oxide, butylene oxide, and the like.

Of these examples, alkylene glycol having 2 to 12 carbon atoms, and alkylene oxide adduct of bisphenol are preferable, and alkylene oxide adduct of bisphenol, and a mixture of alkylene oxide adduct of bisphenol and alkylene glycol having 2 to 12 carbon atoms are particularly preferable.

The trivalent or more polyhydric alcohol (TO) is preferably polyhydric alcohol having a valency of 3 to 8, and/or a valency of 8 or more. Examples of such trivalent or more polyhydric alcohol (TO) are trivalent or more polyhydric aliphatic alcohol, trivalent or more polyphenol, alkylene oxide adduct of trivalent or more polyphenol, and the like.

Examples of the trivalent or more polyhydric aliphatic alcohol are glycerin, trimethylol ethane, trimethylol propane, pentaerythritol, sorbitol, and the like. Examples of the trivalent or more polyphenol are trisphenol PA, phenol novolac, cresol novolac, and the like. Examples of the alkylene oxide adduct of trivalent or more polyphenol are the above-listed trivalent or more polyphenol adducted with alkylene oxide such as ethylene oxide, propylene oxide, butylene oxide, and the like.

In the mixture of the diol (DIO) and the trivalent or more polyhydric alcohol (TO), a mass ratio (DIO:TO) of the diol to the trivalent or more polyhydric alcohol is 100:0.01-10, and preferably 100:0.01-1.

The polycarboxylic acid (PC) is not particularly limited, and may be appropriately selected in accordance with a purpose. Examples of the polycarboxylic acid (PC) are dicarboxylic acid (DIC), trivalent or more polycarboxylic acid (TC), a mixture of dicarboxylic acid (DIC) and trivalent or more polycarboxylic acid (TC), and the like. These can be selected singly or in combination of two or more. Among these example, dicarboxylic acid (DIC) alone or a mixture of dicarboxylic acid (DIC) and the little amount of trivalent or more polycarboxylic acid (TC) is preferable.

Examples of the dicarboxylic acid are alkylene dicarboxylic acid, alkenylene dicarboxylic acid, aromatic dicarboxylic acid, and the like.

Examples of the alkylene dicarboxylic acid are succinic acid, adipic acid, sebacic acid, and the like. Examples of the alkenylene dicarboxylic acid are alkenylene dicarboxylic acid having 4 to 20 carbon atoms, such as maleic acid, fumaric acid, and the like.

Examples of the aromatic dicarboxylic acid are aromatic dicarboxylic acids having 8 to 20 carbon atoms such as phthalic acid, isophthalic acid, terephthalic acid, naphthalene dicarboxylic acid, and the like.

Among these examples, alkenylene dicarboxylic acid having 4 to 20 carbon atoms, and aromatic dicarboxylic acid having 8 to 20 carbon atoms are preferable.

Examples of the trivalent or more polycarboxylic acid (TC) are trivalent or more polycarboxylic acid having 3 to 8 carbon atoms, and/or trivalent or more polycarboxylic acid having 8 or more carbon atoms, such as aromatic polycarboxylic acid.

Examples of the aromatic polyearboxylic acid are aromatic polycarboxylic acids having 9 to 20 carbon atoms such as trimellitic acid, pyromellitic acid, and the like.

The polycarboxylic acid (PC) may also be an acid anhydride or lower alkyl ester of one selected from the above-listed dicarboxylic acid (DIC), the above-listed trivalent or more polycarboxylic acid (TC), the above-listed mixture of dicarboxylic acid (DIC) and trivalent or more polycarboxylic acid (TC). Examples of the lower alkyl ester are methyl ester, ethyl ester, isopropyl ester, and the like.

In the mixture of dicarboxylic acid (DIC) and trivalent or more polycarboxylic acid (TC), a mass ratio (DIC:TC) of the dicarboxylic acid (DIC) to the trivalent or more polycarboxylic acid (TC) can be appropriately adjusted in accordance with a purpose without any limitation, and, for example, is preferably 100:0.1-10, preferably 100:0.01-1.

At the time of subjecting the polyol (PO) and the polycarboxylic acid (PC) polymerization condensation reaction, a mixing ratio thereof is not particularly limited, and may be selected in accordance with a purpose. For example, a mixing ratio of the polyol (PO) to polyvalent carboxylic acid (PC), defined as an equivalent ratio [OH]/[COOH] of a hydroxyl group [OH] to a carboxyl group [COOH], is 2/1 to 1/1, preferably 1.5/1 to 1/1, and more preferably 1.3/1 to 1.02/1.

The polyol (PO) content of the (A) polyester prepolymer having an isocyanate group is not particularly limited, and may be adjusted in accordance with a purpose. Such content is, for example, 0.5% by mass to 40% by mass, preferably 1% by mass to 30% by mass, and more preferably 2% by mass to 20% by mass.

In the case that the polyol (PO) content is less than 0.5% by mass, offset resistance becomes degraded, thereby being difficult to realize both heat resistance preservation and low-temperature fixing properties. In the case that the polyol (PO) content is more than 40% by mass, low-temperature fixing properties may become degraded.

The aforementioned polyvalent isocyanate (PIC) is not particularly limited, and may be appropriately selected in accordance with a purpose. Examples of the polyvalent isocyanate (PIC) are aliphatic polyvalent isocyanate, alicyclic polyvalent isocyanate, aromatic diisocyanate, aromatic aliphatic diisocyanate, isocyanurate, phenol derivative thereof, blocked products thereof with such as oxime, caprolactam, and the like.

Examples of the aliphatic polyvalent isocyanate are tetramethylen diisocyanate, hexamethylen diisocyanate, 2,6-diisocyanate methyl caproate, octamethylene diisocyanate, decamethylene diisocianate, dodecamethylene diisocyanate, tetradecamethylene diisocyanate, trimethyl hexane diisocyanate, tetramethyl hexane diisocyanate, and the like. Examples of the alicyclic polyvalent isocyanate are isophorone diisocyanate, cyclohexylmethane diisocyanate, and the like. Examples of aromatic diisocyanate are tolylene diisocyanate, diphenylmethane diisocyanate, 1,5-naphthylene diisocyanate, diphenylene-4,4'-diisocyanate, 4,4'-diisocyanato-3,3'-dimethyl diphenyl, 3-methyldiphenyl methane-4,4'-diisocyanate, diphenylether-4,4'-diisocyanate, and the like. Examples of the aromatic aliphatic polyvalent diisocyanate are $\alpha$, $\alpha$, $\alpha'$, $\alpha'$-tetramethyl xylylene diisocyanate, and the like. Examples of the isocyanurate are tris-isocyanatoalkyl-isocyanurate, triisocyanatocycroalkyl-isocyanurate, and the like.

These can be selected singly or in combination of two or more.

At the time of reacting the polyvalent isocyanate (PIC) and the active hydrogen group-containing polyester such as hydrogen group-containing polyester, a mixing ratio which is defined as an equivalent ratio [NCO]/[OH] of an isocyanate group [NCO] to a hydroxyl group [OH] of the hydroxyl group-containing polyester, is 5/1 to 1/1, preferably 4/1 to 1.2/1, and more preferably 3/1 to 1.5/1. In the case that the molar ratio of [NCO] in the ratio is more than 5, it is liable to degrade low-temperature fixing properties. In the case that the molar ratio of [NCO] is less than 1, it is liable to degrade offset resistance.

The polyvalent isocyanate (PIC) content of the (A) polyester prepolymer having an isocyanate group is not particularly limited, and may be appropriately selected in accordance with a purpose. It is preferably 0.5% by mass to 40% by mass, more preferably 1% by mass to 30% by mass, and furthermore preferably 2% mass to 20% by mass. In the case that the content is less than 0.5% by mass, it is liable to degrade offset resistance. In the case that the content is more than 40% by mass, it is liable to degrade low-temperature fixing properties.

The average number of isocyanate groups contained in the (A) polyester prepolymer containing an isocyanate group is preferably 1 or more per molecule of the (A) polyester prepolymer, more preferably 1.2 to 5 per molecule, and furthermore preferably 1.5 to 4 per molecule. In the case that the average number of isocyanate groups is less than 1 per molecule, the molecular mass of the urea-modified polyester becomes low which makes hot-offset resistance poor.

The mass average molecular mass of the polymer capable of reacting with the active hydrogen group-containing compound is preferably 3,000 to 40,000, and more preferably 4,000 to 30,000, in terms of a molecular mass distribution of a tetrahydrofuran (THF) soluble part measured by means of gel permeation chromatography (GPC).

In the case that the mass average molecular mass (Mw) is less than 3,000, it is liable to degrade heat resistance preservation. In the case that mass average molecular mass (Mw) is more than 40,000, it is liable to degrade low-temperature fixing properties.

The measurement of molecular mass distribution by means of the gel permeation chromatography (GPC) can be carried out by the following manner.

At first, a column is set and secured in a heat chamber at the interior temperature of 40° C. While maintaining the same interior temperature, tetrahydrofuran (THF) as a column solvent is flown into the column at the flow velocity of 1 ml/min. To this flow, there is introduced 50 μl to 200 μl of a tetrahydrofuran solution of a resin sample wherein the resin sample concentration is adjusted to 0.05% by mass to 0.6% by mass. The resin sample is then measured. In the measurement, the molecular mass distribution of the resin sample is calculated from the relationship between the logarithm values of calibration curve prepared from plurality of singly dispersed standard-polystyrene samples, and the counting number. The standard-polyester samples for calibration are, for example, standard polyester samples each respectively having a molecular mass of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, all of which are commercially available from Pressure Chemical Co. or Toyo Soda Co. Ltd., and are preferably about 10 standard polyester samples. Note that a refractive index (RI) detector can be used as a detector in the above measurements.

-Other Components-

The other components are not particularly limited, and may be appropriately selected in accordance with a purpose. The other components to be contained are, for example, a colorant, a releasing agent, a charge controlling agent, fine inorganic particles, a flowability improver, a cleaning improver, a magnetic material, metal soap, and the like.

The colorant is not particularly limited, and may be appropriately selected from the conventional dyes and pigments in accordance with a purpose. Examples of the colorant are carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasane yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and the like. Theses can be selected singly or in combination of two or more.

The colorant content of the toner is not particularly limited, and may be appropriately adjusted in accordance with a purpose. The colorant content is preferably 1% by mass to 15% by mass, and more preferably 3% by mass to 10% by mass.

In the case that the colorant content is less than 1% by mass, it is liable to lower tinting strength of the toner. In the case that the colorant content is more than 15% by mass, it is liable to adversely affect the dispersibility of the colorant in the toner particles, which results in lowering tinting strength and charging ability of the toner.

The colorant may be used as a master batch compounded with a resin.

The resin for use is not particularly limited, and may be appropriately selected in accordance with a purpose. Examples of the binder resin in the master batch are styrene or substituted polymer thereof, styrene copolymer, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate, rosin, modified rosin, terpene resin, aliphatic hydrocarbon resin, alicyclic hydrocarbon resin, aromatic petroleum resin, chlorinated paraffin, paraffin, and the like. These can be selected singly or in combination of two or more.

Examples of the styrene or substituted polymer thereof are polyester, polystyrene, poly-p-chlorostyrene, polyvinyl toluene, and the like. Examples of the styrene copolymer are styrene-p-clorostyrene copolymer, styrene-propylene copolymer, styrene-vinyl toluene copolymer, styrene-vinyl naphthalene copolymer, styrene-methylacrylate copolymer, styrene-ethylacrylate copolymer, styrene-butylacrylate copolymer, styrene-octylacrylate copolymer, styrene-methylmethacrylate copolymer, styrene-ethylmethacrylate copolymer, styrene-butylmethacrylate copolymer, styrene-methyl-α-chloromethacylate copolymer, styrene-acrylonitril copolymer, styrene-vinylmethylketone copolymer, styrene-butadiene copolymer, styrene-isoprene copolymer, styrene-acrylonitrile-indene copolymer, styrene-maleic acid copolymer, styrene-maleic ester copolymer, and the like.

The master batch is prepared, for example, by mixing or kneading the resin for the master batch and the colorant at high shear force. During this process, it is preferable to add an organic solvent so as to enforce interaction between the colorant and the resin. In addition, flashing method is also preferable for preparing the master batch since the pigment can be employed in the form of wetcake without drying. In the flashing method, an aqueous paste of the pigment and water is mixed or kneaded together with the resin and the organic solvent, the colorant is gradually transferred into the resin, and then the water and organic solvent are removed. For the aforementioned fixing or kneading, high shear force dispersing device, such as three-roller mills and the like are suitably used.

The releasing agent is not particularly limited, and may be appropriately selected from the conventional releasing agents in accordance with a purpose, for example, preferably waxes and the like.

Examples of the wax are a carbonyl group-containing wax, polyolefin wax, long-chain hydrocarbon, and the like. Each of these can be employed singly or in combination of two or more. Of these examples, the carbonyl group-containing wax is preferable.

Examples of the carbonyl group-containing wax are polyalkanoic ester, polyalkanol ester, polyalkanoic acid amide, polyalkyl amide, dialkyl ketone, and the like. Examples of the polyalkanoic ester are carnauba wax, montan wax, trimethylolpropane tribehenate, pentaerythritol tetrabehenate, pentaerythritol diacetate dibehenate, glycerin tribehenate, octadecan-1,18-diol distearate, and the like. Examples of the polyalkanol ester are trimellitic tristearate, distearyl maleate, and the like. Examples of the polyalkanoic acid amide are dibehenyl amide and the like. Examples of the polyalkyl amide are trimellitic acid tristearyl amide, and the like. Examples of the dialkyl ketone are distearyl ketone, and the like. Of these carbonyl group-containing wax, the polyalkanoic ester is particularly preferable.

Examples of the polyolefin wax are polyethylene wax, polypropylene wax, and the like.

Examples of the long-chain hydrocarbon are paraffin wax, Sasol Wax, and the like.

A melting point of the releasing agent is not particularly limited, and may be appropriately selected in accordance with a purpose. It is preferably 40° C. to 160° C., more preferably 50° C. to 120° C., and further more preferably 60° C. to 90° C.

In the case that the melting point is less than 40° C., it adversely affects heat resistance preservation of the wax. In the case that the melting point is more than 160° C., it is liable to cause cold offset at a relatively low temperature at the time of fixing.

A melt viscosity of the wax is preferably 5 cps to 1,000 cps, and more preferably 10 cps to 100 cps by a measurement at a temperature of 20° C. higher than the melting point of the wax.

In the case that the melt viscosity is less than 5 cps, a releasing ability is liable to be insufficient. In the case that the melt viscosity is more than 1,000 cps, on the other hand, it may not improve hot-offset resistance, and low-temperature fixing property.

The content of releasing agents in the toner is not particularly limited and can be appropriately selected in accordance with a purpose. The content of the releasing agent is preferably 0% by mass to 40% by mass, more preferably 3% by mass to 30% by mass. When the content is higher than 40% by mass, the toner may have deteriorated flow ability.

The charge controlling agent is not particularly limited, and may be appropriately selected from conventionally available ones in accordance with a purpose. The charge controlling agent is preferably formed of a material having a color close to transparent and/or white, as a colored charge controlling agent may change or adversely affect on the color toner of the toner.

Examples of the charge controlling agent are triphenylmethane dye, molybdic acid chelate pigment, rhodamine dye, alkoxy amine, quaternary ammonium salt such as fluoride-modified quaternary ammonium salt, alkylamide, phosphoric simple substance or compound thereof, tungsten itself or compound thereof, fluoride activator, salicylic acid metallic salt, salicylic acid derivative metallic salt, and the like. These can be selected singly or in combination of two or more.

The charge controlling agent for use in the present invention is also selected from the commercially available products. Specifically examples thereof are Bontron P-51 of a quaternary ammonium salt, Bontron E-82 of an oxynaphthoic acid metal complex, Bontron E-84 of a salicylic acid metal complex, and Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.), quinacridone, azo pigment, and other high-molecular mass compounds having a functional group, such as sulfonic acid group, carboxyl group, and quaternary ammonium salt, and the like.

The charge controlling agent may be dissolved and/or dispersed in the toner material after kneading with the master batch. The charge controlling agent may also be added at the time of dissolving and/or dispersing in the organic solvent together with the toner material. In addition, the charge controlling agent may be added onto the surface of the toner particles after preparing the toner particles.

The usage amount of the charge controlling agent is determined depending on the type of a binder resin, presence or absence of an additive to be used as required, and the method for manufacturing a toner including a dispersion process and is not limited uniformly; preferably, to 100 parts by mass of binder resin, 0.1 part by mass to 10 parts by mass of the charge controlling agent is used and more preferably with 0.2 part by mass to 5 part by mass of the charge controlling agent. In the case that the usage amount is less than 0.1 parts by mass, charge may not be appropriately controlled. In the case that the charge controlling agent is more than 10 parts by mass, charge ability of the toner become exceedingly large, which lessens the effect of the charge controlling agent itself and increases in electrostatic attraction force with a developing roller, and causes degradations of developer fluidity and image density.

The fine inorganic particles are not particularly limited, and may be appropriately selected from the conventional fine inorganic particles in accordance with a purpose. Suitable examples thereof are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and the like. These can be selected singly or in combination of two or more.

The primary particle diameter of the fine inorganic particle is preferably 5 nm to 2 μm, and more preferably 5 nm to 500 nm. The specific surface of the fine inorganic particle is preferably 20 $m^2/g$ to 500 $m^2/g$ according to BET method.

The fine inorganic particle content of the toner is preferably 0.01% by mass to 5.0% by mass, and more preferably 0.01% by mass to 5.0% by mass.

The aforementioned flowability improver is surface treated to have improved hydrophobic properties, and is capable of inhibiting the degradation of flowability or charging ability under high humidity environment. Suitable examples of the flowability improver are a silane coupling agent, a sililating agent, a silane coupling agent having a fluorinated alkyl group, an organotitanate coupling agent, an aluminum coupling agent, silicone oil, modified silicone oil, and the like.

The aforementioned cleaning improver is added to the toner to remove the residual developer on a latent electrostatic image bearing member or a primary transferring member after transferring.

Suitable example of the cleaning improver are fatty acid metal salt for example metal salt of stearic acid, such as zinc stearate, calcium stearate, and the like, fine polymer particles formed by soap-free emulsion polymerization, such as fine polymethylmethacrylate particles and fine polystyrene particles, and the like. The fine polymer particles have preferably a narrow particle diameter distribution. It is preferred that the volume average particle diameter thereof is 0.01 μm to 1 μm.

The magnetic material is not particularly limited and may be appropriately selected from the conventional magnetic material in accordance with a purpose. Suitable examples thereof are iron powder, magnetite, ferrite, and the like. Among these, one having a white color is preferable in terms of tone.

In the aforementioned preferred embodiment of the toner production method of the present invention, the oil phase can be prepared by dissolving and/or dispersing the toner materials such as the active hydrogen group-containing compound, polymer capable of reacting with the active hydrogen group-containing compound, colorant, releasing agent, charge controlling agent in the organic solvent.

The toner materials except for the polymer (prepolymer) capable of reacting with the active hydrogen group-containing compound can be added to and mixed with an aqueous phase when fine resin particles are dispersed in the aqueous phase in the preparation of an aqueous phase described later or added to the aqueous phase together with the oil phase when the oil phase is added to the aqueous phase.

-Aqueous Phase-

The aqueous phase is not particularly limited and may be appropriately selected from the conventional aqueous phase in accordance with a purpose. Examples of the aqueous phase are water, a solvent compatible with water, a mixture thereof, and the like. Among them, water is most preferable.

Examples of the solvent compatible with water are alcohol, dimethyl formamide, tetrahydrofuran, Cellosolve, lower ketone, and the like.

Examples of the alcohol are methanol, isopropanol, ethylene glycol and the like. Examples of the lower ketone are acetone, methylethylketone, and the like. These can be selected singly or in combination of two or more.

The aqueous phase can be prepared by dispersing fine resin particles in the aqueous phase. The addition rate of the fine resin particles to the aqueous phase is not particularly limited and may be appropriately selected in accordance with a purpose. For example, the addition rate is preferable 0.5% by mass to 10% by mass.

The fine resin particles are not particularly limited, and the material thereof may be appropriately selected from the conventional resin in accordance with a purpose, provided that the resin capable of forming aqueous dispersion in the aqueous phase. The fine resin particles may be formed of thermoplastic resin or thermosetting resin. Examples of the material of the fine resin particles are vinyl resin, polyurethane resin, epoxy resin, polyester resin, polyamide resin, polyimide resin, silicone resin, phenol resin, melamine resin, urea resin, anilline resin, ionomer resin, polycarbonate resin, and the like. These can be selected singly or in combination of two or more, for use as the fine resin particles. Among these examples, the fine resin particles are preferably formed of one selected from the vinyl resin, polyurethane resin, epoxy resin, and polyester resin in view of an easy formation of aqueous dispersion of fine and spherical resin particles.

The vinyl resin is a polymer in which vinyl monomer is mono- or co-polymerized. Examples of the vinyl resin are styrene-(meth)acrylic ester resin, styrene-butadiene copolymer, (meth)acrylic acid-acrylic ester copolymer, styrene-acrylonitrile copolymer, styrene-maleic anhydride copolymer, styrene-(meth)acrylic acid copolymer, and the like.

Moreover, the finer resin particles may be formed of copolymer containing a monomer having two or more unsaturated groups. The monomer having two or more unsaturated groups is not particularly limited, and may be selected in accordance with a purpose. Examples of such monomer are sodium salt of sulfuric acid ester of ethylene oxide adduct of methacrylic acid (Eleminol RS-30, by Sanyo Kasei Co., Ltd.), divinylbenzene, hexane-1,6-diol acrylate, and the like.

The fine resin particles are formed by polymerizing the above-listed monomers in accordance with a method appropriately selected from conventional methods. The fine resin particles are preferably obtained in the form of aqueous dispersion of the fine resin particles. Examples of preparation method of such aqueous dispersion are the following (1)-(8):

(1) a preparation method of aqueous dispersion of the fine resin particles, in which, in the case of the vinyl resin, a vinyl monomer as a starting material is polymerized by suspension-polymerization method, emulsification-polymerization method, seed polymerization method or dispersion-polymerization method;

(2) a preparation method of aqueous dispersion of the fine resin particles, in which, in the case of the polyaddition and/or condensation resin such as the polyester resin, the polyurethane resin, or the epoxy resin, a precursor (monomer, oligomer or the like) or solvent solution thereof is dispersed in an aqueous medium in the presence of a dispersing agent, and sequentially is heated or added with a curing agent so as to be cured, thereby obtaining the aqueous dispersion of the fine resin particles;

(3) a preparation method of aqueous dispersion of the fine resin particles, in which, in the case of the polyaddition and/or condensation resin such as the polyester resin, the polyurethane resin, or the epoxy resin, an arbitrary selected emulsifier is dissolved in a precursor (monomer, oligomer or the like) or solvent solution thereof (preferably being liquid, or being liquidized by heating), and then water is added thereto so that induce phase inversion emulsification is induced, thereby obtaining the aqueous dispersion of the fine resin particles;

(4) a preparation method of aqueous dispersion of the fine resin particles, in which a previously prepared resin by a polymerization method, which is any of addition polymerization, ring-opening polymerization, polyaddition, addition condensation or condensation polymerization, is pulverized by means of a pulverizing mill such as mechanical rotation-type, jet-type or the like, the thus obtained resin powder is classified to thereby obtain fine resin particles, and then the fine resin particles are dispersed in an aqueous medium in the presence of an arbitrary selected dispersing agent, thereby obtaining the aqueous dispersion of the fine resin particles;

(5) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is sprayed in the form of mist to thereby obtain fine resin particles, and then the thus obtained fine resin particles are dispersed in an aqueous medium in the presence of an arbitrary selected dispersing agent, thereby obtaining the aqueous dispersion of the fine resin particles;

(6) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is subjected to precipitation by adding with a poor solvent or cooling after heating and dissolving, the solvent is sequentially removed to thereby obtain fine resin particles, and then the thus obtained fine resin particles are dispersed in an aqueous medium in the presence of an arbitrary selected dispersing agent, thereby obtaining the aqueous dispersion of the fine resin particles;

(7) a preparation method of aqueous dispersion of the fine resin particles, in which a previously prepared resin by a polymerization method, which is any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the fine resin particles;

(8) a preparation method of aqueous dispersion of the fine resin particles, in which a previously prepared resin-by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so that phase inversion emulsification is induced, thereby obtaining the aqueous dispersion of the fine resin particles.

-Emulsification and Dispersion-

The oil phase is emulsified or dispersed in the aqueous phase preferably by stirring and dispersing the oil phase in the aqueous phase. The dispersion method is not particularly limited and may be appropriately selected in accordance with a purpose. For example, a known dispersing apparatus can be used, such as a low speed shearing disperser, a high speed shearing disperser, a friction disperser, a high pressure jet disperser, and an ultrasonic disperser. Among them, a high speed shearing disperser is preferable because it allows the control of the particle diameter of the oil droplets (dispersed matter) to 3 μm to 8 μm.

When a high speed shearing disperser is used, its conditions such as revolution speed, peripheral velocity of the mixing blades, dispersion time, and dispersion temperature are not particularly limited and may be appropriately selected according to the purpose. For example, the revolution speed is preferably 1,000 rpm to 30,000 rpm, more preferably 5,000 rpm to 20,000 rpm; the peripheral velocity of the mixing blades is preferably 5 m/sec to 30 m/sec.; the dispersion time is preferably 0.1 minute to 5 minutes for a batch system; and the dispersion temperature is preferably 0° C. to 150° C., more preferably 10° C. to 98° C., under pressure. Generally, higher dispersion temperatures facilitate the dispersion.

In aforementioned preferred embodiment of the toner production method of the present invention, at the time of emulsifying and/or dispersing, the active hydrogen group-containing compound and the polymer capable of reacting with the active hydrogen group-containng compound are subjected to elongation and/or crosslinking reaction, thereby forming the adhesive base material.

-Adhesive Base Material-

The adhesive base material exhibits adhesion to a recording medium such as a paper, and comprises an adhesive polymer resulted from a reaction, in an aqueous phase, of the active hydrogen group-containing compound and a polymer capable of reacting the active hydrogen group-containing compound. The adhesive base material may further comprise a binder resin appropriately selected from the conventional binder resins.

A mass average molecular mass of the adhesive base material is not particularly limited and can be appropriately adjusted in accordance with a purpose. It is preferably 3,000 or more, more preferably 5,000 to 1,000,000, and further more preferably 7,000 to 500,000.

In the case that the mass average molecular mass of the adhesive base material is less than 3,000, it is liable to adversely affect on offset resistance.

A glass transition temperature (Tg) of the adhesive base material is not particularly limited and may be appropriately adjusted in accordance with a purpose. It is preferably 30° C. to 70° C., and more preferably 40° C. to 65° C. Since the adhesive base material is contained in the toner together with the polyester resin which is crosslinked, and elongation reacted, the toner has a desirable heat resistance preservation even having the lower glass transition temperature than that of the conventional polyester toners.

In the case that the glass transition temperature of the adhesive base material is less than 30° C., it is liable to adversely affect on a heat resistance preservation of the toner. In the case that the glass transition temperature of the adhesive base material is more than 70° C., low-temperature fixing properties of the toner is liable to be insufficient.

The glass transition temperature is measured, for example, by means of TG-DSC/TAS-100 system (manufactured by Rigaku Corp.). A specific method is explained hereinafter.

About 10 mg of a toner sample is charged in a sample container formed of aluminum; the sample container is placed on a holder unit; the holder unit is set in an electric oven. The temperature therein is increased from an ambient temperature to 150° C. at 10° C./min.; the temperature is kept at 150° C. for 10 minutes; the sample toner is then cooled down to an ambient temperature and left to stand for 10 minutes. The sample toner is then heated up to 150° C. at 10° C./min under $N_2$ atmosphere; a DSC spectrum of the sample toner is measured by a differential scanning calorimeter. The glass transition temperature is calculated, by means of TG-DSC/TAS-100 system, based on a contact point of a tangent line of the endothermic curve nearby a glass transition temperature and a base line.

Specific examples of the adhesive base material are particularly limited and may be appropriately selected in accordance with a purpose. Suitable examples thereof are a polyester resin, and the like.

The polyester resin is not particularly limited and may be selected in accordance with a purpose. Suitable examples thereof are urea-modified polyester and the like.

The urea-modified polyester which is obtained by a reaction between (B) amines as the active hydrogen group-containing compound, and (A) a polyester prepolymer having an isocyanate group as the polymer capable of reacting with the active hydrogen group-containing compound in the aqueous phase.

In addition, the urea-modified polyester may include a urethane bond as well as a urea bond. A molar ratio of the urea bond content to the urethane bond content is preferably 100/0 to 10/90, more preferably 80/20 to 20/80, and further more preferably 60/40 to 30/70. In the case that a molar ratio of the urea bond is less than 10%, it is liable to adversely affects on hot-offset resistance.

Specific examples of the urea-modified polyester are preferably the following (1)-(10):

(1) A mixture of (i) polycondensation product of bisphenol A ethyleneoxide dimole adduct and isophthalic acid, and (ii) urea-modified polyester prepolymer which is obtained by reacting isophorone disocyanate with a polycondensation product of bisphenol A ethyleneoxide dimole adduct and isophtalic acid so as to form polyester prepolymer, and modifying the polyester prepolymer with isophorone diamine;

(2) A mixture of (iii) a polycondensation product of bisphenol A ethyleneoxide dimole adduct and terephthalic acid, and (ii) urea-modified polyester prepolymer which is obtained by reacting isophorone disocyanate with a polycondensation product of bisphenol A ethyleneoxide dimole adduct and terephthalic acid so as to form polyester prepolymer, and modifying the polyester prepolymer with isophorone diamine;

(3) A mixture of (iv) polycondensation product of a bisphenol A ethyleneoxide dimole adduct, a bisphenol A propyleneoxide dimole adduct and terephthalic acid, and (v) urea-modified polyester prepolymer which is obtained by reacting isophorone disocyanate with a polycondensation product of a bisphenol A ethyleneoxide dimole adduct, a bisphenol A propyleneoxide dimole adduct and terephthalic acid so as to form polyester prepolymer, and modifying the polyester prepolymer with isophorone diamine;

(4) A mixture of (vi) polycondensation product of a bisphenol A propyleneoxide dimole adduct and terephthalic acid, and (v) urea-modified polyester prepolymer which is obtained by reacting isophorone disocyanate with a polycondensation product of a bisphenol A ethyleneoxide dimole adduct, a bisphenol A propyleneoxide dimole adduct and terephthalic acid so as to form polyester prepolymer, and modifying the polyester prepolymer with isophorone diamine;

(5) A mixture of (iii) polycondensation product of a bisphenol A ethyleneoxide dimole adduct and terephthalic acid, and (vi) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with hexamethylene diamine;

(6) A mixture of (iv) polycondensation product of a bisphenol A ethyleneoxide dimole adduct, a bisphenol A propyleneoxide dimole adduct and terephthalic acid, and (vi) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with hexamethylene diamine;

(7) A mixture of (iii) polycondensation product of a bisphenol A ethyleneoxide dimole adduct and terephthalic acid, and (vii) urea-modified polyester prepolymer which is obtained by reacting isophorone disocyanate with a polycondensation product of a bisphenol A ethyleneoxide dimole adduct and terephthalic acid so as to form polyester prepolymer, and modifying the polyester prepolymer with ethylene diamine;

(8) A mixture of (i) polycondensation product of a bisphenol A ethyleneoxide dimole adduct and isophthalic acid, and (viii) urea-modified polyester prepolymer which is obtained by reacting diphenylmethane disocyanate with a polycondensation product of a bisphenol A ethyleneoxide dimole adduct and isophthalic acid so as to form polyester prepolymer, and modifying the polyester prepolymer with hexamethylene diamine;

(9) A mixture of (iv) polycondensation product of a bisphenol A ethyleneoxide dimole adduct, a bisphenol A propyleneoxide dimole adduct and terephthalic acid, and (ix) urea-modified polyester prepolymer which is obtained by reacting diphenylmethane disocyanate with a polycondensation product of a bisphenol A ethyleneoxide dimole adduct/bisphenol A propyleneoxide dimole adduct and terephthalic acid/dodecenylsuccinic anhydride so as to form polyester prepolymer, and modifying the polyester prepolymer with hexamethane diamine;

(10) A mixture of (i) polycondensation product of a bisphenol A ethyleneoxide dimole adduct and isophthalic acid, and (x) urea-modified polyester prepolymer which is obtained by reacting toluene disocyanate with a polycondensation product of a bisphenol A ethyleneoxide dimole adduct and isophthalic acid so as to form polyester prepolymer, and modifying the polyester prepolymer with hexamethane diamine.

-Binder Resin-

The binder resin is not particularly limited, and may be appropriately selected in accordance with a purpose. Examples of the binder resin are polyester and the like. Of these examples, unmodified polyester (polyester which is not modified) is particularly preferable.

By containing the unmodified polyester in the toner, the toner can realize improved low-temperature fixing properties and glossiness.

Examples of the unmodified polyester are a resin equivalent to the aforementioned polyester resin containing a group capable of generating urea bonding (RMPE), i.e., polycondensation product of polyol (PO) and polycarboxylic acid (PC), and the like. The unmodified polyester is preferably compatible with the polyester resin containing a group capable of generating urea bonding (RMPE) at part thereof, i.e., having a similar polymeric structure which allow to be compatible, in view of low-temperature fixing properties and hot-offset resistance.

The mass average molecular mass (Mw) of the non-polyester is 1,000 to 30,000, and preferably 1,500 to 15,000, in terms of a molecular mass distribution of a tetrahydrofuran (THF) soluble part measured by means of gel permeation chromatography (GPC).

In the case that the mass average molecular mass (Mw) is less than 1,000, it is liable to degrade heat resistance preservation. Therefore, the amount of the unmodified polyester having a mass average molecular mass is 8% by mass to 28% by mass. In the case that mass average molecular mass (Mw) is more than 30,000, it is liable to degrade low-temperature fixing properties.

The glass transition temperature of the unmodified polyester is preferably 35° C. to 70° C. In the case that the glass transition temperature is lower than 35° C., it is liable to degrade heat resistance preservation of the toner. In the case that the glass transition temperature is higher than 70° C., it is liable to degrade lower-temperature fixing properties.

The hydroxyl value of the unmodified polyester is preferably 5 mg KOH/g or more, more preferably 10 mg KOH/g to 120 mg KOH/g, and further more preferably 20 mg KOH/g to 80 mg KOH/g. In the case that the hydroxyl value of less than 5 mg KOH/g, it becomes difficult to achieve both heat resistance preservation and low-temperature fixing properties.

The acid value of the unmodified polyester is 1.0 mg KOH/g to 50.0 mg KOH/g, preferably 5.0 mg KOH/g to 20.0 mg KOH/g.

When the unmodified polyester is contained in the toner, a mass ratio (RMPE/PE) of the urea-modified polyester (RMPE) to the unmodified polyester (PE) is 5/95 to 25/75, and preferably 10/90 to 25/75.

In the case that the mass ratio of the unmodified polyester (PE) is more than 95, it is liable to degrade hot-offset resistance. In the case that the mass ratio of the unmodified polyester is less than 75, it is liable to degrade low-temperature fixing properties and glossiness of the image.

The unmodified polyester content of the binder resin is preferably 50% by mass to 100% by mass, more preferably 55% by mass to 95% by mass. In the case that the unmodified polyester content is less than 50% by mass, it is liable to degrade low-temperature fixing properties, strength of fixing the image and glossiness of the image.

-Crystalline Polyester-

The crystalline polyester has crystallinity, and exhibits thermofusion properties which significantly decrease the viscosity thereof at approximately the fixing-starting temperature. In another word, the crystalline polyester has excellent heat resistance preservation due to crystallinity thereof below the fixing-starting temperature, and significantly decreases the velocity thereof (exhibits sharp-melt properties) at the fixing-starting temperature so as to contribute to the fixing of the toner. Accordingly, there can be realized a toner exhibiting both excellent heat resistance preservation and excellent low-temperature fixing properties. Moreover, the toner containing the crystalline polyester is also excellent in releasing properties margin (margin between the lowest fixing temperature and hot-offset-occurring temperature).

The crystalline polyester is not particularly limited, and may be appropriately selected in accordance with a purpose. Suitable example of the crystalline polyester is a crystalline polyester expressed by the following formula (1), which is synthesized by a diol compound having 2-6 carbon atoms as an alcohol component, and an acid component. It is preferred that the diol component contains 80% by mole or more, and more preferably 85% by mole to 100% by mole of butane-1, 4-diol, hexane-1,6-diol, and a derivative thereof, and the acid component is such as maleic acid, fumaric acid, succinic acid, and a derivative thereof.

$$[—O—CO—(CR^1{=}CR^2)_L CO—O—(CH_2)_n—]_m \qquad \text{Formula (1)}$$

In the above Formula (1), "n" and "m" denote a number of repeating unit, "L" denotes integer of 1-3, and "R1" and "R2", which are mutually identical or different, denote hydrogen atom or hydrocarbon group.

For the purpose of controlling the crystallinity and melting point of the crystalline polyester, the crystalline polyester is configured to have a non-linear polymeric structure, which is obtainable by adding trivalent or more polyhydric alcohol such as glycerin to the aforementioned alcohol component and/or adding trivalent or more polyvalent carboxylic acid such as trimellitic anhydride to the aforementioned acid component in a course of condensation polymerization of the alcohol component and the acid component to synthesize the crystalline polyester. Note that, the polymeric structure of the crystalline polyester can be confirmed in accordance with solid-state nuclear magnetic resonance (NMR) spectroscopy.

The mass average molecular mass (Mw) of the crystalline polyester is 1,000 to 30,000, and preferably 1,000 to 6,500 in terms of a molecular mass distribution of an o-dichlorobenzene soluble part measured by means of gel permeation chromatography (GPC). In the case that the mass average molecular mass (Mw) is less than 1,000, it is liable to degrade heat resistance preservation. In the case that the mass average molecular mass (Mw) is more than 30,000, it is liable to degrade low-temperature fixing properties.

The number average molecular mass (Mn) of the crystalline polyester is 500 to 6,000, and preferably 500 to 2,000 in terms of a molecular mass distribution of an o-dichlorobenzene soluble part measured by means of gel permeation chromatography (GPC). The ratio (Mw/Mn) of the mass average molecular mass to the number average molecular mass is 2 to 8, and preferably 2 to 5.

In a graph of the aforementioned molecular mass distribution by means of GPC, it is preferable to have a peak raining from 3.5 to 4.0, and peak width of 1.5 or less. Note that, the graph is to be drafted so that axis of abscissas indicates log (M), and axis of ordinate indicates % by mass.

The melting temperature and T1/2 temperature of the crystalline polyester is preferably low, provided that heat resistance preservation is not degraded. For example, endothermic peak temperature of DSC is 50° C. to 150° C. In the case that the melting temperature and the T1/2 temperature are lower than 50° C., heat resistance preservation is degraded, and thus it is liable to cause blocking at the interior temperature of the developing unit. In the case that the melting temperature and the T1/2 temperature are higher than 150° C., lowest fixing temperature becomes rather high, and thus it is liable to degrade low-temperature fixing properties.

The infrared spectrograph of the crystalline polyester preferably has an absorption band based on δ CH (out-of-plane deformation vibration) of olefin at 965±10 $cm^{-1}$ and/or 990±10 $cm^{-1}$. In the case that the absorption band based on the δ CH of olefin is in the aforementioned ranges, low-temperature fixing properties are improved.

For the purpose of realizing low-temperature fixing properties in view of compatibility of a paper and the binder resin, the acid value of the crystalline polyester is preferably 8 mg KOH/g or more, and more preferably 20 mg KOH/g or more. In order to improve hot-offset properties, on the other hand, the acid value of the crystalline polyester is preferably 45 mg KOH/g or less.

The hydroxyl value of the crystalline polyester is preferably 0 to 50 mg KOH/g, and more preferably 5 mg KOH/g to 50 mg KOH/g in view of improvements in low-temperature fixing properties and a charging ability.

In the case that the (b) unmodified polyester resin and the (c) crystalline polyester are contained in the toner, a mass ratio ((a)/(b)+(c)) of (a) urea bonding generatable group containing polyester to total of the (b) unmodified polyester and the (c) crystalline polyester is 5/95 to 25/75, preferably 10/90 to 25/75, more preferably 12/88 to 25/75, and further more preferably 12/88 to 22/78. In addition, a mass ratio of (b) to (c) is 99/1 to 50/50, preferably 95/5 to 60/40, and more preferably 90/10 to 65/35. In the case that the mass ratio is outside the aforementioned range, hot-offset resistance is degraded, and thus it rarely achieves both heat resistance preservation and low-temperature fixing properties.

The adhesive base material (e.g. the aforementioned urea-modified polyester) is formed, for example, by the following method (1)-(3):

(1) the oil phase containing the polymer capable of reacting with the active hydrogen group-containing compound (e.g. (A) polyester prepolymer containing an isocyanate group) is emulsified and/or dispersed in the aqueous phase together with the active hydrogen group-containing compound (e.g. (B) amines) so as to form a oil droplets, and then the active hydrogen group-containing compound and the polymer capable of reacting with the active hydrogen group-containing compound are subjected to elongation and/or crosslinking reaction in the aqueous phase; (2) the oil phase is emulsified and/or dispersed in the aqueous phase previously added with the active hydrogen group-containing compound to form oil droplets, and then the active hydrogen group-containing compound and the polymer capable of reacting with the active hydrogen group-containing compound are subjected to elongation and/or crosslinking reaction in the aqueous phase; (3) the oil phase is added and mixed in the aqueous phase, the active hydrogen group-containing compound is sequentially added thereto so as to form oil droplets, and then the active hydrogen group-containing compound and the polymer capable of reacting with the active hydrogen group-containing compound are subjected to elongation and/or crosslinking reaction at an interface of dispersed particles in the aqueous phase. In the case of the method (3), it should be noted that modified polyester is initially formed from a surface of the thus obtained toner particles, and thus it is possible to form a contrast of the modified polyester in the toner particles.

Conditions for forming the adhesive base material by the emulsifying and/or dispersing are not particularly limited, and can be appropriately adjusted in accordance with a combination of the active hydrogen group-containing compound and the polymer capable of reacting therewith. A suitable reaction time is preferable 10 minutes to 40 hours, and more preferably 2 hours to 24 hours. A suitable reaction temperature is preferably 0 to 150° C., and more preferably 40° C. to 98° C.

A suitable formation of the dispersion containing the active hydrogen group-containing compound and the polymer capable of reacting with the active hydrogen group-containing compound (e.g. the (A) polyester prepolymer containing an isocyanate group) in the aqueous phase is realized by, to the aqueous phase, adding the oil phase in which the toner material such as the polymer (e.g. the (A) polyester prepolymer containing an isocyanate group), the colorant, the releasing agent, the charge controlling agent, the unmodified polyester and the like is dissolved and/or dispersed in the organic solvent, and dispersing by a shear force.

In a course of emulsifying and/or dispersing, the usage amount of the aqueous phase is preferably 50 parts by mass to 2,000 parts by mass, and more preferably 100 parts by mass to 1,000 parts by mass with respect to the 100 parts by mass of the toner material.

In the case that the usage amount of less than 50 parts by mass, the toner material is not suitable dispersed, and thus toner particles having a predetermined particle diameter are rarely obtained. In the case that the usage amount is more than 2,000 parts by mass, on the other hand, the production cost is liable to increase.

In a course of emulsifying and/or dispersing, a dispersant is preferably used in order to stabilize the oil droplets to obtain the predetermined-shape of the dispersed particles, and to sharpen the particle diameter distribution of the dispersed particles.

The dispersant is not particularly limited, and may be appropriately selected in accordance with a purpose. Suitable examples of the are a surfactant, water-insoluble inorganic dispersant, polymeric protective colloid, and the like. These dispersants can be selected singly or in combination of two or more. Among these dispersants, a surfactant is preferable.

Examples of the surfactant are an anionic surfactant, a cationic surfactant, a nonionic surfactant, an ampholytic surfactant, and the like.

Examples of the anionic surfactant are alkylbenzene sulfonic acid salts, α-olefin sulfonic acid salts, phosphoric acid salts, and the like. Among them, the anionic surfactant having a fluoroalkyl group is preferable. Examples of the anionic surfactant having a fluoroalkyl group are fluoroalkyl carboxylic acid having 2-10 carbon atoms or a metal salt thereof, disodium perfluorooctanesulfonylglutamate, sodium-3-{omega-fluoroalkyl($C_6$ to $C_{11}$)oxy}-1-alkyl($C_3$ to $C_4$)sulfonate, sodium-3-{omega-fluoroalkanoyl($C_6$ to $C_8$)-N-ethylamino}-1-propanesulfonate, fluoroalkyl($C_{11}$ to $C_{20}$) carboxylic acid or a metal salt thereof, perfluoroalkyl($C_7$ to $C_{11}$)carboxylic acid or a metal salt thereof, perfluoroalkyl($C_4$ to $C_{12}$) sulfonic acid or a metal salt thereof, perfluorooctanesulfonic acid diethanol amide, N-propyl-N-(2-hydroxyethyl) perfluorooctanesulfone amide, perfluoroalkyl($C_6$ to $C_{10}$)sulfoneamidepropyltrimethylammonium salt, a salt of perfluoroalkyl ($C_6$ to $C_{10}$)-N-ethylsulfonyl glycin, monoperfluoroalkyl($C_6$ to $C_{16}$)ethylphosphate, and the like. Examples of the commercially available surfactant having a fluoroalkyl group are: Surflon S-111, S-112 and S-113 (by Asahi Glass Co.); Frorard FC-93, FC-95, FC-98 and FC-129 (by Sumitomo 3M Ltd.); Unidyne DS-101 and DS-102 (by Daikin Industries, Ltd.); Megafac F-110, F-120, F-113, F-191, F-812 and F-833 (by Dainippon Ink and Chemicals, Inc.); ECTOP EF-102, 103, 104, 105, 112, 123A, 123B, 306A, 501, 201 and 204 (by Tohchem Products Co.); Futargent F-100 and F150 (by Neos Co.).

Examples of the cationic surfactant are amine salt, quaternary amine salt, and the like. Examples of the amine salt are alkyl. amine salt, aminoalcohol fatty acid derivative, polyamine fatty acid derivative, imidazoline, and the like. Examples of the quaternary ammonium salt are alkyltrimethyl ammonium salt, dialkyldimethyl ammonium salt, alkyldimethyl benzyl ammonium salt, pyridinium salt, alkyl isoquinolinium salt, benzethonium chloride, and the like. Among them, preferable examples are primary, secondary or tertiary aliphatic amine having a fluoroalkyl group, aliphatic quaternary ammonium salt such as perfluoroalkyl($C_6$ to $C_{10}$) sulfoneamidepropyltrimethylammonium salt, benzalkonium salt, benzetonium chloride, pyridinium salt, imidazolinium salt, and the like. Specific examples of the commercially available product thereof are Surflon S-121 (by Asahi Glass Co.), Frorard FC-135 (by Sumitomo 3M Ltd.), Unidyne DS-202 (by Daikin Industries, Ltd.), Megaface F-150 and F-824 (by Dainippon Ink and Chemicals, Inc.), Ectop EF-132 (by Tohchem Products Co.), and Futargent F-300 (by Neos Co.).

Examples of the nonionic surfactant are fatty acid amide derivative, polyhydric alcohol derivative, and the like.

Examples of the ampholytic surfactant are alanine, dodecyldi(aminoethyl)glycin, di(octylaminoethyle)glycin, N-alkyl-N,N-dimethylammonium betaine, and the like.

Examples of the water-insoluble inorganic dispersant are tricalcium phosphate, calcium carbonate, titanium oxide, colloidal silica, hydroxyl apatite, and the like.

Examples of the polymeric protective colloid are acid, (meth)acryl monomer having a hydroxyl group, vinyl alcohol or ether thereof, ester of vinyl alcohol and a compound having a carboxyl group, amide compound or methylol compound thereof, chloride, monopolymer or copolymer having a nitrogen atom or heterocyclic ring thereof, polyoxyethylene, celluse, and the like.

Examples of the acid are acrylic acid, methacrylic acid, α-cycnoacrylic acid, α-cycnomethacrylic acid, itaconic acid, crotonic acid, fumaric acid, maleic acid, maleic anhydride, and the like. Examples of the (meth)acryl monomer having a hydroxyl group are β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, glycerin monomethacrylate, N-methylol acrylamido, N-methylol methacrylamide, and the like. Examples of the vinyl alcohol or ether thereof are vinyl methyl ether, vinyl ethyl ether, vinyl propyl ether, and the like. Examples of the ester of vinyl alcohol and a compound having a carboxyl group are vinyl acetate, vinyl propionate, vinyl butyrate, and the like. Examples of the amide compound or methylol compound thereof are acryl amide, methacryl amide, diacetone acrylic amide acid, or methylol thereof, and the like.

Examples of the chloride are acrylic chloride, methacrylic chloride, and the like. Examples of the monopolymer or copolymer having a nitrogen atom or heterocyclic ring thereof, are vinyl pyridine, vinyl pyrrolidone, vinyl imidazole, ethylene imine, and the like. Examples of the polyoxyethylene are polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, polyoxyethylene nonylphenyl ester, and the like. Examples of the cellulose are methyl cellulose, hydroxyethyl cellulose, hydroxypropyl cellulose, and the like.

In the preparation of the dispersion, a dispersing stabilizer is employed, if necessary. The dispersing stabilizer is, for example, acid such as calcium phosphate, alkali-soluble compound, or the like.

In the case that the dispersing stabilizer is employed, the dispersing stabilizer is dissolved by acid such as hydrochloric acid, and then is washed with water or decomposed by a enzyme, thereby being removed from fine particles.

In the preparation of the dispersion, a catalyst for the elongation and/or crosslinking reaction is employed, if necessary. The catalyst is, for example, dibutyltin laurate, dioctyltin laurate, and the like.

-Oil Droplets-

The aforementioned oil droplets are formed by emulsifying and/or dispersing the aforementioned oil phase in the aforementioned aqueous phase.

Being formed by emulsifying and/or dispersing the oil phase in the aqueous phase, the oil droplets have the same composition as the oil phase. Therefore, the oil droplets contain toner materials including any of the aforementioned monomer, polymer, active hydrogen group-containing compound, and polymer (prepolymer) that is reactive with the hydrogen-containing compound and, if necessary, the aforementioned other components such as colorants, releasing agents, and charge controlling agents. The oil droplets preferably contain the aforementioned organic solvent, the toner materials being dissolved in the organic solvent.

The viscosity of the oil droplets can be determined by, for example, measuring dynamic viscoelasticity. The flowability of the oil droplets can be determined by, for example, measuring the Casson yield value.

The dynamic viscoelasticity measurement is not particularly limited and may be appropriately selected in accordance with a purpose. For example, the dynamic viscoelasticity can be determined based on a hysteresis curve obtained by a Highshare viscometer ("AR2000", by TA Instruments Inc.).

It is preferable that the oil droplets have a Casson yield value at 25° C. of larger than 0.5 Pa and not larger than 10,000 Pa during the convergence and during the removal of organic solvent.

When the Casson yield value is 0.5 Pa or smaller, irregularly shaped toner particles may not be obtained. When the Casson yield value is larger than 10,000 Pa, the oil droplets become highly flowable and viscous, which sometimes leads to low productivity.

When the Casson yield value is 0.5 Pa or smaller, the oil droplets have a weak structural viscosity and exhibit a state close to the aforementioned Newtonian viscosity even if the oil droplets have a structural viscosity.

Figure 2:
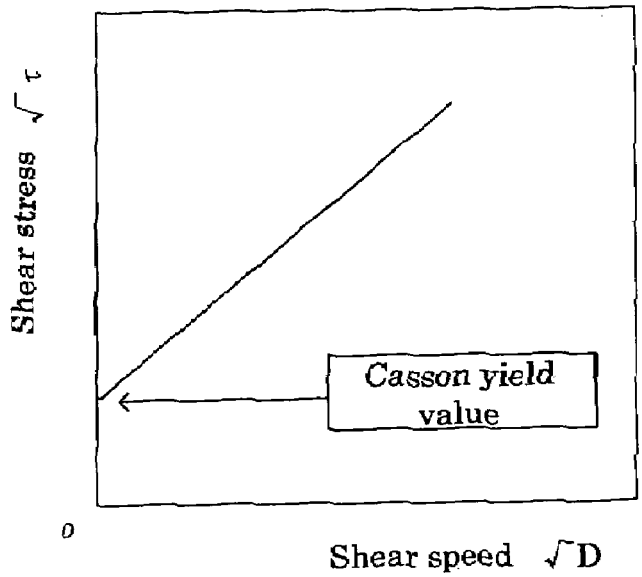
FIG. 2 is a graphical representation showing a Casson yield value.

The Casson yield value is described in, for example, "Rheology for Chemists" (by Shigeharu Onogi, Kagaku-Dojin, p. 205) and determined by the Casson approximation equation, which is given as the Equation 1 below. The Casson yield value indicates a shear stress when a shear speed is zero as shown in FIG. 2.

$$\sqrt{\tau}-\sqrt{\tau 0}=\sqrt{E_{ta}\times D} \qquad \text{Equation 1}$$

in which τ is a hear stress, $\tau_0$ is a yield value, Eta is a plastic viscosity, and D is a shear speed.

The Casson yield value can be measured by, for example, Highshare viscometer ("AR2000," by TA Instruments Inc.).

The contents of the aqueous and oil phases in the oil droplets are not particularly restricted and can be appropriately selected in accordance with a purpose. For example, it is preferable that they contain 90% by mass to 10% by mass of the aqueous phase and 10% by mass to 90% by mass of the oil phase. When the contents of the aqueous and oil phases are within these ranges, an oil-in-water emulsion or suspension in which the oil phase is dispersed in the aqueous phase is formed.

<Convergence>

The convergence allows the oil droplets formed by emulsifying and/or dispersing the oil phase in the aqueous phase to associate between nearby oil droplets. As a result of the convergence, nearby oil droplets associate to form a particle.

The convergence is used in some toner production techniques where the toner is granulated in an aqueous phase, such as known suspension polymerization, emulsion polymerization, dissolution/suspension, and a technique in which adhesive base materials are granulated as described later.

If high shear force is applied while the oil phase is emulsified or dispersed in the aqueous phase, the oil droplets will have a perfect spherical shape due to the difference in interfacial tension between the oil and aqueous phases not only when the oil phase exhibits a Newtonian viscosity but also when the oil phase exhibits a non-Newtonian viscosity because the high shear force destroys the structural viscosity and causes a viscosity close to a Newtonian fluid.

If low shear force such as slow stirring is applied to the oil droplets or the oil droplets are allowed to stay still during the convergence, a toner having a narrow particle diameter distribution can be obtained. This is presumably because smaller oil droplets associate with larger oil droplets, which reduces a fine powder range, thereby narrowing an overall particle diameter distribution even if the oil droplets have a wide particle diameter distribution.

It is essential to inhibit the oil droplets from flowing during the convergence for obtaining irregularly shaped toner particles.

Figure 3A:
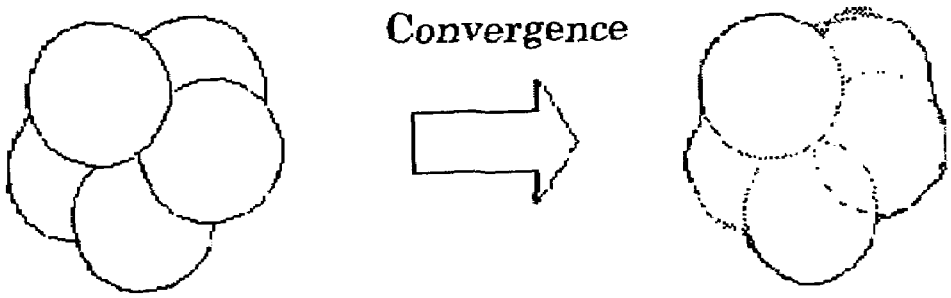
FIG. 3A is an illustration showing a convergence of large particle diameter oil droplets when they exhibit a non-Newtonian viscosity.
Figure 3B:
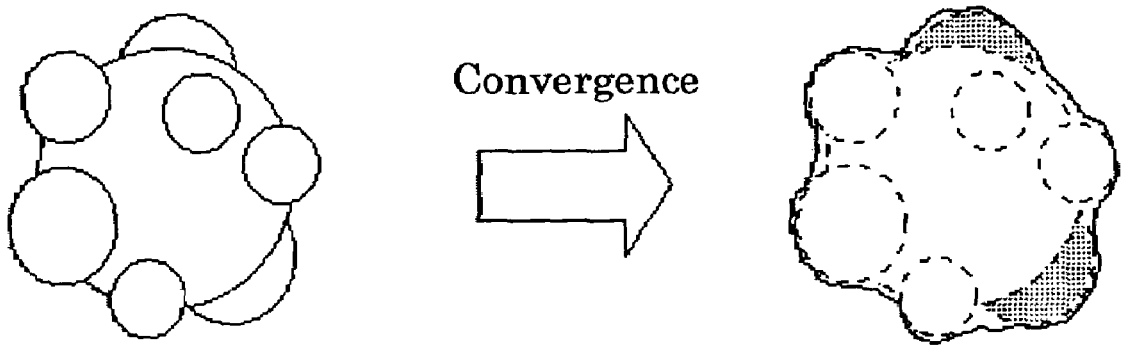
FIG. 3B is an illustration showing a convergence of small particle diameter oil droplets when they exhibit a non-Newtonian viscosity.

The oil droplets are released from high shear force during the convergence. The oil droplets associate with each other when or while they recover a structural viscosity provided that the oil droplets exhibit a non-Newtonian viscosity and have a structural viscosity. The associated oil droplets have a structural viscosity and, therefore, the oil droplets do not flow around within the oil droplets. Therefore, individual oil droplets within a formed particle maintain their shapes and form an irregularly shaped particle. For example, as shown in FIG. 3A, larger particle diameter oil droplets maintain their larger particle diameter oil droplet forms within a formed particle after the convergence. A shown in FIG. 3B, smaller particle diameter oil droplets maintain their smaller particle diameter oil droplet forms though they associate with a larger particle diameter oil droplet after the convergence.

Hence, both larger and smaller particle diameter oil droplets relatively maintain their oil droplet forms though their interfaces associate with each other, thereby forming irregularly shaped toner particles.

<Removal of the Organic Solvent>

The organic solvent is removed from the oil droplets formed by emulsifying and/or dispersing the aforementioned oil phase containing the organic solvent in the aforementioned aqueous phase.

The removal of organic solvent is conducted when toners are produced by known dissolution/suspension method or by the aforementioned preferred embodiment of the toner production method of the present invention.

It is essential to inhibit flowing movement within the oil droplets during the removal of organic solvent for obtaining irregularly shaped toner particles.

Figure 4:
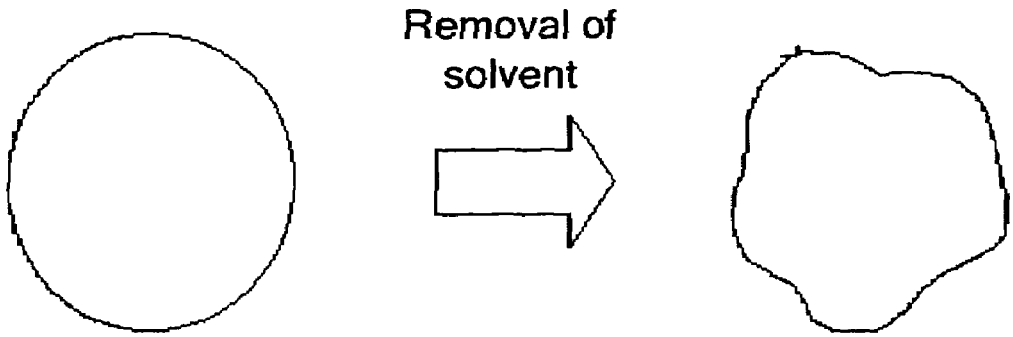
FIG. 4 is an illustration showing an example of organic solvent removal when oil droplets exhibit a non-Newtonian viscosity.

When the oil droplets exhibit a non-Newtonian viscosity and have a structural viscosity, the oil droplets recover their viscosity over time even if the structural viscosity is destroyed by emulsifying and/or dispersing. As shown in FIG. 4, for example, even if the structural viscosity is not recovered during the convergence and larger spherical or nearly spherical oil droplets are obtained, irregularly shaped particles can be formed by allowing the structural viscosity to recover over time and removing the organic solvent. This is because there is no flowing movement within the oil droplets during the removal of the organic solvent and, therefore, the surface area shrinkage does not follow the uniform contraction in volume.

Through the removal of the organic solvent, irregularly shaped toner particles can be obtained as long as the oil droplets exhibit a non-Newtonian viscosity during the removal. However, it is preferable that, provided the oil droplets are subject to the convergence and the organic solvent is removed from the converged oil droplets, the oil droplets exhibit a non-Newtonian viscosity during the convergence and the oil droplets exhibit a non-Newtonian viscosity during the removal of the organic solvent. Smaller sized and irregularly shaped toner particles can be obtained when the oil droplets exhibit a non-Newtonian viscosity during the convergence and during the removal of organic solvent.

The removal of the organic solvent is carried out, for example, by the following methods (1)-(2):

(1) the temperature of the dispersion is gradually increased, and the organic solvent in the oil droplets are completely evaporated and removed;

(2) the emulsified dispersion is sprayed in a dry atmosphere, the water-insoluble organic solvent is completely evaporated and removed from the oil droplets to form toner particles, and the aqueous dispersant is evaporated and removed.

Once the organic solvent is removed, toner particles are formed. The toner particles are preceded with washing, drying, and the like. Sequentially, the toner particles are optionally preceded with a classification. The classification is, for example, carried out by cyclone, decanter, or centrifugal separation in the solution. Alternatively, the classification is carried out after the toner particles are obtained as powder by drying.

The thus obtained toner particles are subjected to mixing with particles such as the colorant, the releasing agent, the charge controlling agent, etc., and mechanical impact, thereby preventing the particles such as the releasing agent falling off from the surface of the toner particles.

Examples of the method of imparting mechanical impact are a method in which an impact is imparted by rotating a blade at high speed, and a method in which an impact is imparted by introducing the mixed particles into a high-speed flow and accelerating the speed of the flow so as to make the particles to impact with each other or so as to make the composite particles to impact upon an impact board. Examples of a device employed to such method are an angmill (by Hosokawamicron Corp.), a modified I-type mill (by Nippon Pneumatic Mfg. Co., Ltd.) to decrease crushing air pressure, a hybridization system (by Nara Machinery Co., Ltd.), a kryptron system (by Kawasaki Heavy Industries, Ltd.), an automatic mortar, and the like.

The toner preferably has the following average circularity, volume average particle diameter (Dv), a ratio (Dv/Dn) of volume average particle diameter (Dv) to number average particle diameter (Dn), penetration, low-temperature fixing properties, offset non-occurring temperature, thermal characteristics, glass transition temperature, acid value, image density, and the like.

The average circularity is an amount which a circumference of an equivalent circle having the same projected area to the toner particle shape minuses a boundary length of the actual toner particle. The average circularity is preferably 0.900 to 0.980, and more preferably 0.900 to 0.970. It is preferable that the amount of the particles having the average circularity of 0.970 or more is 10% or less with respect to the total amount of the toner.

In the case that the average circularity is more than 0.980, it is liable to cause image smears resulted from cleaning failure to a latent electrostatic image bearing member and a transferring belt in an image-forming system utilizing a cleaning blade. Specifically, in the case of a formation of images having large image area such as photographic images, a toner forming an image remains on a latent electrostatic image bearing member due to paper feed failure or the like, and becomes a residual toner. Such residual toner is accumulated on the latent electrostatic image bearing member and the accumulated residual toner causes background smear on the formed image, or pollutes a charging roller which contact-charges the latent electrostatic image bearing member so that the charging roller is unable to exhibits original charging ability.

The average circularity is measured, for example, by an optical detection zone method in which a suspension containing the toner is passed through an image-detection zone disposed on a plate, the particle images of the toner are optically detected by means of a CCD camera, and the obtained particle images are analyzed. For example, Flow-type particle image analyzer FPIA-2100 (by Sysmex Corp.) is employed to measure as follows.

First, 0.1 ml to 0.5 ml of a surfactant, preferably alkylbenzene sulfonate, as a dispersant is added to 100 ml to 150 ml of water from which impurities are previously removed in a container and approximately 0.1 g to 0.5 g of a measuring sample is added. The suspension in which the sample is dispersed is subject to dispersion using an ultrasonic dispersing devise for approximately one to three minutes to a dispersion concentration of 3,000 particles/μl to 10,000 particles/μl. The shape and distribution of toner particles can be measured using the aforementioned flow-type particle image analyzer.

The volume average particle diameter (Dv) of the toner is preferably 3 μm to 8 μm, more preferably 4 μm to 7 μm.

In the case that the volume average particle diameter is less than 3 μm, the toner of two-component developer is liable to fuse onto carrier surfaces as a result of stirring in the developing unit for a long period, and a one-component developer is liable to cause a filming to a developing roller or fusion to a member such as a blade for reducing a thickness of a toner layer formed onto a developing roller.

In the case that the volume average particle diameter is more than 8 μm, an image of high resolution and high quality is rarely obtained, and the average toner particle diameter is liable to fluctuate when a toner is repeatedly added to the developer to compensate the consumed toner.

The ratio (Dv/Dn) of the volume average particle diameter (Dv) to the number average particle diameter (Dn) is preferably 1.05 to 1.25, more preferably 1.05 to 1.20.

In the case that the ratio is less than 1.05, the toner of a two-component developer is liable to fuse onto carrier surfaces due to stirring in a developing unit for a long-term, thereby degrading a charging ability of the carrier or cleaning properties, and a one-component developer is liable to cause a filming to a developing roller or fusion to a member such as a blade for reducing a thickness of a toner layer formed onto a developing roller. In the case that the ratio is more than 1.25, an image of high resolution and high quality is rarely obtained, and the average toner particle diameter is liable to fluctuate when a toner is repeatedly added to the developer to compensate the consumed toner.

When the ratio (Dv/Dn) of volume-average particle diameter to number-average particle diameter is 1.05 to 1.20, excellent heat resistance preservation, low temperature fixing property, and hot-offset resistance are obtained and, particularly, glossiness of the image can be obtained with a full color copy machine. Two-component developers show little changes in toner particle diameter after a prolonged time of toner in and out. After a prolonged time of stirring in the developing apparatus, they provide excellent and stable developing properties. One-component developers show little changes in toner particle diameter after a prolonged time of toner in and out. In addition, there is no toner filming on the developing roller or adhered by fusion to the parts such as the blade for forming a thin toner layer. They provide excellent and stable developing properties after a prolonged time of use of a developing apparatus (stirring), thereby high quality images can be obtained.

The volume average particle diameter and the ratio (Dv/Dn) are measured, for example, by means of a particle diameter analyzer, MultiSizer II, manufactured by Beckmann Coulter Inc.

The penetration is 15 mm or more, and preferably 20 mm to 30 mm in accordance with a penetration test (JIS K2235-1991).

In the case that the penetration is less than 15 mm, it is liable to degrade heat resistance preservation.

The penetration is measured in accordance with JIS K2235-1991. Specifically, the penetration is measure by filling a toner into a 50 ml glass container, leaving the glass container filled with the toner in a thermostat of 50° C. for 20 hours, sequentially cooling the toner to an ambient temperature, and then carrying out a penetration test thereto. Note that, the higher the penetration is, more excellent heat resistance preservation the toner has.

As the low-temperature fixing properties of the toner, the lowest fixing temperature is preferably as low as possible, and the offset non-occurring temperature is preferably as high as possible, in view of realizing both lower fixing temperature and prevention of offset. When the lowest fixing temperature is less than 140° C. and the offset non-occurring temperature is 200° C. or more, both the lower fixing temperature and prevention of offset are realized.

The lowest fixing temperature is determined as follow. A transfer sheet is set in an image-forming apparatus, a copy test is carried out, the thus obtained fixed image is scrubbed by pads, and the persistence of the image density is measured. The lowest fixing temperature is determined as a temperature at which the persistence of the image density becomes 70% or more.

An example of method for measuring the offset non-occurring temperature is as follows: A transfer sheet is set in an image-forming apparatus, and the image-forming apparatus is adjusted to develop a solid image with a predetermined amount of toner to be evaluated to vary the temperature of a fixing member. The offset non-occurring temperature is determined as the highest fixing temperature at which offset does not occur.

The thermal characteristics are also referred to flow tester characteristics, and are evaluated by softening temperature (Ts), flow-beginning temperature (Tfb), 1/2 method softening temperature (T1/2), and the like.

These thermal characteristics are measured by an appropriately selected method. For example, the thermal characteristics are obtained from a flow curve measured by means of a capillary flow tester CFT500 manufactured by Shimazu Corporation.

The softening temperature (Ts) is not particularly limited, and may be appropriately adjusted in accordance with a purpose. It is preferably 30° C. or more, and more preferably 50° C. to 90° C. In the case that the softening temperature (Ts) is less than 30° C., the heat resistance preservation may be degraded.

The flow-beginning temperature (Tfb) is not particularly limited, and may be appropriately adjusted in accordance with a purpose. It is preferably 60° C. or more, and more preferably 80° C. to 120° C. In the case that the flow-beginning temperature (Tfb) is less than 60° C., at least one of the heat resistance preservation or low-temperature preservation may be degraded.

The 1/2 method softening temperature (T1/2) is not particularly limited, and may be appropriately adjusted in accordance with a purpose. It is preferably 90° C. or more, and more preferably 100° C. to 170° C. In the case that the 1/2 method softening temperature (T1/2) is less than 90° C., the offset resistance may be degraded.

The glass transition temperature is not particularly limited, and may be appropriately selected in accordance with a purpose. It is preferably 40° C. to 70° C., more preferably 45° C. to 65° C. In the case that the glass transition temperature is lower than 40° C., it is liable to degrade heat resistance preservation of the toner. In the case that the glass transition temperature is higher than 70° C., it is liable to degrade lower-temperature fixing properties.

The glass transition temperature may be measured in accordance with differential scanning calorimetry (DSC), for example, by using a DSC 60 (manufactured by Shimadzu Corporation).

The acid value of the toner is preferably 1.0 mg KOH/g to 50.0 mg KOH/g, more preferably 3 mg KOH/g to 35 mg KOH/g. By imparting the acid value to the toner, the toner is generally liable to be negatively chargeable.

The image density is determined as a density value measured by means of a spectrometer (SpectroDensitometer 938, by X-Rite K.K.), and is preferably 1.40 or more, more preferably 1.45 or more, and further more preferably 1.50 or more.

In the case that the image density is less than 1.40, the image density is low and thus a high quality image may not be obtained.

The image density is measured as follow. A solid image is formed by using a transfer sheet ("Type 6200", by Ricoh Company, Ltd.), and a tandem type color image-forming apparatus (imagioNeo 450, by Ricoh Company, Ltd.) The photocopier was adjusted so that 1.00±0.1 mg/cm$^2$ of toner is transferred onto the sheet, and the transferred image is fixed by the fixing roller having a surface temperature of 160±2° C. The thus obtained solid image is subjected to a measurement of glossines by means of a spectrometer (SpectroDensitometer 938. by X-Rite K.K.), and an average value of measurements at arbitrary selected five points in the solid image is calculated.

The coloration of the toner is not particularly limited, and may be appropriately selected in accordance with a purpose. For example, the coloration is at least one selected from a black toner, a cyan toner, a magenta toner, and a yellow toner. Each color toner is obtained by appropriately selecting the colorant to be contained therein.

The toner production method of the present invention at least comprises emulsifying and/or dispersing the aforementioned oil phase in the aforementioned aqueous phase to form oil droplets and conversing the oil droplets, wherein the oil droplets exhibit a non-Newtonian viscosity during the convergence and, therefore, there is no flowing movement within the oil droplets when the oil droplets associate with each other, thereby irregularly shaped particles are obtained.

Alternatively, the toner production method of the present invention at least comprises emulsifying and/or dispersing the aforementioned oil phase containing an organic solvent in the aforementioned aqueous phase to form oil droplets and removing the organic solvent from the oil droplets, wherein the oil droplets exhibit a non-Newtonian viscosity during the removal of organic solvent and, therefore, there is no flowing movement within the oil droplets during the removal of organic solvent and the surface area shrinkage does not follow the contraction in volume, thereby irregularly shaped particles are obtained.

Hence, a toner having small-sized and potato shaped particles created from multiple coherent spherical particles for excellent cleaning ability, high image quality, excellent cleaning ability, and high image quality can be efficiently produced.

The toner of the present invention has small-sized and potato-shaped particles created from multiple coherent spherical particles, thereby having excellent cleaning ability and proving high quality images. When it contains the aforementioned adhesive base material obtained by reacting the aforementioned active hydrogen group-containing compound and the aforementioned polymer that is reactive with the active hydrogen group-containing compound in an aqueous phase, the toner of the present invention has excellent properties including aggregation resistance, electification, flowability, releasing, fixing property, particularly has excellent low temperature fixing property. Therefore, the toner of the present invention can be preferably used in a variety of fields. It is further preferably used in forming images in electro-photography, and is preferably used in the toner container, developer, process cartridge, image-forming apparatus, and image-forming method of the present invention.

(Developer)

The developer according to the present invention comprises the toner according to the present invention, and the other ingredients such as carrier selected properly. The developer may be a one-component or two-component developer; however, the developer is preferably of two-component type in light of such factor as prolonged life, in order to be applied to high-speed printers for the purpose of nowadays increased information processing rate.

In the case of the one-component developer comprising the toner according to the present invention, even after consumption and addition of the toner, the variation of the toner particle diameter is minimized, filming of the toner to a developing roller, and toner fusion to members such as a toner blade which controls the toner thickness on the development roller are also prevented, and also excellent and stable developing properties and images may be obtained even after the developing apparatus is utilized (stirred) for a long period. Further, in the case of the two-component developer comprising the toner according to the present invention, even after prolonged consumption and addition of the toner, the variation of the toner particle diameter is minimized, and even after the developing apparatus is stirred for a long period, excellent and stable developing properties may be obtained.

The carrier may not particularly limited and may be appropriately selected in accordance with a purpose. However, the carrier is preferably those having a core material and a resin layer coating the core material.

The material for the core may be not particularly limited and may be appropriately selected from conventional materials; for example, the material based on manganese-strontium (Mn—Sr) of 50 emu/g to 90 emu/g and the material based on manganese-magnesium (Mn—Mg) are preferable, high magnetizing materials such as iron powder (100 emu/g or more) and magnetite (75 emu/g to 120 emu/g) are preferable from the standpoint of securing image density. Also, weak magnetizing materials such as of copper-zinc (Cu—Zn) (30 emu/g to 80 emu/g) are preferable from the standpoint for aiming higher-grade images by means of softening the contacts of the toner to the photoconductor where the toner is standing. Each of these materials may be employed alone or in combination.

As for the particle diameter of the core material, preferably the volume-average particle diameter is 10 μm to 150 μm, more preferably 40 μm to 100 μm.

When the volume-average particle diameter is less than 10 μm, the carrier particle distribution contains fine particle in significant fraction, which may cause carrier scattering due to lowered magnetization per one particle, on the other hand, when it exceeds 150 μm, the specific surface area comes to lower, which may cause toner scattering and deteriorate the production quality of the contact printing part for full-color printing.

The material for the resin layer is not particularly limited and may be properly selected from conventional resins in accordance with a purpose; examples of the material for the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoro ethylene resins, polyhexafluoropropylene resins, copolymers of vinylidene fluoride with acrylic monomer, copolymers of vinylidene fluoride with vinyl fluoride, fluoroterpolymers such as the terpolymer of tetrafluoroethylene, vinylidene fluoride and a non-fluoride monomer, and silicone resins. Each of these resins may be used alone or in combination.

The amino resins include, for example, urea-formaldehyde resins, melamine resins, benzoguanamine resins, urea resins, polyamide resins, epoxy resins, and the like. The polyvinyl resins include acrylic resins, polymethyl methacrylate resins, polyacrylonitrile resins, polyvinyl acetate resins, polyvinyl alcohol resins, polyvinyl butyral resins, and the like. The polystyrene resins include polystyrene resins, styrene acryl copolymer resins and the like. The halogenated olefin resins include polyvinyl chloride and the like. The polyester resins include polyethylene terephthalate resins, polybutylene terephthalate resins and the like.

The resin layer may be contained such material as conductive powder depending on the application; as for the conductive powder, metal powder, titanium oxide, tin oxide, zinc oxide, and the like are exemplified. These conductive powders preferably have an average particle diameter of 1 μm or less. When the average particle diameter is more than 1 μm, it may be difficult to control electrical resistance. The resin layer may be formed by first dissolving the silicone resins into a solvent to prepare a coating solution, then uniformly coating the surface of the core material with the coating solution by means of the immersion process, the spray process, the brush painting process and the like, and baking it after drying.

The solvent is not particularly limited and may be appropriately selected in accordance with a purpose. Examples of the solvent include toluene, xylene, methylethylketone, methylisobutylketone, and celsorbutylacetate and the like.

The baking process may be an externally heating process or an internally heating process, and can be selected from, for example, a process using either a fixed type electric furnace, a fluid type electric furnace, a rotary type electric furnace, and a burner furnace, or a process of using microwave and the like.

The ratio of the resin layer in the carrier is preferably 0.01% by mass to 5.0% by mass base on the entire amount of the carrier. When the ratio is less than 0.01% by mass, it is difficult to form a uniform resin layer, on the other hand, when the ratio exceeds 5.0% by mass, the resin layer becomes too thick and particle formation between carriers occurs, as the result uniform carrier fine particles may not be obtained.

When the developer is two-component developer, the content of the carrier in the two-component developer is not particularly limited and may be properly selected in accordance with a purpose; for example, it is preferably 90% by mass to 98% by mass, more preferably 93% by mass to 97% by mass.

Since the developer according to the present invention comprises the toner of the present invention having small-sized and potato-shaped particles created from multiple coherent particles, cleaning ability is excellent and images of high quality may be realized stably.

The developer according to the present invention may be applied to the image forming by means of publicly known various electro-photography such as a magnetic one-component developing process, non-magnetic one component developing process, two-component developing process, and also employed in an especially suitable manner to the toner container, a process cartridge, an image forming apparatus, and an image forming method, which will be explained in the following.

(Toner Container)

The toner container according to the present invention is a container supplied with the toner or developer according to the present invention.

The toner container is not particularly limited and may be properly selected from conventional containers; for example, the container may be suitably exemplified which comprises a container main body and a cap.

The size, shape, configuration, material and the like of the container main body is not particularly limited and may be properly selected in accordance with a purpose. For example, the shape is preferably cylindrical, and such configuration is particularly preferable that spiral convexo-concave grooves are formed on the inner surface so as to allow the toner, which is the content of the container, shift to the exit with involving motion, and all or part of the spiral grooves provide a bellows function.

The material for the container main body is not particularly limited and may be preferably selected from the materials which may provide suitable dimension accuracy; the material may be resin, for example, of polyester resins, polyethylene resins, polypropylene resins, polystyrene resins, polyvinyl chloride resins, polyacrylic acid resins, polycarbonate resins, ABS resins, polyacetal resins, and the like.

The toner container according to the present invention may provide easy storing and transporting abilities, and excellent handling property, and may be preferably utilized with the process cartridge, image forming apparatus and the like, by detachably mounting it on them for supplying the toner.

(Process Cartridge)

The process cartridge according to the present invention at 10 least comprises a latent electrostatic image bearing member configured to bear a latent electrostatic image and a developing unit configured to develop the latent electrostatic image borne by the latent electrostatic image bearing member using a toner and further comprises other appropriately selected units.

The developing unit at least comprises a developer container for storing the toner or developer according to the present invention, and a developer carrier for carrying and transferring the toner or developer stored in the developer container, and may further comprises a layer-thickness control member for controlling the thickness of a toner layer to be carried.

The process cartridge according to the present invention can be detachably mounted on a variety of electrophotographic apparatus and preferably detachably mounted on the electrophotographic apparatus of the present invention, which is described later.

Figure 5:
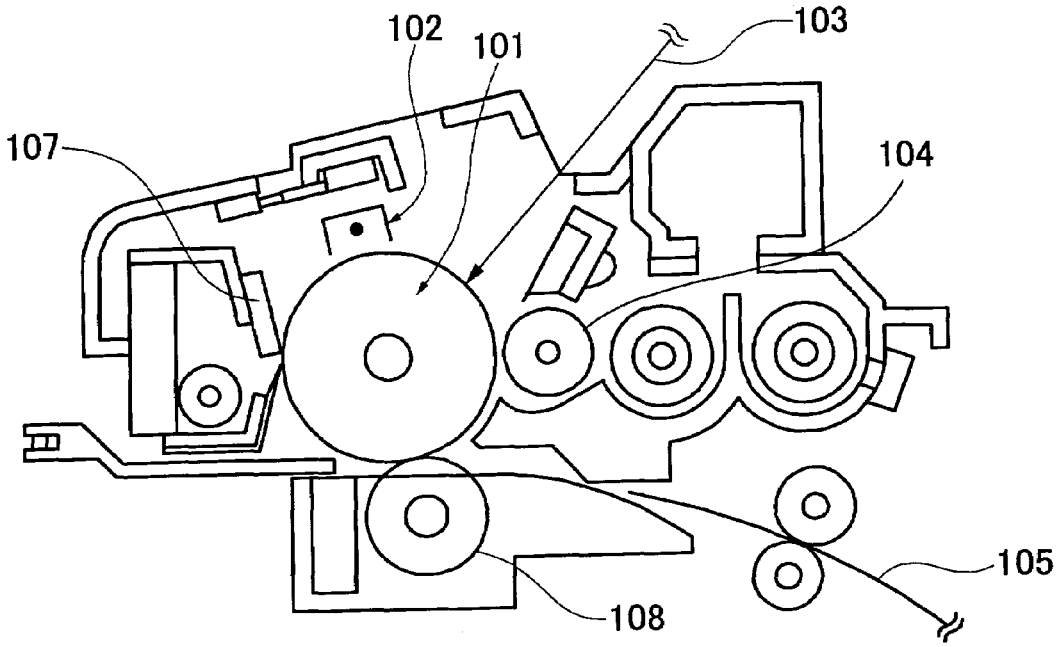
FIG. 5 is a schematic illustration showing an embodiment of the process cartridge of the present invention.

The process cartridge comprises, for example as shown in FIG. 5, built-in photoconductor 101, charging unit 102, developing unit 104, and cleaning unit 107 and, if necessary, further comprises other members. In FIG. 5 also shown is exposing unit 103 in which a light source that allows for high resolution writing is used. Recording medium 105 and transferring roller 108 are also shown.

The photoconductor 101 can be the same one as in the image-forming apparatus described later.

The charging unit 102 can be any charging member.

(Image-Forming Method and Image-Forming Apparatus)

The image-forming method according to the present invention at least comprises a latent electrostatic image-forming step, a developing step, a transferring step, and a fixing step, and may further comprises other steps, for example, a charge-eliminating step, a cleaning step, a recycling step, and a control step, if required.

The image-forming apparatus according to the present invention at least comprises a latent electrostatic image bearing member, a latent electrostatic image forming unit, a developing unit, a transferring unit, and a fixing unit and, and may further comprises the other units, for example, a charge-eliminating unit, a cleaning unit, recycling unit, and a control unit, if required.

-Latent Electrostatic Image Formation and Latent Electrostatic Image/Forming Unit- The latent electrostatic image formation is a step for forming a latent electrostatic image on a latent electrostatic image bearing member (also referred to a photoconductive insulator, a photoconductor, electrophotographic photoconductor and the like). The latent electrostatic image bearing member is not particularly limited in terms of material, shape, configuration, and size thereof, and may be appropriately selected in accordance with a purpose. A suitable example of the shape thereof is a drum shape. Examples of the material thereof are an inorganic photoconductor such as amorphous silicone, or selenium, an organic photoconductor such as polysilane, or phthalopolymethine, and the like. Among these examples, the amorphous silicon is preferable in view of long lifetime.

The latent electrostatic image formation is carried out, for example, by exposing the latent electrostatic image bearing member to imagewise light after uniformly charging the entire surface of the latent electrostatic image bearing member. This is performed by means of the latent electrostatic image forming unit.

The latent electrostatic image forming unit comprises at least a charging unit which is configured to uniformly charge the surface of the photoconductor, and an exposing unit which is configured to expose the surface of the latent electrostatic image bearing member to imagewise light.

The charging is carried out, for example, by applying voltage to the surface of the photoconductor by means of the charging unit.

The charging unit is not particularly limited, and may be appropriately selected in accordance with a purpose. Examples of the charging unit are the conventional contact-charging unit equipped with a conductive or semiconductive roller, blush, film, or rubber blade, the conventional non-contact-charging unit utilizing corona discharge such as corotron, or scorotoron, and the like.

The exposure is carried out, for example, by exposing the surface of the photoconductor to imagewise light by means of the exposing unit.

The exposing unit is not particularly limited, provided that a predetermined exposure is performed imagewise on the surface of the charged latent electrostatic image bearing member by the charging unit, and may be appropriately selected in accordance with a purpose. Examples of the irradiating unit are various irradiating units such as an optical copy unit, a rod lens array unit, an optical laser unit, an optical liquid crystal shatter unit, and the like In the present invention, a backlight system may be applied for the exposure, in which exposure is carried out imagewise from the back side of the photoconductor.

-Developing and Developing Unit-

The developing is a step of developing the latent electrostatic image with the toner and/or the developer to form a visible image (toner image).

The forming visible image is performed, for example, by developing the latent electrostatic image with the toner and/or the developer by means of the developing unit.

The developing unit is not particularly limited, provided that developing is carried out with the toner of the developer, and may be appropriately selected in accordance with a purpose. A suitable example of the toner-image forming unit is a developing unit which contains a toner and/or a developer therein and capable of directly or indirectly applying the toner and/or the developer to the latent electrostatic image. A developing unit equipped with the toner container of the present invention is preferable.

The developing unit may be of dry developing or wet developing, and a developing unit for mono-color or a developing unit for multi-color. A suitable example of the developing unit is a developing unit comprising a stirring unit which stirs the toner and/or the developer to impart frictional electrification, and a magnet roller which is rotatebly mounted.

Within the developing unit, the toner and carrier are mixed and stirred, and the toner is charged at the time of friction with the carrier, the rotatable magnetic roller bears the charged toner on the surface thereof to form a magnetic blush. Since the magnet roller is disposed adjacent to the photoconductor, a part of the toner consisting of the magnetic blush, which is formed on the surface of the magnetic roller, is electrically attracted and transferred to the surface of the photoconductor. As a result, the latent electrostatic image is developed by the toner, and the visible image (toner image) of the toner is formed on the photoconductor.

The developer contained in the developing unit is a developer comprising the aforementioned toner. The developer is either one-component developer or two-component developer. The toner comprised in the developer is the toner of the invention.

-Transferring and Transferring Unit-

The transferring is a step of transferring the visible image (toner image) onto a recording medium. The preferably embodiment of the transferring is such that a toner image is primary transferred to an intermediate transferring medium, the visible image (toner image) transferred on the intermediate transferring member is secondary transferred to a recording member. The more preferably embodiment of the transferring is such that the toner is of two or more color, or preferably full-color toner, and the transfer contains a primary transferring wherein a toner image is transferred to the intermediate transferring member to form a composite transferred image, and a secondary transferring wherein the composite transferred image is transferred onto a recording member.

The transferring is carried out, for example, by charging the toner image on the photoconductor by means of a transfer charging unit. This transferring is performed by means of the transferring unit. The preferable embodiment of the transferring unit is such that a transferring unit comprises a primary transferring unit which is configured to transfer a toner image onto an intermediate transferring member to form a composite transferred image, and a secondary transferring unit which is configured to transfer the composite transferred image onto a recording medium.

The intermediate transferring member is not particularly limited, and may be selected from the conventional transferring members in accordance with a purpose. Examples thereof are a transferring belt, and the like.

The transferring unit (the primary transferring unit and the secondary transferring unit) preferably comprises a transferring element which is configured to charge so as to separate the visible image (toner image) from the photoconductor and to transfer onto a recording medium. In the image-forming apparatus of the present invention, either one, or plurality of transferring units are disposed.

Examples of the transferring element are a corona transferring element utilizing corona discharge, a transferring belt, a transferring roller, a pressure-transferring roller, an adhesion-transferring element, and the like.

The recording medium is not particularly limited, and may be appropriately selected from the conventional recording mediums (recording medium) in accordance with a purpose.

-Fixing and Fixing Unit-

The fixing is a step of fixing the visible image transferred on a recording medium using a fixing unit. The fixing step can be performed for toner of each color transferred to the recording medium, or in one operation when the toners of each color have been layered.

The fixing unit is not particularly limited and may be appropriately selected in accordance with a purpose. However, conventional heating and pressurizing units are preferable. The heating and pressurizing units include a combination of a heating roller and a pressurizing roller and a combination of a hearing roller, a pressurizing roller, and an endless belt, and the like.

In general, the heating and pressurizing units preferably provide heating to 80° C. to 200° C.

In the present invention, for example, a conventional photo-fixing device can be used along with or in place of the fixing step and fixing unit.

The charge removing is a step of applying a bias to the charged photoconductor so as to remove the charge. This is suitably performed by the charge removing unit.

The charge removing unit is not particularly limited, provided that bias is applied to the charged photoconductor to thereby remove the charge, and can be appropriately selected from the conventional charge removing units in accordance with a purpose. A suitable example thereof is a charge removing lamp.

The cleaning is a step of removing the residual toner on the photoconductor. This is suitably performed by means of the cleaning unit.

The cleaning unit is not particularly limited, provided that the residual electrophotographic toner on the photoconductor is removed, and can be appropriately selected from the conventional cleaners in accordance with a purpose. Examples thereof are a magnetic blush cleaner, a electrostatic brush cleaner, a magnetic roller cleaner, a blade cleaner, a blush cleaner, a wave cleaner, and the like.

The recycling is a step of recycling or recovering the electrophotographic color toner collected by the cleaning to the developing unit. This is suitably performed by means of the recycling unit.

The recycling unit is not particularly limited, and may be appropriately selected from the conventional conveyance systems.

The controlling is a step of controlling each of the aforementioned steps. This is suitably performed by means of the controlling unit.

The controlling unit is not particularly limited, provided that each of the aforementioned units or members is controlled, and can be appropriately selected in accordance with a purpose. Examples thereof are devices such a sequencer, a computer, and the like.

One embodiment of the image-forming method of the present invention by means of the image-forming apparatus of the present invention is explained with reference to FIG. 6.

The image-forming apparatus 100 shown in FIG. 6 comprises the photoconductor drum 10 (referred to a photoconductor 10 hereinafter) as the latent electrostatic image bearing member, the charging roller 20 as the charging unit, the exposure device 30 as the exposing unit, the developing device 40 as the developing unit, the intermediate transferring member 50, the cleaning device 60 as the cleaning unit having a cleaning blade, and the charge removing lamp 70 as the charge removing unit.

The intermediate transferring member 50 is an endless belt, and looped around three rollers 51 which are disposed inside thereof. The intermediate transferring member 50 is configured to rotate in the direction shown with the arrow by means of the rollers 51. One or more of the three rollers 51 also functions as a transfer bias roller which is capable of applying a certain transfer bias (primary bias) to the intermediate transferring member 50. Adjacent to the intermediate transferring member 50, there are disposed the cleaning device 90 having a cleaning blade, and the transferring roller 80 as the transferring unit which is capable of applying a transfer bias so as to transfer (secondary transfer) a developed image (toner image) to transfer sheet 95 as the recording medium. Moreover, there is disposed the corona charger 58 for applying a charge to the toner image transferred on the intermediate transferring medium 50, beside the intermediate transferring medium 50, and in between the contact region of the photoconductor 10 and the intermediate transferring medium 50 and the contact region of the intermediate transferring medium 50 and the transfer sheet 95 in the rotational direction of the intermediate transferring medium 50.

The developing device 40 comprises a developing belt 41, a black developing unit 45K, yellow developing unit 45Y, magenta developing unit 45M, and cyan developing unit 45C, in which the developing units positioned around the developing belt 41. The black developing unit 45K comprises a developer container 42K, a developer supplying roller 43K, and a developing roller 44K; the yellow developing unit 45Y comprises a developer container 42Y, a developer supplying roller 43Y, and a developing roller 44Y; the magenta developing unit 45M comprises a developer container 42M, a developer supplying roller 43M, and a developing roller 44M; the cyan developing unit 45C comprises a developer container 42C, a developer supplying roller 43C, and a developing roller 44C. In addition, the developing belt 41 is an endless belt which is looped around a plurality of belt rollers so as to rotate. Moreover, the developing belt 41 is configured to contact with the photoconductor 10 at a part thereof.

Figure 6:
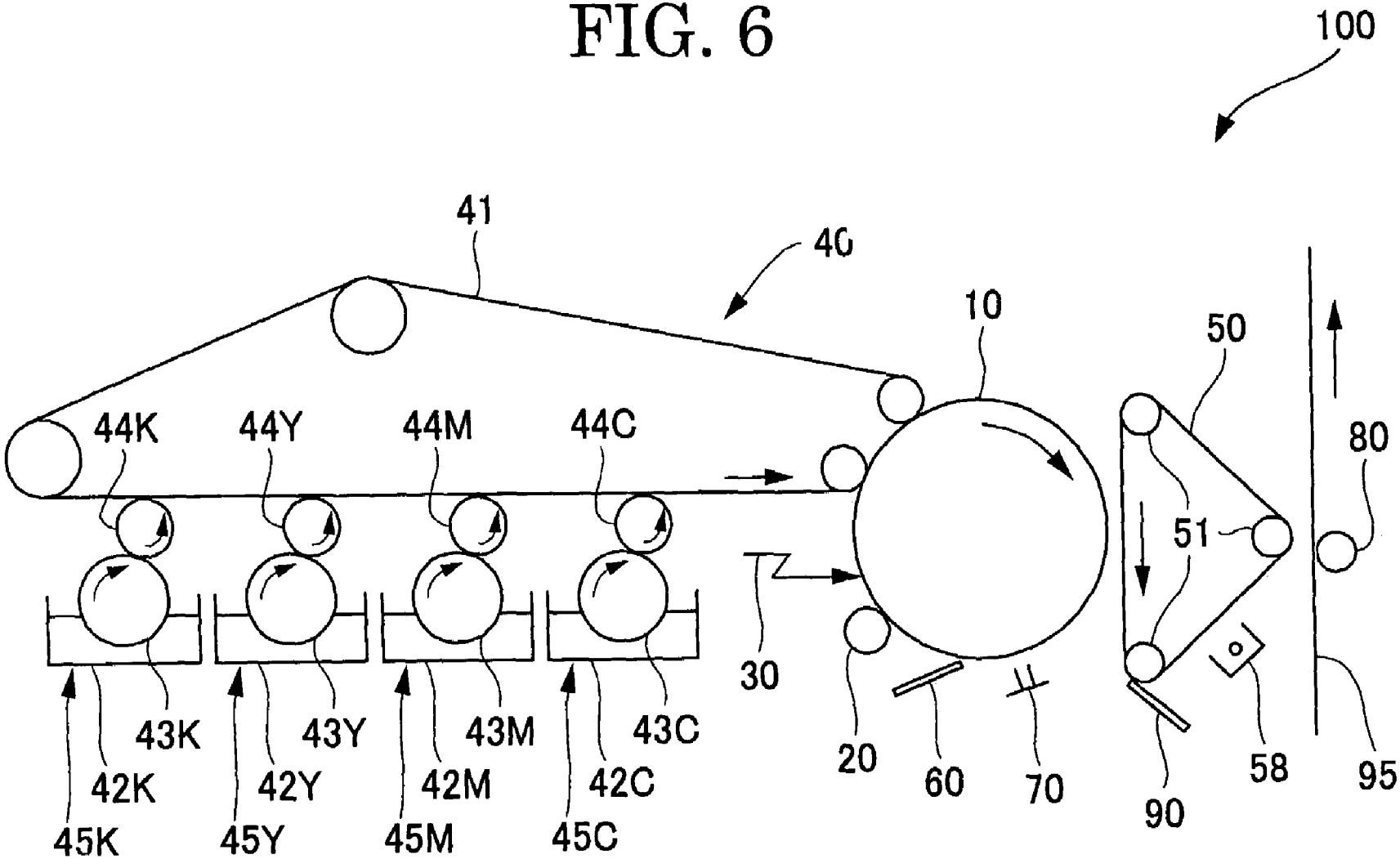
FIG. 6 is a schematic illustration showing an embodiment of the image-forming apparatus of the present invention to execute the image-forming method of the present invention.

In the image-forming apparatus 100 shown in FIG. 6, the photoconductor 10 is uniformly charged by the charging roller 20. The exposure device 30 sequentially exposes the photoconductor 10 to imagewise light so as to form a latent electrostatic image. The latent electrostatic image formed on the photoconductor 10 is supplied with a toner from the developing device 40 so as to form a visible image (toner images). The roller 51 applies a bias to the toner image so as to transfer (primary transfer) the visible image (toner image)

onto the intermediate transferring medium 50, and further applies a bias to transfer (secondary transfer) the toner image from the intermediate transferring medium 50 to the transfer sheet 95. In this way, the transferred image is formed on the transfer sheet 95. Thereafter, the residual toner on the photoconductor 10 is removed by the cleaning device 60, and the charged photoconductor 10 is diselectrified by the charge removing lamp 70.

Figure 7:
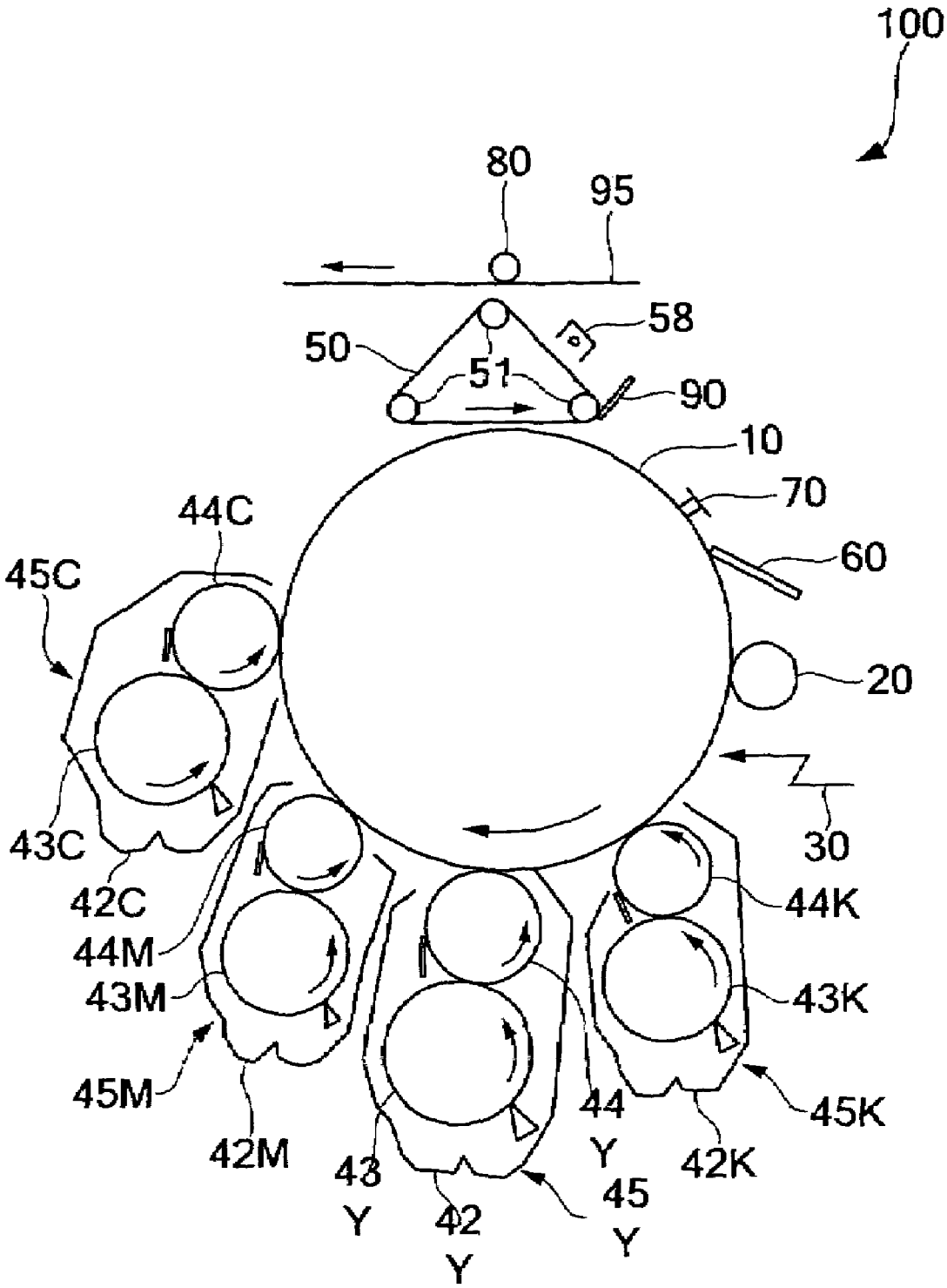
FIG. 7 is a schematic illustration showing another embodiment of the image-forming apparatus of the present invention to execute the image-forming method of the present invention.

Another embodiment of the image-forming method of the present invention by means of the image-forming apparatus of the present invention is explained with reference to FIG. 7. The image-forming apparatus 100 shown in FIG. 7 has the identical configurations and functions to the image-forming apparatus 100 shown in FIG. 6, provided that the image-forming apparatus 100 does not comprise a developing belt 41, and the black developing unit 45K, the yellow developing unit 45Y, the magenta developing unit 45M, and the cyan developing unit 45C are disposed around the photoconductor 10 so as to face to each other. Note that, the reference numbers of FIG. 7 denote the same members or units to the ones in FIG. 6, if the numbers are identical.

Another embodiment of the image-forming method of the present invention by means of the image-forming apparatus of the present invention is explained with reference to FIG. 8.

Figure 8:
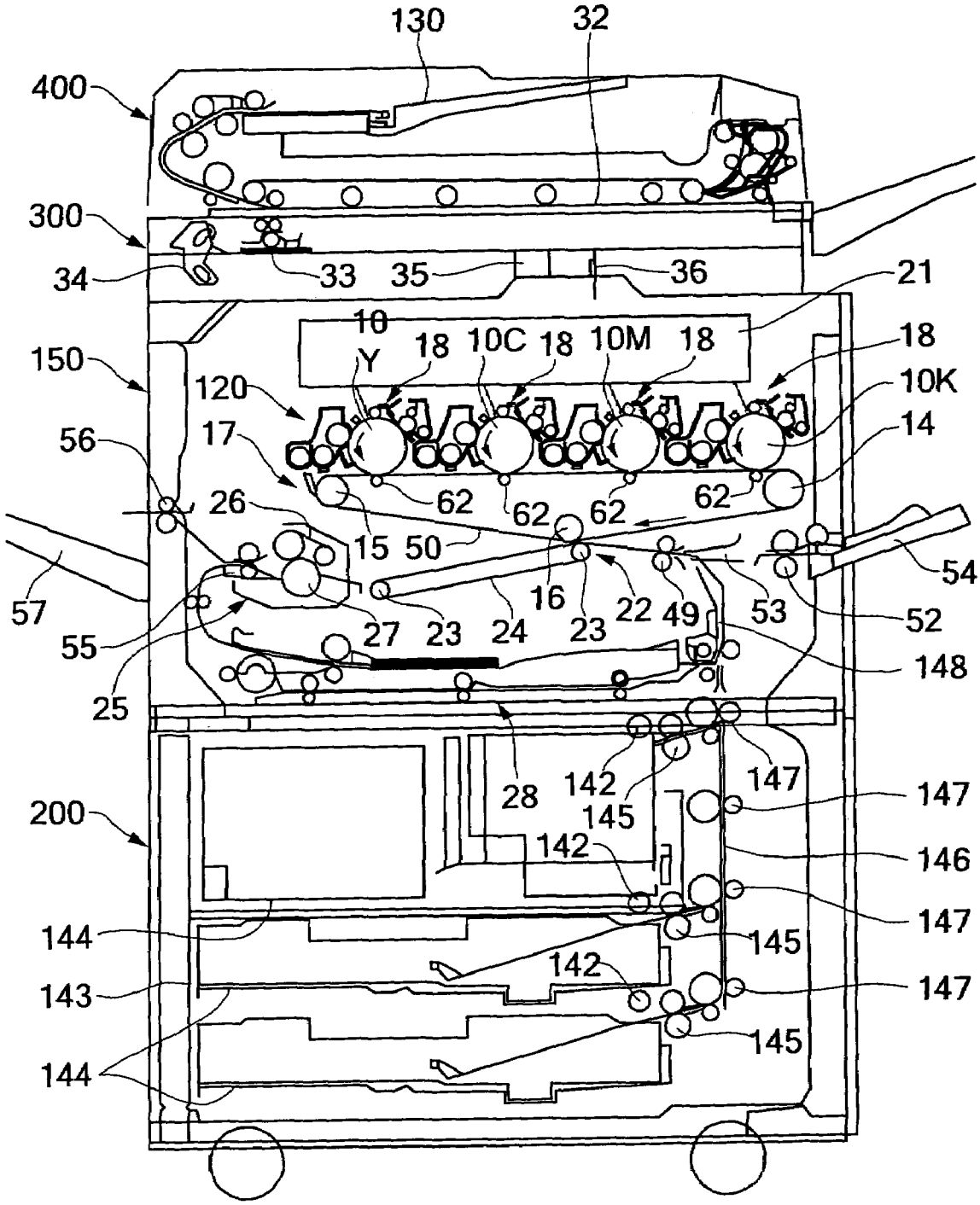
FIG. 8 is a schematic illustration showing an embodiment of the image-forming apparatus of the present invention (a tandem type color image-forming apparatus) to execute the image-forming method of the present invention.

The image-forming apparatus 100 shown in FIG. 8 is a tandem color-image-forming apparatus. The tandem image-forming apparatus 100 comprises a copying machine main body 150, the feeder table 200, the scanner 300, and an automatic document feeder (ADF) 400. The copying machine main body 150 contains the endless-belt intermediate transferring member 50 in the middle part.

The intermediate transferring member 50 shown in FIG. 8 is looped around support rollers 14, 15 and 16 and is configured to rotate in a clockwise direction in FIG. 8. There is disposed the cleaning device 17 for the intermediate transferring member adjacent to the support roller 15. The cleaning device 17 for the intermediate transferring member is capable of removing a residual toner on the intermediate transferring member 50 after transferring a toner image.

Above the intermediate transferring member 50 looped around the support rollers 14 and 15, four image-forming devices 18 of yellow, cyan, magenta, and black are arrayed in parallel in a conveyance direction of the intermediate transferring member 50 to thereby constitute the tandem developing unit 120.

There is also disposed the exposing unit 21 adjacent to the tandem developing unit 120. The secondary transferring unit 22 is disposed the opposite side of the intermediate transferring member 50 to where the tandem developing unit 120 is disposed. The secondary transferring unit 22 comprises the secondary transferring belt 24 of an endless belt, which is looped around a pair of rollers 23. The secondary transferring unit 22 is configured so that the transfer sheet conveyed on the secondary transferring belt 24 contacts with the intermediate transferring member 50. Adjacent to the secondary transferring unit 22, there is disposed the image-fixing device 25. The image-fixing device 25 comprises the fixing belt 26 which is an endless belt, and the pressurizing roller 27 which is disposed so as to contact against the fixing belt 26.

In the tandem image-forming apparatus 100, the sheet reverser 28 is disposed adjacent to the secondary transferring unit 22 and the image-fixing device 25. The sheet reverser 28 is configured to reverse a transfer sheet in order to form images on the both sides of the transfer sheet.

Next, full-color image-formation (color copy) is formed by means of the tandem developing unit 120 in the following manner.

Initially, a document is placed on the document platen 130 of the automatic document feeder 400. Alternatively, the automatic document feeder 400 is opened, the document is placed on the contact glass 32 of the scanner 300, and the automatic document feeder 400 is closed to press the document.

At the time of pushing a start switch (not shown), the document placed on the automatic document feeder 400 is transported onto the contact glass 32. In the case that the document is initially placed on the contact glass 32, the scanner 300 is immediately driven to operate the first carriage 33 and the second carriage 34. Light is applied from a light source to the document, and reflected light from the document is further reflected toward the second carriage 34 at the first carriage 33. The reflected light is further reflected by a mirror of the second carriage 34 and passes through the image-forming lens 35 into the read sensor 36 to thereby read the color document (color image). The read color image is interrupted to image information of black, yellow, magenta and cyan.

Figure 9:
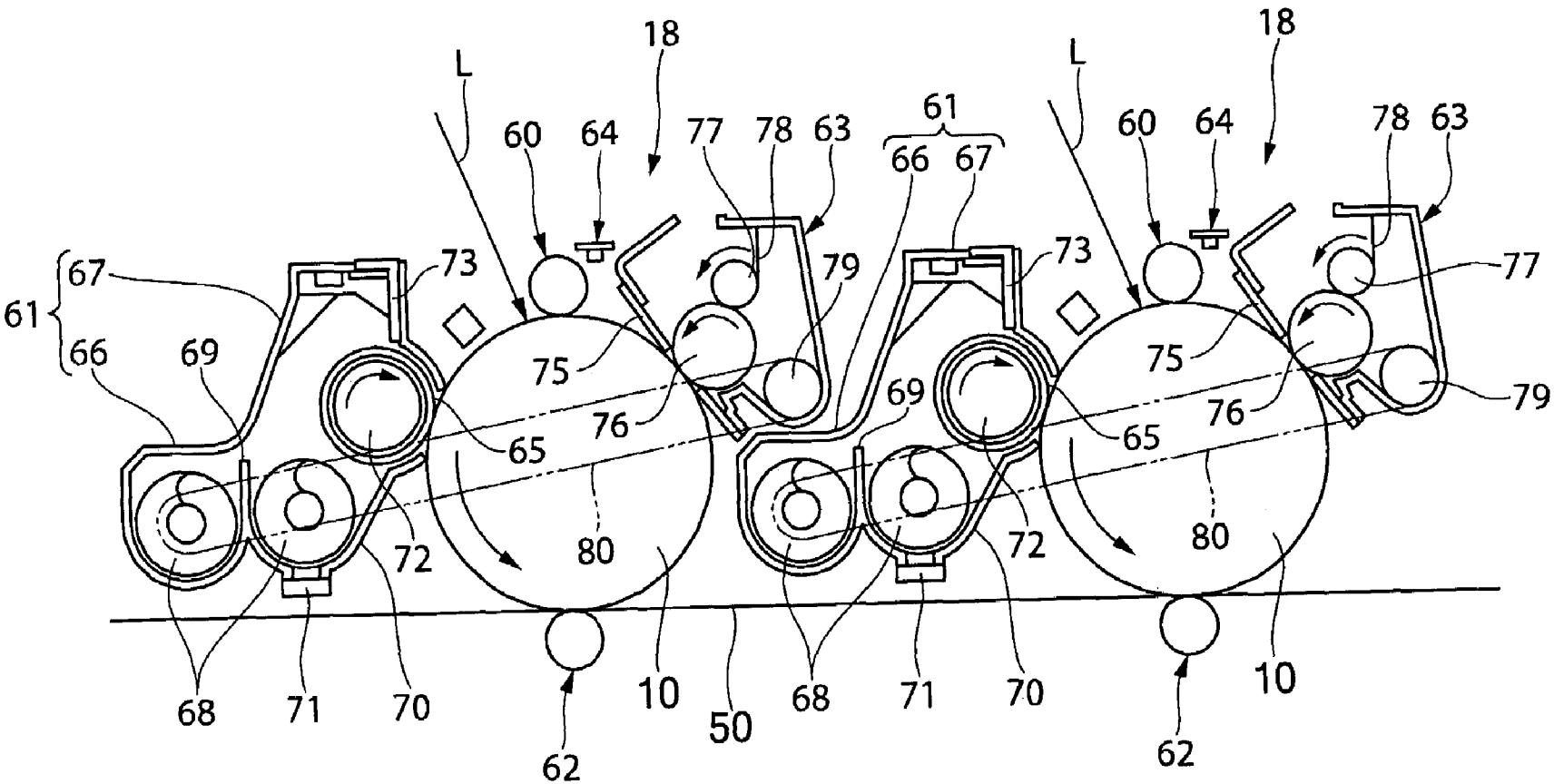
FIG. 9 is a partial enlarged schematic illustration of the image-forming apparatus of FIG. 8.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 9, there are disposed a photoconductor 10 (a photoconductor for black 10K, a photoconductor for yellow 10Y, a photoconductor for magenta 10M, or a photoconductor for cyan 10C), a charger 60 which uniformly charge the photoconductor, an exposure unit (L) which form a latent electrostatic image corresponding to each color image on the photoconductor, an developing unit 61 which develops the latent electrostatic image with the corresponding color toner (a black toner, a yellow toner, a magenta toner, or a cyan toner) to form a toner image of each color, the transfer charger 62 for transferring the toner image to the intermediate transferring member 50, the photoconductor cleaning device 63, and the charge removing unit 64. Accordingly, each monocolor images (a black image, a yellow image, a magenta image, and a cyan image) are formed based on the corresponding color-image information. The thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transfer) onto the intermediate transferring member 50 which rotate by means of support rollers 14, 15 and 16. These toner images are superimposed on the intermediate transferring member 50 to form a composite color image (color transferred image).

One of feeder rollers 142 of the feeder table 200 is selectively rotated, sheets are ejected from one of multiple feeder cassettes 144 in the paper bank 143 and are separated in the separation roller 145 one by one into the feeder path 146, are transported by the transport roller 47 into the feeder path 148 in the copying machine main body 150 and are bumped against the resist roller 49. Note that, the resist roller 49 is generally earthed, but it may be biased for removing paper dust of the sheets.

The resist roller 49 is rotated synchronously with the movement of the composite color image on the intermediate transferring member 50 to transport the sheet (recording medium) into between the intermediate transferring member 50 and the secondary transferring unit 22, and the composite color image is transferred onto the sheet by action of the secondary transferring unit 22. After transferring the toner image, the residual toner on the intermediate transferring member 50 is cleaned by means of the intermediate cleaning device 17.

The sheet bearing the transferred image is transported by the secondary transferring unit 22 into the image-fixing device 25, is applied with heat and pressure in the image-fixing device 25 to fix the composite color image (transferred image) to the sheet (recording medium). Thereafter, the sheet changes its direction by action of the switch blade 55, is ejected by the ejecting roller 56 and is stacked on the output tray 57. Alternatively, the sheet changes its direction by action of the switch blade 55 into the sheet reverser 28, turns the direction, is transported again to the transfer section, subjected to an image formation on the back surface thereof. The sheet bearing images on both sides thereof is then ejected with assistance of the ejecting roller 56, and is stacked on the output tray 57.

The image-forming apparatus and image-forming method of the present invention uses the toner of the present invention having small-sized and potato-shaped particles created from multiple coherent particles, thereby efficiently forming high quality images.

The present invention dissolves the prior art problems and provides a toner having small-sized and potato-shaped particles created from multiple coherent particles for excellent cleaning ability and high image quality, and a developer, a toner container, a process cartridge, an image-forming apparatus, and an image-forming method, all using the toner and, therefore, realizing high image quality.

Examples of the present invention are described hereafter. However, the present invention is not limited to the examples below. All percentages and parts are by mass unless indicated otherwise.

EXAMPLES

Production Example 1

-Preparation of Oil Phase-

An oil phase of Production Example 1 was prepared as follows.

--Synthesis of Unmodified Polyester (Low-Molecular Mass Polyester)--

Into a reaction vessel equipped with a cooling duct, a stirrer, and a nitrogen inlet, 229 parts by mass of bisphenol A ethylene oxide dimolar adduct, 529 parts by mass of bisphenol A propion oxide trimolar adduct, 208 parts by mass of terephthalic acid, 46 parts by mass of adipic acid, and 2 parts by mass of dibutyltin oxide were introduced, and the reaction was performed under 230° C. for eight hours. Then, the reaction was further performed under reduced pressures of 10 mmHg to 15 mmHg for 5 hours, then 44 parts by mass of anhydrous trimellitic acid was added to the reaction vessel, and the reaction was performed at 180° C. under normal pressure for 2 hours to synthesize an unmodified polyester.

The obtained unmodified polyester had a number-average molecular mass (Mn) of 2,600, a mass-average molecular mass (Mw) of 5,800, a glass transition temperature (Tg) of 45° C., and an acid number of 24.

--Preparation of Masterbatch (MB)--

The 1200 parts by mass of water, 540 parts by mass of carbon black (PB-k7: Printex 60, by Degussa, DBP oil-absorption rate=114 ml/100 g, pH=7), and 1200 parts by mass of polyester resin were mixed in Henschel mixer (by Mitsui Mining Co. Ltd.). The mixture was kneaded with two rollers at 150° C. for 30 minutes, rolled and cooled, and pulverized by a pulverizer (by Hosokawa Micron Corporation) to obtain a masterbatch.

--Synthesis of Prepolymer--

Into a reaction vessel equipped with a cooling duct, a stirrer, and a nitrogen inlet, 682 parts by mass of bisphenol A ethylene oxide dimolar adduct, 81 parts by mass of bisphenol A propion oxide dimolar adduct, 283 parts by mass of terephthalic acid, 22 parts by mass of anhydrous trimellitic acid, and 2 parts by mass of dibutyltin oxide were introduced, and the reaction was performed at 230° C. for 8 hours under the normal pressure. Then, the reaction was further performed under reduced pressure of 10 mmHg to 15 mmHg for 5 hours to synthesize an intermediate polyester.

The obtained intermediate polyester had a number-average molecular mass (Mn) of 2,100, a mass-average molecular mass (Mw) of 9,500, a glass transition temperature (Tg) of 55° C., an acid number of 0.5, and a hydroxyl value of 51.

Then, into a reaction vessel equipped with a cooling duct, a stirrer, and a nitrogen inlet, 410 parts by mass of the intermediate polyester, 89 parts by mass of isophoronediisocyanate, and 500 parts by mass of ethyl acetate were introduced, and the reaction was performed at 100° C. for 5 hours to synthesize a pre-polymer (the polymer that is reactive with the active hydrogen group-containing compound).

The obtained pre-polymer contained 1.75% by mass of free isocyanate.

--Synthesis of Ketimine (the Active Hydrogen Group-Containing Compound)--

Into a reaction vessel equipped with a stirrer and a thermometer, 170 parts by mass of isophoronedimaine and 75 parts by mass of methylethylketone were introduced, and the reaction was performed at 50° C. for 5 hours to synthesize a ketimine compound (the active hydrogen group-containing compound).

The obtained ketimine compound (the active hydrogen group-containing compound) had an amine value of 418.

Into a reaction vessel equipped with a stirrer and a thermometer, 300 parts by mass of the above unmodified polyester, 90 parts by mass of carnauba wax, 10 parts by mass of rice wax, and 1,000 parts by mass of ethyl acetate were introduced, and heated to a temperature of 79° C. while stirring to dissolve, then rapidly cooled to 4° C. This was dispersed three times using a bead mill (Ultra Visco Mill, manufactured by Aimex Co., Ltd.) under the conditions of liquid feed rate of 1 kg/hr, disk circumferential speed of 6 m/sec, 0.5 mm zirconia beads packed to 80% by volume to obtain a wax dispersion having a volume-average particle diameter of 0.6 μm. Then, 500 parts by mass of the above master batch and 640 parts by mass of 700% ethyl acetate solution of the above unmodified polyester were added to the wax dispersion, mixed for 10 hours, and dispersed 5 times using the bead mill under the same conditions as above. Then, ethyl acetate was added to obtain a raw material solution having a solid content concentration of 50% by mass (130° C., 30 minutes).

Into a reaction vessel, 73.2 parts by mass of the above raw material solution, 6.6 parts by mass of the above prepolymer, and 0.48 parts by mass of the above ketimine compound were introduced, and well mixed to preparer an oil phase.

-Viscosity of Oil Phase-

The Casson yield value and structural viscosity of the obtained oil phase were measured as follows. The results are shown in Table 1.

material solution had a solid content concentration of 70% by mass. The Casson yield value and structural viscosity of the obtained oil phase were measured in the same manner as in Production Example 1. The results are shown in Table 1.

TABLE 1

| Oil phase | Production Example 1 | Production Example 2 | Production Example 3 | Production Example 4 | Production Example 5 |
|---|---|---|---|---|---|
| Pigment | PB-k7 | PY155 | PR269 | PB15:3 | PY155 |
| Manufacturer | Degussa | Clariant | Dainippon Ink and Chemicals, Inc. | Dainichiseika Color & Chemicals Mfg. Co., Ltd. | Clariant |
| Resin | Polyester | Polyester | Polyester | Polyester | Polyester |
| Solid content concentration (% by mass) | 50 | 53 | 55 | 40 | 75 |
| Casson yield value (Pa) | 10.5 | 25.3 | 19.9 | 0.9 | 240 |
| Structural viscosity | Thixotropy | Thixotropy | Thixotropy | Thixotropy | Thixotropy |

<Measurement of Casson Yield Value>

The Casson yield value of the oil phase was measured by a Highshare viscometer (AR2000, manufactured by TA Instruments Inc.). A hysteresis curve was obtained by 40 mm parallel plates with a gap of 1.000 mm at 25° C. and the Casson yield value was calculated using the following approximation equation:

$$\sqrt{\tau}-\sqrt{\tau 0}=\sqrt{E_{ta}\times D} \quad \text{Equation 1}$$

in which $\tau$ is a shear stress, $\tau_0$ is a yield value, Eta is a plastic viscosity, and D is a shear speed.

The oil phase had a Casson yield value of 10.5 Pa.

<Measurement of Structural Viscosity>

The structural viscosity of the oil phase was measured by a Highshare viscosity (AR2000, manufactured by TA Instruments Inc.). A hysteresis curve was obtained by 40 mm parallel plates with a gap of 0.500 mm at 30° C. and at a shear speed of 0 (1/sec) to 1,800 (1/sec) over 2 minutes and, then, 1,800 (1/sec) to 0 (1/sec) over 2 minutes. The structural viscosity was derived from the hysteresis curve. The oil phase exhibited a non-Newtonian viscosity with a thixotropic structural viscosity.

Production Examples 2 to 4

-Preparation of Oil Phase-

Oil phases of Production Examples 2 to 4 were prepared in the same manner as in Production Example 1 except that the carbon black and resin in the master batch were replaced with pigments and resins shown in Table 1 and the raw material solutions had solid content concentrations shown in Table 1. The Casson yield value and same manner as in Production Example 1. The results are shown in Table 1.

Production Example 5

-Preparation of Oil Phase-

An oil phase of Production Example 5 was prepared in the same manner as in Production Example 3 except that 2,500 parts by mass of the master batch was used and the raw Example 1

-Formation of Oil Droplets-

Using the oil phase prepared in Production Example 1, oil droplets were formed to produce a toner as follows.

--Preparation of Aqueous Phase--

---Preparation of Fine Particle Dispersion---

Into a reaction vessel equipped with a stirrer and a thermometer, 683 parts by mass of water, 11 parts by mass of sodium salt of the sulfuric acid ester of methacrylic acid ethylene oxide adduct (Eleminol RS-30, manufactured by Sanyo Chemical Industries, Ltd.), 83 parts by mass of styrene, 83 parts by mass of metacrylic acid, 110 parts by mass of butyl acrylate, and 1 part by mass of ammonium persulfonate were placed and stirred at 400 rpm for 15 minutes to obtain a white emulsion. The emulsion was heated to a system temperature of 75° C., and the reaction was performed for 5 hours. Then, 30 parts by mass of 1% by mass aqueous ammonium persulfonate was added, and the reaction mixture was matured at 75° C. for 5 hours to prepare an aqueous dispersion (fine particle dispersion) of vinyl resin particles (a copolymer of styrene-metacrylic acid-butyl acrylate-sodium salt of the sulfuric acid ester of methacrylic acid ethylene oxide adduct).

The volume-average particle diameter of fine particles in the obtained fine particle dispersion measured by a laser diffraction particle diameter distribution analyzer (LA-920, manufactured by Horiba, Limited) was 105 nm. After drying part of the fine particle dispersion and isolating the resin, the glass transition temperature (Tg) of the resin was 59° C., and the mass-average molecular mass (Mw) was 150,000.

The 990 parts by mass of water, 83 parts by mass of the above file particle dispersion, 37 parts by mass of 48.8% by mass aqueous solution of sodium dodecyl diphenylether disulfonic acid (Eleminol MON-7, manufactured by Sanyo Chemical Industries, Ltd.), and 90 parts by mass of ethyl acetate were mixed and stirred together to obtain an milky solution (aqueous phase).

--Emulsification and/or Dispersion--

To 80.48 parts by mass of the oil phase obtained in Production Example 1, 120 parts by mass of the above aqueous phase was added, and mixed using a TK homomixser (manufactured by Tokushu Kika Co., Ltd.) at 13,000 rpm for one minute to prepare an emulsion slurry containing oil droplets.

<Convergence >

The obtained emulsion slurry was slowly stirred at the room temperature for one hour for convergence. After one hour, the Casson yield value and structural viscosity of the emulsion slurry (oil droplets) were measured. The results are shown in Table 2.

<Removal of Organic Solvent>

Into a reaction vessel equipped with a stirrer and a thermometer, the converged emulsion slurry was introduced to remove the organic solvent at 30° C. for one hour and the product was matured at 60° C. for 5 hours to obtain a dispersion slurry.

-Rinsing and Drying-

After filtering 100 parts by mass of the dispersion slurry under reduced pressure, 300 parts by mass of ion exchange water were added to the filtered cake, mixed in a TK homomixer at 12,000 rpm for 10 minutes and filtered. This operation was repeated three times to obtain a final filter cake.

The final filter cake was dried in a circulating air dryer at 45° C. for 48 hours and then sieved through a sieve of 75 μm mesh to obtain toner based particles of Example 1.

-External Additives-

To 100 parts by mass of the obtained toner base particles of Example 1, 0.7 parts by mass of hydrophobic silica and 0.3 part by mass of hydrophobic titanium oxide as external additives were mixed in the Henschel mixer (manufactured by Mitsui Mining Co., Ltd.) to produce a toner of Example 1.

The obtained toner was observed with a scanning electronic microscope (SEM) FE-SEM (S-4200, by Hitachi, Ltd.). The SEM photograph is shown in FIG. 1A. The SEM photograph shows that the toner of Example 1 had potato-shaped particles having a diameter R (μm) of a spherical particle and a length L (μm) along the depth of the coherent part satisfying $0.1\ R \leqq L < 1.0\ R$.

The volume-average particle diameter (Dv), number-average particle diameter (Dn), particle diameter distribution (the ratio of the volume-average particle diameter (Dv) to the number-average particle diameter (Dn)), and average circularity of the obtained toner were measured as follows.

<Toner Particle Diameter>

The volume-average particle diameter (Dv) and number-average particle diameter (Dn) of the toner were measured by a particle sizing device ("Multisizer II", by Beckman Coulter Inc.) for an aperture size of 100 μm. Based on the results, the particle diameter distribution (the ratio of the volume-average particle diameter (Dv) to the number-average particle diameter (Dn)) was calculated. The toner had a volume-average particle diameter (Dv) of 5.5 μm, a number-average particle diameter (Dn) of 4.9 μm, and a particle diameter distribution (Dv)/(Dn) of 1.12.

<Average Circularity>

The average circularity of the toner was measured using a flow-type particle image analyzer (FPIA, manufactured by Toa Electronic Co., Ltd.). Specifically, 0.1 ml to 0.5 ml of a surfactant (alkylbenzene suphonate) as a dispersant was added to 100 ml to 150 ml of water from which impurities were previously removed and, then, 0.1 g to 0.5 g of the toner was dispersed therein. The obtained dispersion was treated by an ultrasonic disperser (by Honda Electronics Co., Ltd.) for 1 to 3 minutes to a dispersion concentration of 3,000 particles/μl to 10,000 particles/μl. Then, the shape and particle diameter distribution of the toner particles were measured. The average circularity was calculated based on the measurements. The toner had an average circularity of 0.978.

Examples 2 to 5

Toner base particles each of Example 2 to 5 were prepared in the same manner as in Example 1 except that the oil phases of Production Examples 2 to 5 were used, respectively, instead of the oil phase of Production Example 1. Then, the external additives were added in the respective toner base particles to obtain toners of Examples 2 to 5.

The SEM photographs of the toners of Examples 2 to 5 showed that the toners of Examples 2 to 5 had potato-shaped particles having a diameter R (μm) of a spherical particle and a length L (μm) along the depth of the coherent part satisfying $0.1\ R \leqq L < 1.0\ R$.

Example 6

-Formation of Oil Droplets-

The oil and aqueous phases were prepared as follows to form oil droplets and produce a toner.

-Preparation of Oil Phase-

---Preparation of Masterbatch (MB)---

The 1,200 parts by mass of water, 540 parts by mass of a pigment (PY155, by Clariant), and 1,200 parts by mass of polyester resin were mixed in Henschel mixer (manufactured by Mitsui Mining Co. Ltd.). The mixture was kneaded with two rollers at 150° C. for 30 minutes, rolled and cooled, and pulverized by a pulverizer (by Hosokawa Micron Corporation) to obtain a masterbatch.

Into a reaction vessel equipped with a stirrer and a thermometer, 90 parts by mass of carnauba wax, 10 parts by mass of rice wax, and 300 parts by mass of toluene were introduced, heated to a temperature of 80° C. while stirring to dissolve, and rapidly cooled to 4° C. This was dispersed five times using a bead mill (Ultra Visco Mill, manufactured by Aimex Co., Ltd.) under the conditions of liquid feed rate of 1 kg/hr, a disk circumferential speed of 6 m/sec, 0.5 mm zirconia beads packed to 80% by volume to obtain a wax dispersion having a volume-average particle diameter of 0.6 μm. Then, 600 parts by mass of the above master batch was added to the wax dispersion, stirred for 10 hours, and dispersed five times using the bead mill under the same conditions as above. Then, 100 parts by mass of the wax dispersion was introduced in another reaction vessel equipped with a stirrer and a thermometer. Then, 70 parts by mass of styrene, 5 parts by mass of metacrylic acid, 25 parts by mass of n-butylacrylate, and 5 parts by mass of dialykylsalicylic acid metal compound (the aforementioned charge controlling agent) were added and uniformly dissolved and/or dispersed in a TK homomixer (manufactured by Tokushu Kika Co., Ltd.) at 10.000 rpm. Then, 5 parts by mass of 2,2'-azobis(2,4-dimethylvarelonitrile) was dissolved therein to prepare an oil phase of a polymerizable monomer composition.

-Viscosity of Oil Phase-

The Casson yield value and structural viscosity of the obtained oil phase were measured. The oil phase had a Casson yield value of 1.0 Pa and a thixotropic structural viscosity.

-Preparation of Aqueous Phase-

The 350 parts by mass of ion exchange water and 230 parts by mass of 0.1 M $Na_3PO_4$ aqueous solution were heated to 60° C. and stirred using the TK monomixer at 12,000 rpm. The 34 parts by mass of 1.0 M $CaCl_2$ aqueous solution was gradually added to prepare an aqueous phase of an aqueous dispersion containing $Ca_3(PO_4)_2$.

The above oil phase was introduced into the obtained aqueous phase and stirred under nitrogen atmosphere in the TK homomixer at 60° C., 11,000 rpm for 3 minutes to granulate a polymerizable monomer composition (the above oil droplets).

<Convergence >

The obtained polymerizable monomer composition was slowly stirred using a paddle stirring blade for 1 hour for convergence. After one hour, the Casson yield value and structural viscosity of the polymerizable monomer composition (the oil droplets) were measured. The results are shown in Table 3.

The converged polymerizable monomer composition was heated to 80° C. and the reaction was performed for 10 hours, distilled under reduced pressure to remove remaining monomers, cooled, and, after hydrochloric acid was added to dissolve calcium phosphate, filtered, rinsed with water, and dried to obtain yellow toner base particles.

-External Additives-

External additives were added in the obtained toner base particles of Example 6 in the same manner as in Example 1 to produce the toner of Example 6.

The volume average particle diameter (Dv), number-average particle diameter (Dn), particle diameter distribution (the ratio of the volume average particle diameter (Dv) to the number-average particle diameter (Dn)), and average circulatory of the obtained toner were measured in the same manner as in Example 1. The results are shown in Table 3.

The SEM photograph of the toner of Example 6 showed that the toner of Example 6 had potato-shaped particles having a diameter R (μm) of a spherical particle and a length L (μm) along the depth of the coherent part satisfying 0.1 R≦L<1.0 R.

Comparative Example 1

The toner base particles were prepared in the same manner as in Example 5 except that the a solid content concentration of the oil phase obtained in Production Example 5 was changed to 50% by mass. Then the external additives were added in the toner base particles to lo obtain a toner of Comparative Example 1. The physical properties of the toner were measured in the same manner as in Example 1. The results are shown in Table 3.

Figure 10:
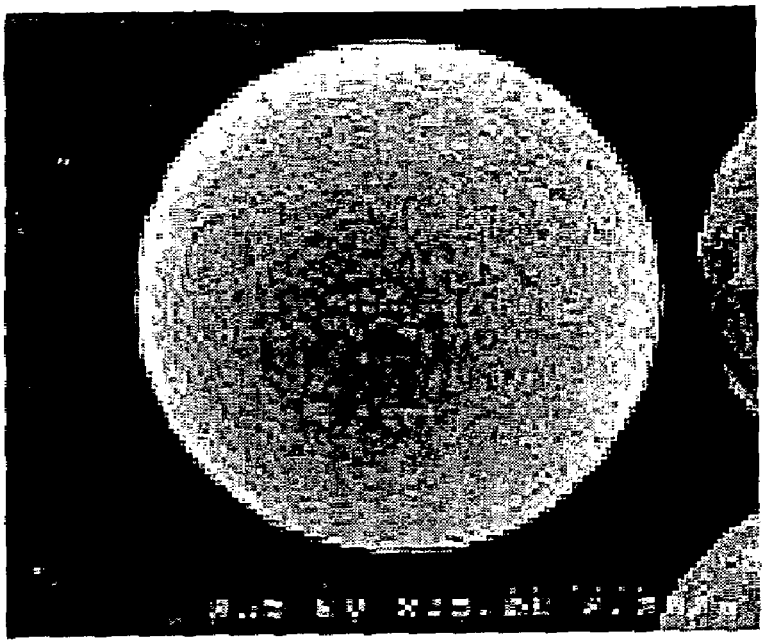
FIG. 10 is a SEM photograph of the toner produced in Comparative Example 1.

The obtained toner was observed using a scanning electronic microscope (SEM) FE-SEM (S-4200, by Hitachi, Ltd.). The SEM photograph is shown in FIG. 10. The SEM photograph shows that the toner of Comparative Example 1 had a spherical shape.

Comparative Example 2

The toner of Comparative Example was prepared in the same manner as in Example 1 disclosed in JP-A No. 2001-66820.

The obtained toner was observed using a scanning electronic microscope (SEM) FE-SEM (S-4200, by Hitachi, Ltd.). The SEM photograph showed that the toner of Comparative Example 1 had a spherical shape.

TABLE 2

| | Example 1 | Example 2 | Example 3 | Example 4 |
|---|---|---|---|---|
| Oil Phase No. | Production Example 1 | Production Example 2 | Production Example 3 | Production Example 4 |
| Casson yield value of oil phase (Pa) | 10.5 | 25.3 | 19.9 | 0.9 |
| Structural viscosity of oil phase | Thixotropy | Thixotropy | Thixotropy | Thixotropy |
| Solid content concentration (% by mass) | 50 | 53 | 55 | 40 |
| Casson yield value of oil phase in convergence(Pa) | 21 | 110 | 85 | 20 |
| Structural viscosity of oil phase in convergence | Thixotropy | Thixotropy | Thixotropy | Thixotropy |
| Average circularity | 0.978 | 0.965 | 0.973 | 0.974 |
| Volume average particle diameter Dv(μm) | 5.5 | 6.1 | 5.8 | 5.4 |
| Number average particle diameter Dn(μm) | 4.9 | 5.2 | 5.0 | 4.9 |
| Particle diameter distribution (Dv/Dn) | 1.12 | 1.17 | 1.16 | 1.10 |

TABLE 3

| | Example 5 | Example 6 | Comparative Example 1 |
|---|---|---|---|
| Oil Phase No. | Production Example 5 | — | Production Example 5 |
| Casson yield value of oil phase (Pa) | 240 | 1.0 | 0.11 |
| Structural viscosity of oil phase | Thixotropy | Thixotropy | Newtonian |
| solid content concentration (% by mass) | 75 | — | 50 |
| Casson yield value of oil phase in convergence(Pa) | 6500 | 2.311 | 0.12 |
| Structural viscosity of oil phase in convergence | Thixotropy | Thixotropy | Newtonian |
| Average circularity | 0.938 | 0.971 | 0.988 |
| Volume average particle diameter Dv(μm) | 7.8 | 7.5 | 5.3 |
| Number average particle diameter Dn(μm) | 6.4 | 6.0 | 4.7 |
| Particle diameter distribution (Dv/Dn) | 1.22 | 1.25 | 1.13 |

Developers of Examples 1 to 6 and Comparative Examples 1 and 2 were produced using 5% by mass of each of the toners produced in Examples 1 to 6 and Comparative Examples 1 and 2, which were added with external additives, and 95% by mass of a copper-zinc ferrite carrier having an average particle diameter of 40 μm, which were coated with a silicone resin in the usual manner.

Using the obtained toners, (a) cleaning ability, (b) fixing property, (c) image density, and (d) cracking resistance were evaluated as follows. The results are shown in Table 4.

(a) Cleaning Ability

Residual toner on the photoconductor after the cleaning step was transferred to a white sheet using a scotch tape (manufactured by Sumitomo 3M Ltd.) and measured by a Macbeth reflection densitometer (RD514 model) for evaluating cleaning ability according to the following criteria.

[Criteria]

A (good): difference from the blank is 0.01 or smaller.

B (no good): difference from the blank is larger than 0.1.

(b) Fixing Property (Offset-Occurring Temperature and the Lowest Fixing Temperature)

Fixing property (offset-occurring temperature and the lowest fixing temperature) was evaluated using a tandem type color image-forming apparatus (imagioNeo 450, manufactured by Ricoh Company, Ltd.), regular papers (TYPE 6200, manufactured by Ricoh Company, Ltd.), and thick transfer sheets (copy sheets <135>, manufactured by NBS Ricoh Co., Ltd.). The tandem type color image-forming apparatus had an ability of continuously printing 45 sheets of A4 size per minute.

<Offset-Occurring Temperature>

The tandom type color image-forming apparatus was adjusted for forming images in single solid colors, yellow, magenta, cyan, and black, and images in intermediate solid colors, red, blue, and green, on regular papers by 1.0±0.1 mg/cm$^2$ of toner. The obtained images were fixed by a fixing belt (a heating roller) at different temperatures and the lowest fixing temperature at which the offset occurs (the offset-occurring temperature) was determined.

<Lowest Fixing Temperature>

Image copy test was performed using the tandem type color image-forming apparatus and the thick sheets. The lowest fixing temperature was defined as a temperature of the fixing roller at which the image density was retained 70% or more after the obtained fixed image was scraped with a pat.

(c) Image Density

Solid images were formed by 1.00±0.1 mg/cm$^2$ of each developer on transfer sheets (TYPE 6200, manufactured by Ricoh Company, Ltd.) using a tandem type color image-forming apparatus (imagioNeo 450, manufactured by Ricoh Company, Ltd.) with the fixing roller at 160±2° C. The image density of the obtained solid images was measured at any five points using a spectrometer (938 Spectrodensitometer, manufactured by X-Rite K.K.). The five image densities were averaged to obtain an image density score. The higher the image density score was, the higher the image densities were, indicating that a high density image was formed. When an image has an image density of 1.4 or higher, the image is assumed to be at a practical level.

(d) Cracking Resistance 50 g of each developer was introduced in a 100 ml jar (manufactured by Nichiden-Rika Glass Co., Ltd.), stirred using a paint conditioner at 50 Hz for 30 minutes, subjected to electric field separation to separate the toner, and observed in scanning electronic microscopy (SEM). In the SEM observation, the ratio of cracked or disintegrated toner particles to 1000 toner particles (% by number) was determined to evaluate the toner for cracking resistance. Larger numbers indicate deteriorated cracking resistance.

TABLE 4

| | Cleaning ability | | | Fixing property | | Image density | |
|---|---|---|---|---|---|---|---|
| | Beginning | After 10,000 sheet | After 100,000 sheet | Lowest fixing temperature (° C.) | Offset-occurring temperature (° C.) | After 100,000 sheet | Cracking resistance |
| Example 1 | A | A | A | 140 | 220 or more | 1.51 | 0% |
| Example 2 | A | A | A | 140 | 220 or more | 1.48 | 0% |
| Example 3 | A | A | A | 145 | 220 or more | 1.46 | 0% |
| Example 4 | A | A | A | 140 | 220 or more | 1.50 | 0% |
| Example 5 | A | A | A | 140 | 220 or more | 1.53 | 0% |
| Example 6 | A | A | A | 140 | 220 or more | 1.49 | 0% |
| Comparative Example 1 | B | B | B | 140 | 220 or more | 1.35 | 0% |
| Comparative Example 2 | B | B | B | 165 | 200 | 1.28 | 19% |

Tables 2 to 4 show the following. The toners of Examples 1 to 6 had small-sized and irregularly shaped particles. Those toners had excellent cleaning abilities, low temperature fixing properties, and image densities, yielding high image quality.

On the other hand, the toner particles of Comparative Examples 1 and 2 had a spherical shape and low cleaning ability. The toner of Comparative Example 2 had deteriorated cracking resistance.

Synthesis Example 1

-Synthesis of a Crystalline Polyester (1)-

Into 5-litter four-necked flask equipped with a nitrogen inlet, a drain duct, a stirrer, and a thermocouple, 2,070 g of 1,4-butanediol, 2,535 g of fumaric acid, 291 g of anhydrous trimellitic acid, and 4.9 g of hydroquinone were introduced and the reaction was performed at 160° C. for 5 hours. Then, the reaction product was heated to 200° C. and the reaction was performed for 1 hour. Further, the reaction product was performed for 1 hour at 8.3 kPa to synthesize a Crystalline Polyester (1).

The Crystalline Polyester (1) had a endothermic peak temperature of DSC of 123° C. The o-dichlorobenzene soluble components had a mass-average molecular mass (Mw) of 2,100, a number average molecular mass (Mn) of 710, and a ratio Mw/Mn of 2.96 as determined by means of GPC. The infrared spectrograph of the crystalline polyester had an absorption band based on δCH (out-of-plane deformation vibration) of olefin at 970 $cm^{-1}$.

Synthesis Examples 2 to 7

-Synthesis of Crystalline Polyester (2) to (7)-

Crystalline Polyester (2) to (7) of Synthesis Examples 2 to 7 were synthesized in the same manner as in Synthesis Example 1 except that the types and amount of alcohol and acid components were changed as shown in Table 4. The properties of the obtained crystalline polyester are shown in Table 5.

TABLE 5

| Crystalline polyester | Tm (° C.) | DSC endothermic peak temperature (° C.) | Mw | Mn | Mw/Mn | δCH ($cm^{-1}$) |
|---|---|---|---|---|---|---|
| Synthesis Example 1 | — | 123 | 2,100 | 710 | 2.96 | 970 |
| Synthesis Example 2 | 128 | 130 | 3,500 | 900 | 3.89 | 970 |
| Synthesis Example 3 | 139 | 140 | 2,800 | 800 | 3.50 | 968 |
| Synthesis Example 4 | 113 | 119 | 3,300 | 700 | 4.71 | 970 |
| Synthesis Example 5 | 94 | 100 | 1,500 | 800 | 1.88 | 970 |
| Synthesis Example 6 | 91 | 99 | 11,900 | 2,400 | 4.96 | 999 |
| Synthesis Example 7 | 55 | 53 | 9,735 | 3,425 | 2.84 | 961 |

Preparation Example 1

-Preparation of Crystalline Polyester Dispersion (1)-

Into a 2-L metal container, 100 g of the Crystalline Polyester (5) synthesized in Synthesis Example 5 and 400 g of ethyl acetate were introduced, heated and dissolved at 79° C., and cooled in an ice water bath. 500 ml of glass beads (3 mm in diameter) was added and pulverized using a batch type sandmill apparatus (by Kanpe Hapio Co., Ltd.) for 10 hours. Then, the ethyl acetate was partly distilled away to obtain a Crystalline Polyester Dispersion (1) having a volume-average particle diameter of 0.4 μm and a solid content concentration of 50% by mass.

Preparation Examples 2 to 6

-Synthesis of Crystalline Polyester Dispersions (2) to (6)-

Crystalline Polyester Dispersions (2) to (6) of Preparation Examples 2 to 6 were prepared in the same manner as in Preparation Example 1 except that the dispersion conditions were changed as shown in Table 6.

TABLE 6

| Crystalline polyester dispersion No. | Crystalline polyester No. | Organic solvent | Melting temperature (° C.) | Pulverizing time (hr) | Volume average particle diameter (μm) |
|---|---|---|---|---|---|
| (1): Preparation Example 1 | (5): Synthesis Example 5 | ethyl acetate | 79 | 10 | 0.4 |
| (2): Preparation Example 2 | (2): Synthesis Example 2 | methylethylketone | 80 | 30 | 0.7 |
| (3): Preparation Example 3 | (3): Synthesis Example 3 | toluene | 110 | 60 | 0.9 |
| (4): Preparation Example 4 | (4): Synthesis Example 4 | ethyl acetate | 79 | 45 | 0.6 |
| (5): Preparation Example 5 | (6): Synthesis Example 6 | ethyl acetate | 79 | 18 | 0.4 |
| (6): Preparation Example 6 | (7): Synthesis Example 7 | ethyl acetate | 79 | 8 | 0.3 |

Preparation Example 6

-Preparation of Oil Phase-

--Synthesis of Unmodified Polyester (Low-Molecular Mass Polyester)--

Into a reaction vessel equipped with a cooling duct, a stirrer, and a nitrogen inlet, 229 parts by mass of bisphenol A ethylene oxide dimolar adduct, 529 parts by mass of bisphenol A propion oxide trimolar adduct, 208 parts by mass of terephthalic acid, 46 parts by mass of adipic acid, and 2 parts by mass of dibutyltin oxide were introduced and the reaction was performed under normal pressure and nitrogen flow at 230° C. for 8 hours for condensation. Further, the reaction was performed under reduced pressure of 10 mmHg to 15 mmHg for 5 hours. Then, 44 parts by mass of anhydrous trimellitic acid was added and the reaction was performed under normal pressure at 180° C. for 2 hours to synthesize an unmodified polyester.

The obtained unmodified polyester had a number-average molecular mass (Mn) of 2,500, a mass-average molecular mass (Mw) of 6,700, a glass transition temperature (Tg) of 43° C., and an acid number of 25.

--Preparation of Masterbatch (MB)--

The 540 parts by mass of carbon black (PBk-7: Printex 60, manufactured by Degussa) as a colorant (DBP oil-absorption rate 114 ml/100 g, pH 10), 1,200 parts by mass of polyester resin (RS801, manufactured by Sanyo Kasei Co., Ltd., the acid number=10, mass-average molecular mass (Mw)=20,000, glass transition temperature (Tg)=64° C.), and 1,200 parts by mass of water were mixed in Henschel mixer (manufactured by Mitsui Mining Co. Ltd.). The mixture was kneaded with two rollers at 150° C. for 30 minutes, rolled and cooled, pulverized by a pulverizer (manufactured by Hosokawa Micron Corporation) to a diameter of 1 mm, whereby obtaining a master batch.

Into a reaction vessel equipped with a stirrer and a thermometer, 378 parts by mass of the above unmodified polyester, 92 parts by mass of carnauba wax, 22 parts by mass of CCA (salicylic acid metal chelate E-84, manufactured by Orient Chemical Industries Ltd.), and 947 parts by mass of ethyl acetate were introduced, heated to 80° C. while stirring, and allowed to stand at 80° C. for five hours, and cooled to 30° C. over 1 hour. Then, 500 parts by mass of the master batch and 500 parts by mass of ethyl acetate were introduced in a reaction vessel and stirred for 1 hour to obtain a raw material solution.

The 1324 parts by mass of the obtained raw material solution was transferred to a reaction vessel and dispersed three times using a bead mill (Ultra Visco Mill, manufactured by Aimex Co., Ltd.) under the conditions of liquid feed rate of 1 kg/hr, disk circumferential speed of 6 m/sec, 0.5 mm zirconia beads packed to 80% by volume to disperse the carbon black and carnauba wax. Then, 1042.3 parts by mass of 65% ethyl acetate solution of the unmodified polyester was added to the dispersion and dispersed once using the bead mill under the same conditions as above to prepare an oil phase. The obtained oil phase had a solid content concentration of 50% by mass (130° C., 30 minutes).

Production Example 7

-Preparation of Oil Phase-

An oil phase of Production Example 7 was prepared in the same manner as in Production Example 6 except that 200 parts by mass of the Crystalline Polyester Dispersion (1) was added together with 1042.3 parts by mass of 65% ethyl acetate solution of the unmodified polyester resin and was partly evaporated.

Production Examples 8 to 12

Preparation of Oil Phase

Oil phases of Production Examples 8 to 12 were prepared in the same manner as in Production Example 7 except that the Crystalline Polyester Dispersion (1) was replaced with the Crystalline Polyester Dispersions (2) to (6), respectively, and the solid content concentrations were adjusted as shown in Table 7.

TABLE 7

| Oil phase (Oil droplets) | Crystalline polyester dispersion No. | Solid content concentration (% by mass) |
|---|---|---|
| Production Example 6 | — | 50 |
| Production Example 7 | (1): Preparation Example 1 | 79 |
| Production Example 8 | (2): Preparation Example 2 | 79 |
| Production Example 9 | (3): Preparation Example 3 | 55 |
| Production Example 10 | (4): Preparation Example 4 | 63 |
| Production Example 11 | (5): Preparation Example 5 | 70 |
| Production Example 12 | (6): Preparation Example 6 | 37 |

Example 7

-Production of Toner-

Using the oil phase obtained in Production Example 6, a toner was produced as follows.

-Preparation of Fine Particle Dispersion-

Into a reaction vessel equipped with a stirrer and a thermometer, 683 parts by mass of water, 11 parts by mass of sodium salt of the sulfuric acid ester of methacrylic acid ethylene oxide adduct (Eleminol RS-30, manufactured by Sanyo Chemical Industries, Ltd.), 83 parts by mass of styrene, 83 parts by mass of metacrylic acid, 110 parts by mass of butyl acrylate, and 1 part by mass of ammonium persulfate were placed and stirred at 400 rpm for 15 minutes to obtain a white emulsion. The emulsion was heated to a system temperature of 75° C. and the reaction was performed for 5 hours. Then, 30 parts by mass of 1% by mass aqueous ammonium persulfate was added and allowed to mature at 75° C. for 5 hours to prepare an aqueous dispersion (fine particle dispersion) of vinyl resin particles (a copolymer of styrene-metacrylic acid-butyl acrylate-sodium salt of the sulfuric acid ester of methacrylic acid ethylene oxide adduct).

The volume-average particle diameter of fine particles in the obtained fine particle dispersion measured by a laser diffraction particle diameter distribution analyzer (LA-920, manufactured by Horiba, Limited) was 105 nm. After drying part of the fine particle dispersion and isolating the resin, the glass transition temperature (Tg) of the resin was 59° C., and the mass-average molecular mass (Mw) was 150,000.

-Preparation of Aqueous Phase (Aqueous Medium)-

The 990 parts by mass of water, 83 parts by mass of the above fine particle dispersion, 37 parts by mass of 48.5% by mass aqueous solution of sodium dodecyldiphenyl ether disulfonate (Eleminol MON-7, manufactured by Sanyo Kasei Co., Ltd.), and 90 parts by mass of ethyl acetate were mixed and stirred to obtain an opaque white solution (aqueous phase).

--Synthesis of Prepolymer--

Into a reaction vessel equipped with a cooling duct, a stirrer, and a nitrogen inlet, 682 parts by mass of bisphenol A ethylene oxide dimolar adduct, 81 parts by mass of bisphenol A propion oxide dimolar adduct, 283 parts by mass of terephthalic acid, 22 parts by mass of anhydrous trimellitic acid, and 2 parts by mass of dibutyltin oxide were introduced and the reaction was performed under normal pressure at 230° C. for 8 hours. Then, the reaction solution was allowed to react under reduced pressure of 10 mmHg to 15 mmHg for 5 hours to synthesize an intermediate polyester.

The obtained intermediate polyester had a number-average molecular mass (Mn) of 2,100, a mass-average molecular mass (Mw) of 9,500, a glass transition temperature (Tg) of 55° C., an acid number of 0.5, and a hydroxyl value of 51.

Then, in a reaction vessel equipped with a cooling duct, a stirrer, and a nitrogen inlet, 410 parts by mass of the above intermediate polyester, 89 parts by mass of isophoronediisocyanate, and 500 parts by mass of ethyl acetate were introduced and the reaction was performed at 100° C. for 5 hours to synthesize a prepolymer (the polymer that is reactive with the active hydrogen group-containing compound).

The obtained prepolymer contained 1.53% by mass of free isocyanate.

--Synthesis of Ketimine (the Active Hydrogen Group Containing Compound)--

Into a reaction vessel equipped with a stirrer and a thermometer, 170 parts by mass of isophoronedimaine and 75 parts by mass of methylethylketone were introduced and the reaction was performed at 50° C. for 5 hours to synthesize a ketimine compound (the active hydrogen group-containing compound).

The obtained ketimine compound (the active hydrogen group-containing compound) had an amine value of 418.

--Emulsification/Dispersing (Formation of Oil Droplets)--

Into a reaction vessel, 664 parts by mass of the above oil phase, 109.4 parts by mass of the above prepolymer, and 4.6 parts by mass of the above ketimine compound were introduced and mixed in a TK homomixser (manufactured by Tokushu Kika Co., Ltd.) at 5,000. rpm for 1 minute to prepare an emulsion oil phase (the oil droplets). The 1,200 parts by mass of the above aqueous phase was added to the emulsion oil phase and mixed in the TK homomixser at a stirring blade peripheral velocity of 8.4 m/sec for 20 minutes to prepare an emulsion slurry.

Then, the emulsion slurry was introduced in a reaction vessel equipped with a stirrer and a thermometer to remove the solvent at 30 ° C. for 1 hour and allowed to mature at 45° C. for 4 hour to obtain a dispersion slurry.

The emulsion oil phase had a solid content concentration of 50% by mass. The viscosity of the emulsion oil phase was measured as follows. The results are shown in Table 8.

<Measurement of Viscosity>

The viscosity of the emulsion oil phase was measured using a rotation viscometer manufactured by Brookfield (DV-E VISCOMETER: HADVE 115 model) at 25° C. and 5 rpm. The viscosity of the same emulsion oil phase was also measured at 50 rpm and the viscosity ratio was determined using the following equation. As a result, the viscosity of the emulsion oil phase was 3.5 Pa·s and the viscosity ratio was 3.2.

<Viscosity Ratio Equation>

$$\text{Viscosity Ratio}=\text{Viscosity (5 rpm)}/\text{Viscosity (50 rpm)}$$

-Rinsing and Drying-

After filtering 100 parts by mass of the dispersion slurry under reduced pressure, 100 parts by mass of ion exchange water were added to the filtered cake, mixed and filtered. The 100 parts by mass of 10% by mass aqueous solution of sodium hydroxide was added to the filtered cake, mixed and filtered. The 100 parts by mass of 10% by mass aqueous solution of hydrochloric acid was added to the filtered cake, mixed and filtered. Further, 300 parts by mass of ion-exchanged water was added to the filtered cake; mixed and filtered and this operation was repeated two times to obtain a final filter cake.

Figure 11A:
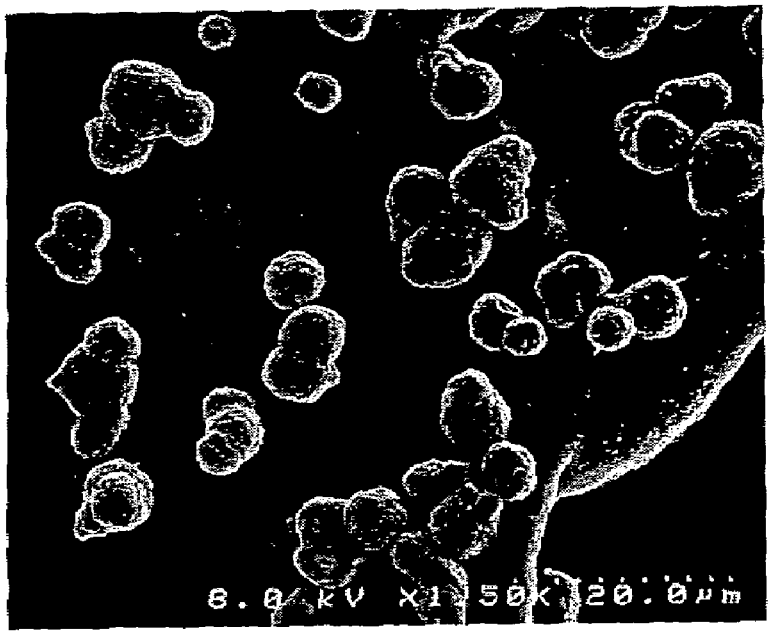
FIG. 11A is a SEM photograph of the toner produced in Example 7 (magnification: 1500×).
Figure 11B:
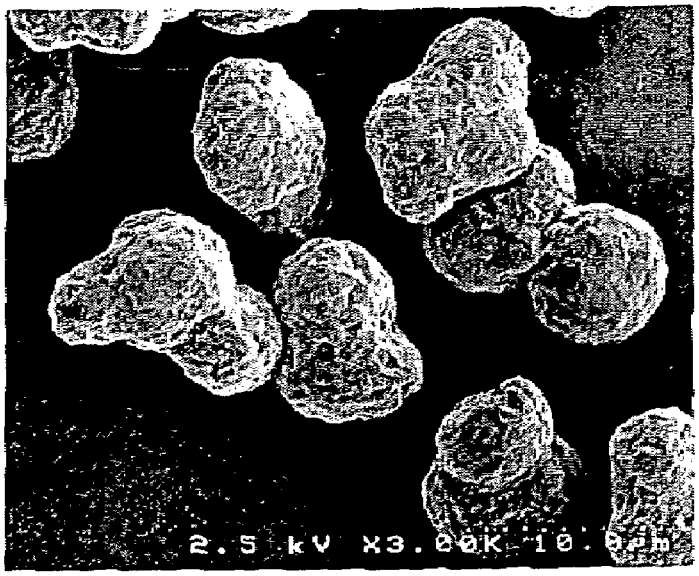
FIG. 11B is a SEM photograph of the toner produced in Example 7 (magnification: 3000×).

Then, the obtained final filter cake was dried in circulating air dryer at 45° C. for 48 hours and then sieved through a sieve of 75 μm mesh to obtain a toner of Example 7. The toner was observed by a scanning electronic microscope (SEM) FE-SEM (S-4200, manufactured by Hitachi, Ltd.). The SEM photographs are shown in FIGS. 11A and 11B. The SEM photographs show that the obtained toner had potato-shaped particles having a diameter R (μm) of a spherical particle and a length L (μm) along the depth of the coherent part satisfying $0.1\ R \leqq L < 1.0\ R$.

The SEM photographs in FIGS. 11A and 11B are at magnifications of 1,500× and 3,000×, respectively.

The volume-average particle diameter (Dv), number-average particle diameter (Dn), (Dv)/(Dn), and average circularity of the toner were measured in the same manner as in Example 1. The results are shown in Table 8.

Examples 8 to 13

-Production of Toner-

Toners of Examples 8 to 13 were produced in the same manner as in Example 7 except that the oil phase of Production Example 6 was replaced with the oil phases of Production Examples 7 to 12, respectively, and the viscosity and solid content concentration of the emulsion oil phases (oil droplets) and the stirring blade peripheral velocity were changed as shown in Table 8. The volume-average particle diameter (Dv), number-average particle diameter (Dn), (Dv)/(Dn), and average circularity of the obtained toners were measured. The results are shown in Table 8.

The SEM photographs of the toners obtained in Examples 8 to 13 showed that the toners of Examples 8 to 13 had potato-shaped particles having a diameter R (μm) of a spherical particle and a length L (μm) along the depth of the coherent part satisfying $0.1\ R \leqq L < 1.0\ R$.

Comparative Example 3

-Production of Toner-

A toner was produced in the same manner as in Example 7 except that ethyl acetate was added to the emulsion oil phase (oil droplets) to a solid content concentration of 25% by mass and the dispersion was conducted at a peripheral velocity of 4.8 m/sec when the emulsion oil phase had a viscosity of 0.5 Pa·s. The volume-average particle diameter (Dv), number-average particle diameter (Dn), (Dv)/(Dn), and average circularity of the obtained toner were measured. The results are shown in Table 8.

Observation of a SEM photograph of the toner obtained in Comparative Example 3 revealed that the toner of Comparative Example 3 had spherical particles.

TABLE 8

| | Emulsion oil phase viscosity (Pa · s) | Viscosity ratio | Solid content concentration of the emulsion oil phases (% by mass) | Peripheral velocity (m/s) | Average circularity | Volume average particle diameter Dv(μm) | Dv/Dn |
|---|---|---|---|---|---|---|---|
| Example 7 | 3.5 | 3.2 | 50 | 18.4 | 0.965 | 7.5 | 1.11 |
| Example 8 | 17.5 | 17.8 | 78 | 28.7 | 0.911 | 7.8 | 1.23 |
| Example 9 | 21.5 | 8.9 | 77 | 11.1 | 0.975 | 5.3 | 1.09 |
| Example 10 | 6.5 | 8.9 | 53 | 7.1 | 0.960 | 3.9 | 1.14 |
| Example 11 | 9.8 | 9.2 | 61 | 20.9 | 0.945 | 6.5 | 1.19 |
| Example 12 | 12.8 | 13.5 | 68 | 14.2 | 0.923 | 6.8 | 1.24 |
| Example 13 | 1.1 | 1.1 | 35 | 5.5 | 0.965 | 4.8 | 1.15 |
| Comparative Example 3 | 0.5 | — | 25 | 4.8 | 0.985 | 6.5 | 1.26 |

The 0.7 parts by mass of hydrophobic silica and 0.3 part by mass of hydrophobic titanium oxide as external additives were added to 100 parts by mass of each of the toners obtained in Examples 7 to 13 and Comparative Example 3 (toner base particles) were mixed in Henschel mixer (manufactured by Mitsui Mining Co., Ltd.) to produce a toner, which was added with external additives. The physical properties of the obtained toners are shown in Tables 9 to 11.

-Preparation of Developer-

Developers of Examples 7 to 13 and Comparative Example 3 were produced using 5% by mass of each of the toners prepared in Examples 7 to 13 and Comparative Examples 3, which were added with external additives, and 95% by mass of a copper-zinc ferrite carrier having an average particle diameter of 40 μm, which were coated with a silicone resin in the usual manner.

Using the obtained toners, (a) charging rate, (b) toner thermal characteristic, (c) fixing property (offset-occurring temperature and the lowest fixing temperature), (d) image density, (e) background smear, (f) cleaning ability, (g) filming, (h) heat resistance preservation, and (i) cracking resistance were measured as follows. The results are shown in Tables 9 to 11.

(a) Charging Rate

The 6 g of each developer was measured and introduced in a sealable metal cylinder and subject to blow to obtain a charging rate. The toner density was adjusted for 4.5% by mass to 5.5% by mass.

(b) Toner Thermal Property (Flow Tester Characteristic)

Figure 12A:
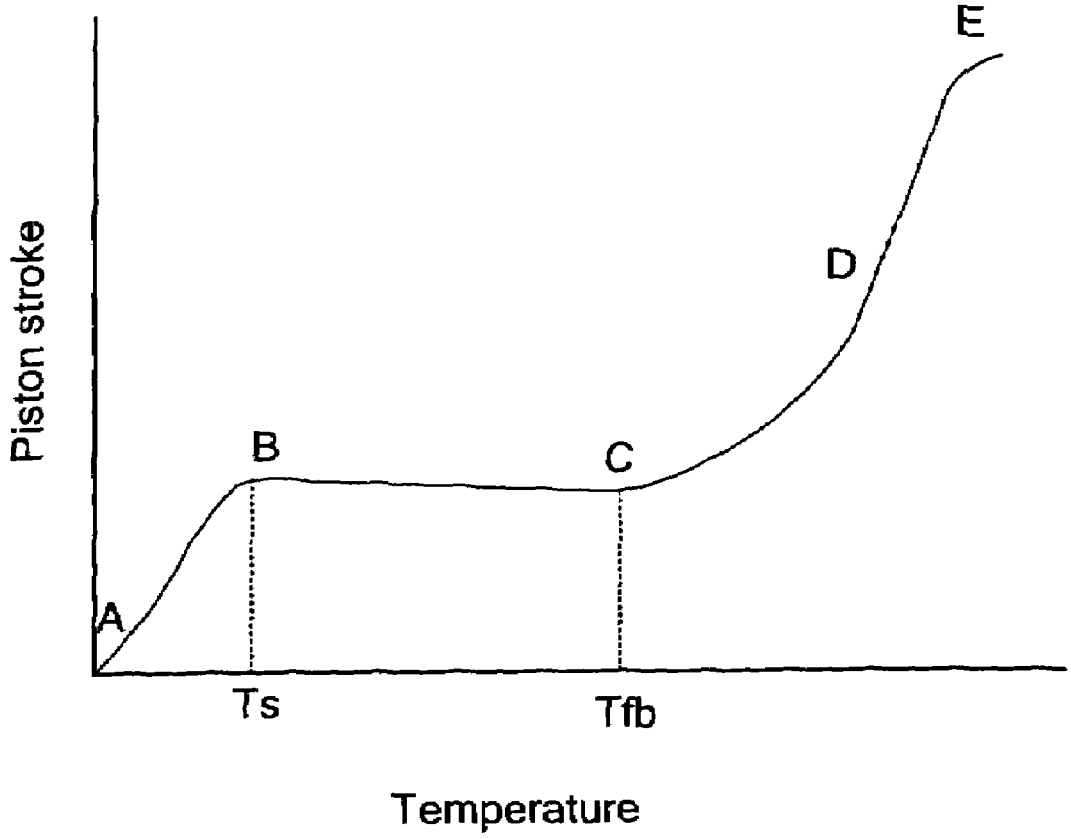
FIG. 12A is a graphical representation showing a flow curve of a flow tester used in the thermal property evaluation.
Figure 12B:
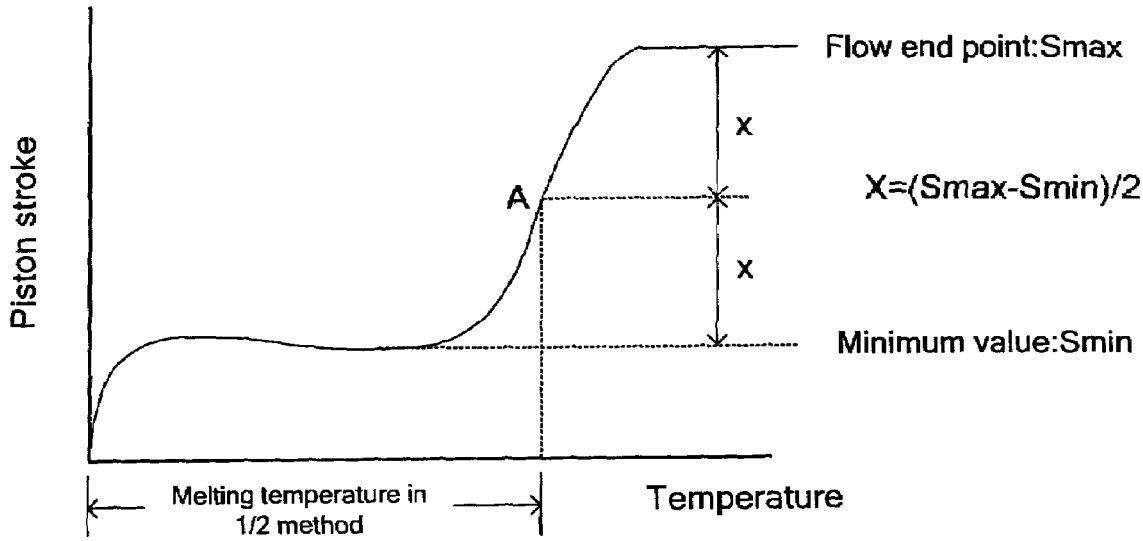
FIG. 12B is a graphical representation showing a flow curve of a flow tester used in the thermal property evaluation.

Thermal properties were determined from a flow curve (FIGS. 12A and 12B) measured by a capillary flow tester CFT500 model (manufactured by Shimazu Corporation). In FIGS. 12A and 12B, Ts is a softening temperature and Tfb is a flow-beginning temperature. The temperature of the 1/2 method is the 1/2 method softening point (T1/2). The measurement was conducted under the condition of a load of 10 kg/cm$^2$, a heating rate of 3.0° C./min., a die diameter of 0.50 mm, and a die length of 10.0 mm.

(c) Fixing Property (Offset-Occurring Temperature and the Lowest Fixing Temperature)

Fixing property (offset-occurring temperature and the lowest fixing temperature) was evaluated using a tandem type color image-forming apparatus (imagioNeo 450, manufactured by Ricoh Company, Ltd.), regular papers (TYPE 6200, manufactured by Ricoh Company, Ltd.), and thick transfer sheets (copy sheets <135>, manufactured by NBS Ricoh Co., Ltd.). The tandem type color image-forming apparatus had an ability of continuously printing 45 sheets of A4 size per minute.

<Offset-Occurring Temperature >

The tandem type color image-forming apparatus was adjusted for forming images in single solid colors, yellow, magenta, cyan, and black, and images in intermediate solid colors, red, blue, and green, on regular papers by 1.0±0.1 mg/cm$^2$ of toner. The obtained images were fixed by a fixing belt (a heating roller) at different temperatures and the lowest fixing temperature at which the offset occurs (the offset-occurring temperature) was determined.

<Lowest Fixing Temperature>

Image copy test was conducted using the above tandem type color image-forming apparatus and the above thick sheets. The lowest fixing temperature was defined as a temperature of the fixing roller at which the image density was retained 70% or more after the obtained fixed image was scraped with a pat.

(c) Image/Density

Solid images were formed by 1.00±0.1 mg/cm$^2$ of each developer on transfer sheets (TYPE 6200, manufactured by Ricoh Company, Ltd.) using a tandem type color image-forming apparatus (imagioNeo 450, manufactured by Ricoh Company, Ltd.) with the fixing roller at 160±2° C. The image density of the obtained solid images was measured at any five points using a spectrometer (938 Spectrodensitometer, manufactured by X-Rite K.K.). The five image densities were averaged to obtain an image density score. The higher the image density score was, the higher the image densities were, indication that a high density image was formed. When an image has an image density of 1.4 or higher, the image is assumed to be at a practical level.

(e) Background Smear

The image-forming apparatus (imagio Neo450, manufactured by Ricoh Company Ltd.) was forcedly terminated after the developing step for developing a blank image and before the cleaning step for cleaning the photoconductor, and the residual developer on the photoconductor after the developing step was transferred to a tape. The difference in image density between the transferred tape and an untransferred tape was measured using a spectrometer (938 Spectrodensitometer, by X-Rite K.K.).

(f) Cleaning Ability

Residual toner on the photoconductor after the cleaning step was transferred to a white sheet using a scotch tape (manufactured by Sumitomo 3M Ltd.) and measured by a Macbeth reflection densitometer (RD514 model) for evaluating cleaning ability according to the following criteria.

[Criteria]

A (good): difference from the blank is 0.01 or smaller.

B (no good): difference from the blank is larger than 0.1.

(g) Filming

The presence of toner filming on the developing roller or photoconductor was visibly observed and evaluated according to the following criteria.

[Criteria]

A: no filming was observed

B: streaky filming was observed

C: overall filming was observed.

(h) Heat Resistance Preservation

Each toner was introduced in a 50 ml glass jar and allowed to stand in a constant temperature bath at 50° C. for 20 hours. The toner was cooled to the room temperature and subjected to a penetration test (JIS K2235-1991) to determine a penetration rate (%). The heat resistance preservation was evaluated based on the penetrate ion rate (%) of densely packed toner according to the following criteria.

[Criteria]

A: a penetration rate is 60% or higher

B: a penetration rate is less than 60%

(i) Cracking Resistance 50 g of each developer was introduced in a 100 ml jar (manufactured by Nichiden-Rika Glass Co., Ltd.), stirred using a paint conditioner at 50 Hz for 30 minutes, subjected to electric field separation to separate the toner, and observed in scanning electronic microscopy (SEM). In the SEM observation, the ratio of cracked or disintegrated toner particles to 1000 toner particles (% by number) was determined to evaluate the toner for cracking resistance. Larger numbers indicate deteriorated cracking resistance.

TABLE 9

| | Particle diameter distribution | | | | Thermal property | |
|---|---|---|---|---|---|---|
| | Volume average particle diameter Dv (μm) | Number average particle diameter Dn (μm) | Dv/Dn | Shape Average circularity | Softening temperature Ts (° C.) | Flow-beginning temperature Tfb (° C.) |
| Example 7 | 7.5 | 6.75 | 1.11 | 0.965 | 57 | 106 |
| Example 8 | 7.8 | 6.34 | 1.23 | 0.911 | 56 | 100 |
| Example 9 | 5.3 | 4.86 | 1.09 | 0.975 | 58 | 103 |
| Example 10 | 3.9 | 3.42 | 1.14 | 0.960 | 54 | 91 |
| Example 11 | 6.5 | 5.46 | 1.19 | 0.945 | 53 | 87 |
| Example 12 | 6.8 | 5.48 | 1.24 | 0.923 | 54 | 96 |
| Example 13 | 4.8 | 4.17 | 1.15 | 0.965 | 50 | 82 |
| Comparative Example 3 | 6.5 | 5.16 | 1.26 | 0.985 | 57 | 107 |

TABLE 10

| | Fixing property | | Charging rate (-μC/g) | | | Image density | | |
|---|---|---|---|---|---|---|---|---|
| | Lowest fixing temperature (° C.) | Offset non-occuring temperature (° C.) | Biginning | After 10,000 sheet | After 100,000 sheet | Biginning | After 10,000 sheet | After 100,000 sheet |
| Example 7 | 140 | 220 or more | 28.6 | 26.2 | 25.5 | 1.43 | 1.42 | 1.40 |
| Example 8 | 130 | 220 or more | 26.5 | 24.1 | 23.9 | 1.43 | 1.43 | 1.41 |
| Example 9 | 130 | 220 or more | 25.3 | 23.5 | 22.7 | 1.42 | 1.41 | 1.39 |
| Example 10 | 125 | 220 or more | 27.2 | 24.5 | 23.1 | 1.45 | 1.42 | 1.40 |
| Example 11 | 120 | 220 or more | 25.3 | 22.7 | 21.6 | 1.45 | 1.40 | 1.38 |
| Example 12 | 125 | 220 or more | 27.6 | 23.7 | 21.9 | 1.43 | 1.41 | 1.39 |
| Example 13 | 115 | 220 or more | 26.3 | 24.3 | 23.0 | 1.42 | 1.41 | 1.40 |
| Comparative Example 3 | 145 | 220 or more | 27.5 | 25.7 | 24.2 | 1.42 | 1.39 | 1.38 |

TABLE 11

| | Background smear | | | Cleaning ability | | | Filming | | |
|---|---|---|---|---|---|---|---|---|---|
| | Start | After 10,000 sheet | After 100,000 sheet | Biginning | After 10,000 sheet | After 100,000 sheet | After 100,000 sheet | Heat resistance preservation | Cracking resistance |
| Example 7 | 0.00 | 0.01 | 0.02 | A | A | A | A | A | 0% |
| Example 8 | 0.00 | 0.01 | 0.01 | A | A | A | A | A | 0% |
| Example 9 | 0.00 | 0.01 | 0.01 | A | A | A | A | A | 0% |
| Example 10 | 0.00 | 0.00 | 0.01 | A | A | A | A | A | 0% |
| Example 11 | 0.00 | 0.01 | 0.01 | A | A | A | A | A | 0% |
| Example 12 | 0.01 | 0.00 | 0.00 | A | A | A | A | A | 0% |
| Example 13 | 0.00 | 0.01 | 0.01 | A | A | A | A | A | 0% |
| Comparative Example 3 | 0.01 | 0.14 | 0.25 | B | B | B | B | A | 17% |

The toner of the present invention has small-sized and potato-shaped particles created from multiple coherent spherical particles, whereby having excellent cleaning ability and being preferably used in forming high quality images.

The developer, toner container, process cartridge, image-forming apparatus, and an image-forming method of the present invention, all using the toner of the present invention, are preferably used in forming high quality images.

What is claimed is:

1. A toner, which is produced by a process comprising:

emulsifying or dispersing an organic phase in an acqueous phase, thereby forming oil droplets as primary oil droplets, wherein the organic phase comprises a binder resin and a colorant, and converging two or more of the primary oil droplets to form irregular-shaped particles, wherein the toner comprises the irregular-shaped particles, and the irregular shaped particles are potato-shaped particles.

2. The toner according to claim 1, wherein the organic phase is a solution and/or a dispersion of at least the binder resin and the colorant dissolved and/or dispersed in an organic solvent.

3. The toner according to claim 1, wherein the organic phase comprises at least a polymerizable monomer and the colorant.

4. The toner according to claim 1, wherein the potato-shaped particles satisfy $0.1\,R \leqq L < 1.0\,R$ in which R (μm) is the diameter of a spherical particle that is the primary oil droplets of the organic phase and L (μm) is the length along the depth of the coherent part between spherical particles.

5. The toner according to claim 1, wherein the toner contains 30% by number to 100% by number of the potato-shaped toner particles per 100 toner particles in electronic microscopic observation.

6. The toner according to claim 1, wherein the toner has a particle shape formed by 2 to 20 coherent spherical particles that are the primary oil droplets of the organic phase and contains 30% by number to 100% by number of the potato-shaped toner particles per 100 toner particles in electronic microscopic observation, and an imaginary circle around the spherical particles has a number-average diameter R of 0.5 μm to 7 μm.

7. A toner, which is produced by granulating in an aqueous medium comprising at least a binder resin and a colorant, wherein the toner contains 10% by number or less of cracked or disintegrated toner particles per 1000 toner particles in electronic microscopic observation after 50 g of a developer consisting of 2.5 g of the toner and 47.5 g of a carrier is stirred in a 100 ml jar at 50 Hz for 30 minutes using a paint conditioner.

8. The toner according to claim 1, wherein the toner has an average circularity of 0.900 to 0.980.

9. The toner according to claim 1, wherein the toner has a glass transition temperature (Tg) of 40° C. to 70° C.

10. The toner according to claim 1, wherein the toner has a volume-average particle diameter (Dv) of 3 μm to 8 μm.

11. The toner according to claim 1, wherein the toner has a ratio (Dv/Dn) of volume-average particle diameter (Dv) to number average particle diameter (Dn) of 1.05 to 1.25.

12. The toner according to claim 1, wherein the toner has an acid number of 1.0 KOHmg/g to 50.0 KOHmg/g.

13. The toner according to claim 1, wherein the toner is obtained by:

dissolving and/or dispersing toner materials including an active hydrogen group-containing compound, a polymer that is reactive with the active hydrogen group-containing compound, a colorant, and a releasing agent in an organic solvent to form a toner solution;

emulsifying and/or dispersing the toner solution in an aqueous medium to prepare a dispersion;

reacting the active hydrogen group-containing compound with the polymer that is reactive with the active hydrogen group-containing compound in the aqueous medium to granulate adhesive base materials; and removing the organic solvent.

14. The toner according to claim 13, wherein the polymer that is reactive with the active hydrogen group-containing compound has a mass-average molecular mass (Mw) of 3,000 to 40,000.

15. The toner according to claim 1, wherein the binder resin comprises a polyester resin and the content of the polyester resin in the toner is 50% by mass to 100% by mass.

16. The toner according to claim 15, wherein the THF-soluble moiety of the polyester resin has a mass-average molecular mass (Mw) of 1,000 to 30,000.

17. The toner according to claim 15, wherein the polyester resin has an acid number of 1.0 KOHmg/g to 50.0 KOHmg/g.

18. The toner according to claim 15, wherein the polyester resin has a glass transition temperature of 35° C. to 70° C.

19. The toner according to claim 1, wherein the toner comprises a crystalline polyester.

20. The toner according to claim 19, wherein the crystalline polyester has a DSC endothermic peak temperature of 50° C. to 150° C.

21. The toner according to claim 19, wherein the orthodichlorobenzene-soluble moiety of the crystalline polyester has an mass-average molecular mass (Mw) of 1,000 to 30,000, a number-average molecular mass (Mn) of 500 to 6,000, and a Mw/Mn ratio of 2 to 8 in the molecular mass distribution determined by gel permeation chromatography (GPC).

22. The toner according to claim 19, wherein the crystalline polyester has an infrared absorption spectrum having an absorption based on olefin δCH (out-of-plane deformation vibration) either at one of $965 \pm 1\ cm^{-1}$ or at $990 \pm 10\ cm^{-1}$.

23. A developer comprising a toner, wherein the toner is the toner according to claim 1.

24. A toner container, which is supplied with a toner, wherein the toner is the toner according to claim 1.

25. A process cartridge comprising:

a latent electrostatic image bearing member; and a developing unit configured to develop a latent electrostatic image formed on the latent electrostatic image bearing member using a toner, wherein the toner is the toner according to claim 1, whereby forming a visible image.

26. An image-forming method comprising:

forming a latent electrostatic image on a latent electrostatic image bearing member;

developing the latent electrostatic image using a toner to form a visible image;

transferring the visible image onto a recording medium; and fixing the transferred image on the recording medium, wherein the toner is the toner according to claim 1.

27. An image-forming apparatus comprising:

a latent electrostatic image bearing member;

a latent electrostatic image-forming unit configured to form a latent electrostatic image on the latent electrostatic image bearing member;

a developing unit configured to develop the latent electrostatic image using a toner to form a visible image;

a transferring unit configured to transfer the visible image onto a recording medium; and a fixing unit configured to fix the transferred image on the recording medium, wherein the toner is the toner according to claim 1.

* * * * *